US006308039B1

(12) United States Patent
Haneda et al.

(10) Patent No.: US 6,308,039 B1
(45) Date of Patent: Oct. 23, 2001

(54) APPARATUS FOR FIXING TONER IMAGES ON A TRANSFER MATERIAL

(75) Inventors: Satoshi Haneda; Kunio Shigeta; Hiroyuki Tokimatsu, all of Hachioji; Toshihide Miura, Koganei; Masahiro Onodera, Hachioji, all of (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/547,929

(22) Filed: Apr. 11, 2000

Related U.S. Application Data

(63) Continuation-in-part of application No. 09/343,041, filed on Jun. 29, 1999, now Pat. No. 6,157,805.

(30) Foreign Application Priority Data

| | | |
|---|---|---|
| Jul. 1, 1998 | (JP) | 10-186307 |
| Oct. 7, 1998 | (JP) | 10-285262 |
| Apr. 16, 1999 | (JP) | 11-109149 |
| Jun. 14, 1999 | (JP) | 11-166738 |

(51) Int. Cl.[7] ..... G03G 15/20

(52) U.S. Cl. ..... 399/328; 399/333

(58) Field of Search ..... 399/328, 330, 399/332, 333; 219/216

(56) References Cited

U.S. PATENT DOCUMENTS 5,659,853 * 8/1997 Matsudu et al. ..... 399/176
5,974,294 * 10/1999 Tange ..... 399/328

FOREIGN PATENT DOCUMENTS 8-240965 * 9/1996 (JP) .

* cited by examiner

*Primary Examiner*—Quana M. Grainger
(74) *Attorney, Agent, or Firm*—Jordan B. Bierman; Bierman, Muserlian and Lucas

(57) ABSTRACT

In a fixing apparatus for fixing toner images on a transfer material upon which toner images have been placed by applying heat to the transfer material, the fixing apparatus includes: a roll-shaped rotary member for applying heat to the transfer material upon which toner images have been placed, the roll-shaped rotary member including a cylindrical ray-transmitting base member, and a ray absorbing layer for generating heat onto the transfer material upon which toner images have been placed so as to fix the toner on the transfer material, the ray absorbing layer, provided on an outer side of the ray-transmitting base member; a ray irradiating device for irradiating ray to the ray absorbing layer, the ray irradiating device provided inside the cylindrical ray-transmitting base member; bearing member for rotatably supporting the roll-shaped rotary member; flange members provided on both ends of the ray-transmitting base member; and an elastic covering member provided between the flange member and the roll-shaped rotary member for joining each member.

24 Claims, 34 Drawing Sheets

FIG. 21 ( a )
RECORDING SHEET PASSING TIMING
1ST RECORDING SHEET PASSES
2ND RECORDING SHEET PASSES
FIG. 21 ( b )
TEMPERATURE CONTROL FOR UPPER ROTARY MEMBER FOR HEAT WAVE FIXING
T1
T
FIG. 21 ( c )
TEMPERATURE CONTROL FOR LOWER ROTARY MEMBER FOR HEAT WAVE FIXING
T2
T

FIG. 22 ( a )

RECORDING SHEET PASSING TIMING

FIG. 22 ( b )

TEMPERATURE CONTROL FOR UPPER ROTARY MEMBER FOR HEAT WAVE FIXING

FIG. 22 ( c )

TEMPERATURE CONTROL FOR LOWER ROTARY MEMBER FOR HEAT WAVE FIXING

FIG. 23 ( a )
RECORDING SHEET PASSING TIMING
1ST RECORDING SHEET PASSES
2ND RECORDING SHEET PASSES
FIG. 23 ( b )
TEMPERATURE CONTROL FOR UPPER ROTARY MEMBER FOR HEAT WAVE FIXING
T1
T
FIG. 23 ( c )
TEMPERATURE CONTROL FOR LOWER ROTARY MEMBER FOR HEAT WAVE FIXING
T2
T

FIG. 32A
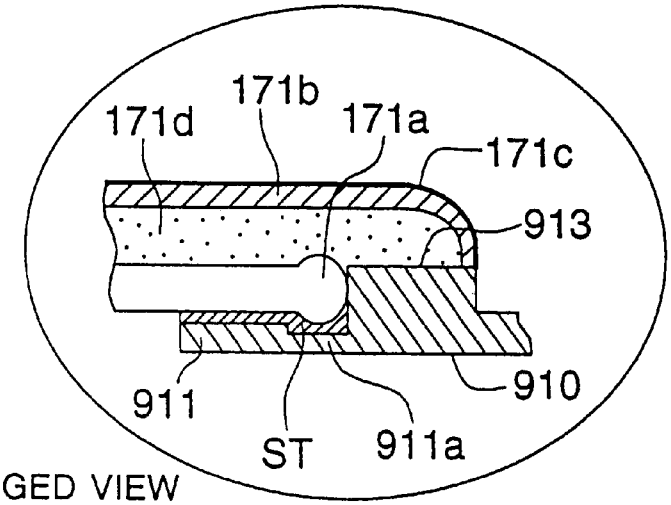
ENLARGED VIEW
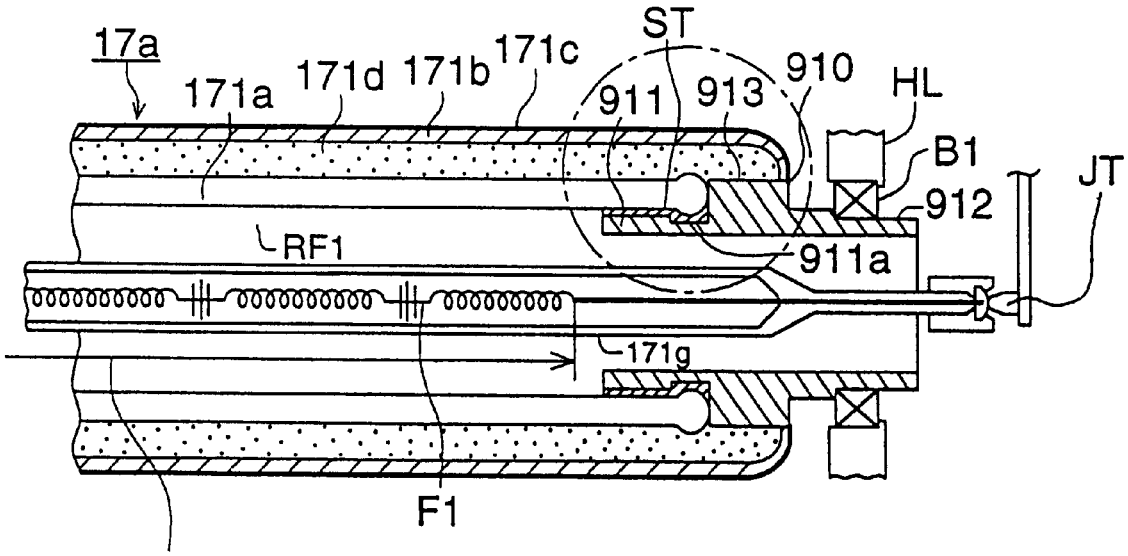
HEAT GENERATION AREA
FIG. 32B

APPARATUS FOR FIXING TONER IMAGES ON A TRANSFER MATERIAL

This application is a continuation-in-part of U.S. patent application Ser. No. 09/343,041, filed on Jun. 29, 1999 now U.S. Pat. No. 6,157,805.

BACKGROUND OF THE INVENTION

The present invention relates to a fixing apparatus for use in an image forming apparatus such as a copying machine, a printer and a facsimile machine and in particular, to a fixing apparatus for quick start fixing capable of heating instantly.

As a fixing apparatus used for an image forming apparatus such as a copying machine, a printer and a facsimile machine, a heat roller fixing system has widely been used, covering from a low speed machine to a high speed machine and from a monochromatic machine to a full-color machine, as a stable system which is highly completed technically.

However, in the conventional fixing apparatus of a heat roller fixing system, when heating a transfer material or toner, an effect of energy conservation is poor to be disadvantageous on the aspect of energy conservation because it is necessary to heat a fixing roller having large heat capacity, and it is time-consuming to warm a fixing apparatus in the case of printing, resulting in a long printing time (warming-up time), which is a problem.

To solve the problem stated above, there has been proposed a fixing apparatus of a film fixing system wherein a film (a heat fixing film) is used so that a heat roller may have an ultimate thickness of a heat fixing film to be of a low heat capacity, and temperature-controlled heater (a ceramic heater) is directly brought into pressure contact with the heat fixing film to improve thermal conduction efficiency sharply, thereby energy conservation and quick start which hardly requires warming-up time are achieved, and an image forming apparatus employing the fixing apparatus of a film fixing system has been proposed, and both of them are used recently.

Further, as a variation of a heat roller, Japanese TOKKAISHO Nos. 52-106741, 57-82240, 57-102736 and 57-102741 disclose a fixing method wherein a light-transmitting base body is used as a fixing roller (a rotary member for fixing), and heat wave emitted from a halogen lamp (ray irradiating device) provided inside the light-transmitting base body is irradiated on toner for heating and fixing to attain quick start without requiring warming-up time. Further, Japanese TOKKAISHO No. 59-65867 discloses a fixing method wherein a fixing roller (a rotary member for fixing) is structured by providing a light-absorbing layer on the outer circumferential surface of a light-transmitting base body, and light emitted from a halogen lamp provided inside a cylindrical light-transmitting base body is absorbed by the light-absorbing layer provided on the outer circumferential surface of the light-transmitting base body, and toner images are fixed by heat of the light-absorbing layer.

However, in the method disclosed by Japanese TOKKAISHO No. 52-106741 wherein a heat wave emitted from a halogen lamp is irradiated through the light-transmitting base body for heating and fixing toner, and in the method disclosed by Japanese TOKKAISHO No. 59-65867 wherein a fixing roller (a rotary member for heat wave fixing) is structured by providing a light-absorbing layer on the outer circumferential surface of the light-transmitting base body, and a heat wave emitted from a halogen lamp is irradiated on the light-absorbing layer through the light-transmitting base body to fix toner with heat of the light-absorbing layer, there are caused problems of separation or damage of the joint portion with a flange member of an end portion of the light-transmitting base body of the rotary member for heat wave fixing, due to the rotary torque pressure applied on the rotary member for heat wave fixing and to the thermal expansion, because a cylindrical glass member is mainly used as a material of the light-transmitting base body, although energy conservation and quick start with shortened warming-up time are achieved. There are further problems that accuracy of an inside diameter or of an outside diameter of the light-transmitting base body is poor, which makes it difficult for the light-transmitting base body to be centered.

Further, in the disclosure of Japanese TOKKAISHO No. 59-65867, a cylindrical glass member is mainly used as a material of the light-transmitting base body, and a flange member serving as a bearing which is mainly made of metal is used to be fitted in the glass member. In this case, the thermal expansion of the flange member is greater than that of the light-transmitting base body, and when the flange member is made accurately, the light-transmitting base body is cracked from its end portion by the thermal expansion of the flange member, which is a problem. In particular, the glass end portion of the light-transmitting base body is easily broken because it already has microscopic cracks which are caused when the glass end portion is cut, and therefore, the end portion is baked so that it is melted. However, because of the reasons that cracks are not eliminated completely and the end face is deformed to be rounded and swelled, the cracks running from the end portion of the light-transmitting base body which comes in contact with the flange member still tend to be caused easily. Therefore, when the flange member is expanded thermally by heat in the course of fixing, the thermal expansion of the flange member causes cracks which start from the end portion of the light-transmitting base body, which is a problem.

SUMMARY OF THE INVENTION

The first object of the invention is to solve the problems stated above and to provide a fixing apparatus wherein split and damage of an end portion of a ray-transmitting base member of a rotary member for fixing are prevented, and the ray-transmitting base member can be accurately centered.

The second object of the invention is to solve the problems stated above and to provide a fixing apparatus for quick start fixing capable of heating instantly wherein breakage of a ray-transmitting base member from its end portion caused by thermal expansion of a flange member can be prevented.

The first structure for achieving the first object mentioned above is attained by a fixing apparatus for fixing toner images on a transfer material by applying heat on the transfer material, wherein a roll-shaped rotary member for applying heat is formed by providing a cylindrical ray-transmitting base member housing therein a ray irradiating device for irradiating ray and providing a ray absorbing layer for generating heat on the outer side of the ray-transmitting base member, then flange members are provided on both ends of the ray-transmitting base member, and the flange member is joined with the ray-transmitting base member through a joining elastic layer.

The second structure for achieving the first object mentioned above is attained by a fixing apparatus for fixing toner images on a transfer material by applying heat on the transfer material, wherein a roll-shaped rotary member for applying heat is formed by providing a cylindrical ray-transmitting base member housing therein a ray irradiating device for irradiating ray and providing a resilient layer and a ray absorbing layer for generating heat in this order on the outer side of the ray-transmitting base member, then flange members are provided on both ends of the ray-transmitting base member, and the flange member is in contact with the ray-transmitting base member through a joining elastic layer.

The first structure for achieving the second object mentioned above is attained by a fixing apparatus for fixing toner images formed on a transfer material by applying heat on the transfer material, wherein a roll-shaped rotary member for applying heat is formed by providing a cylindrical ray-transmitting base member housing therein a ray irradiating device for irradiating ray and providing a ray absorbing layer for generating heat on the outer side of the ray-transmitting base member, and a flange member having grooves or slits is in contact with an end of the ray-transmitting base member through an elastic member to be fitted in a bore of the ray-transmitting base member of the rotary member for heat fixing.

The second structure for achieving the second object mentioned above is attained by a fixing apparatus for fixing toner images formed on a transfer material by applying heat on the transfer material, wherein a roll-shaped rotary member for applying heat is formed by providing a cylindrical ray-transmitting base member housing therein a ray irradiating device for irradiating ray and providing a ray absorbing layer for generating heat on the outer side of the ray-transmitting base member, a conductive flange member which is in contact with an inside of the ray-transmitting base member is provided on the end portion of the ray-transmitting base member, a clearance between the flange member and an inner wall surface of the ray-transmitting base member at an end portion of fitting between them is set to be greater, and the flange member is in contact with an end portion of the ray-transmitting base member through an elastic member.

Figure 1:
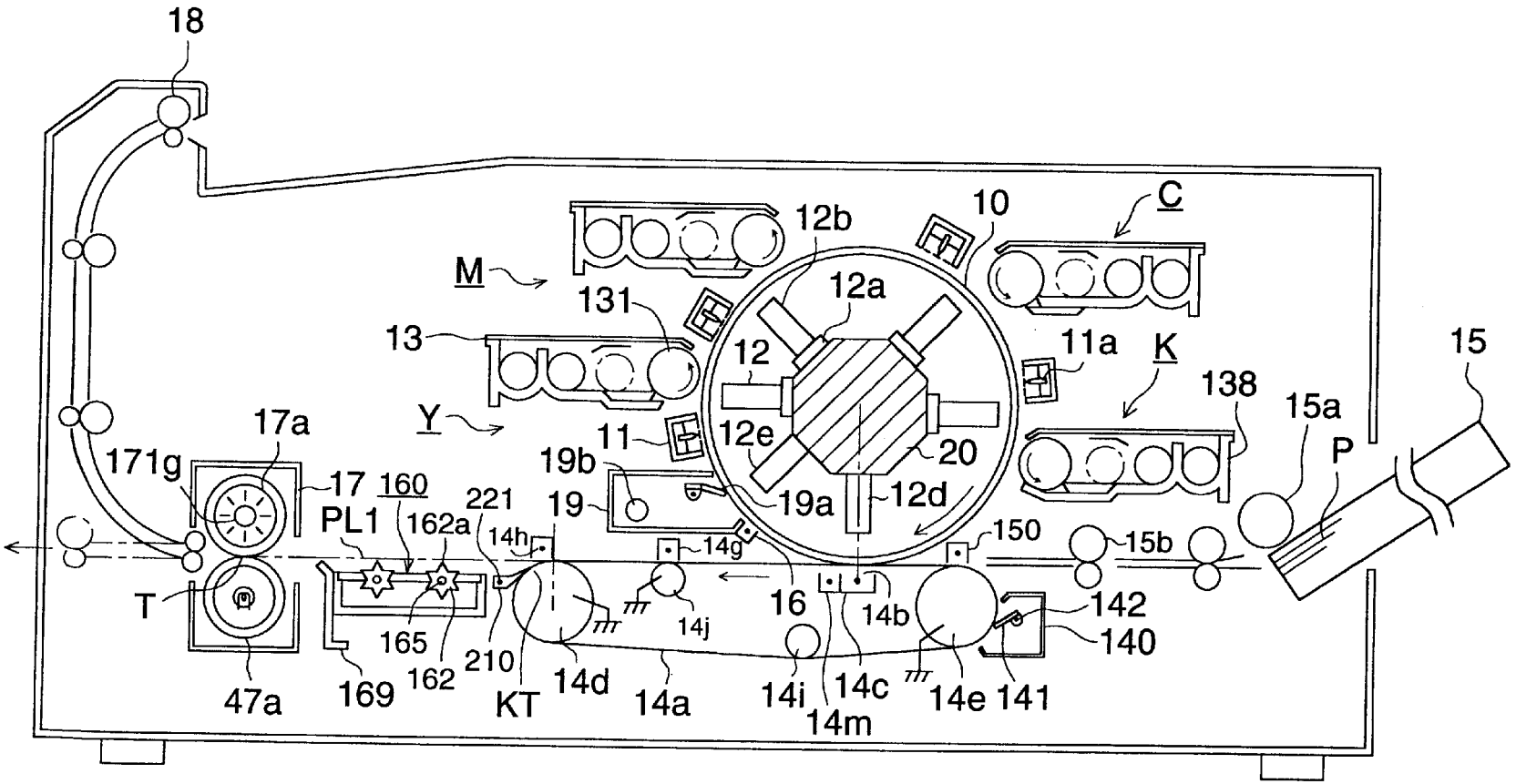
FIG. 1 is a sectional structure diagram of a color image forming apparatus showing an embodiment of a fixing apparatus related to the invention and of an image forming apparatus employing the fixing apparatus.
Figure 2:
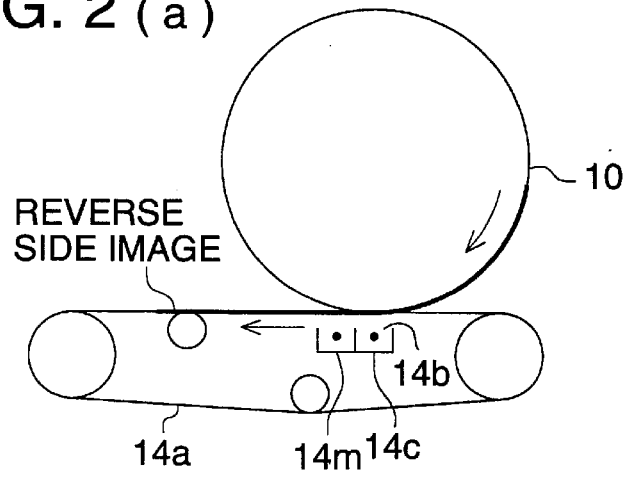
Figure 2:
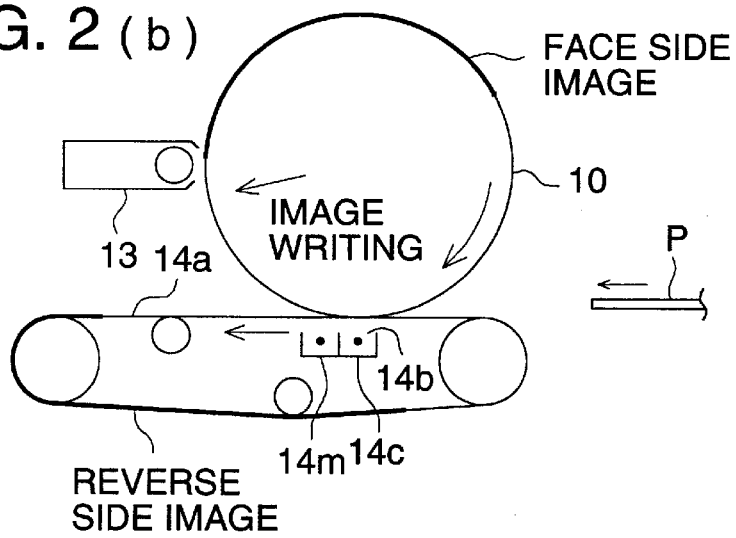
Figure 2:
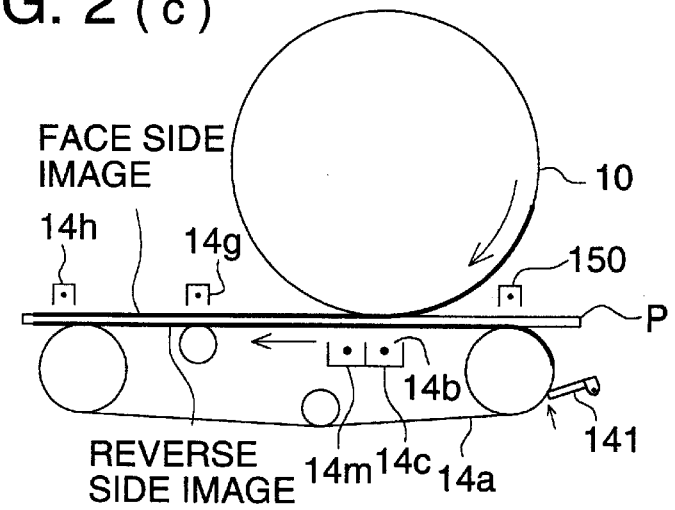

Each of FIGS. 2(*a*), 2(*b*) and 2(*c*) is a diagram showing how toner images are formed in the image forming apparatus shown in FIG. 1.

Figure 3:
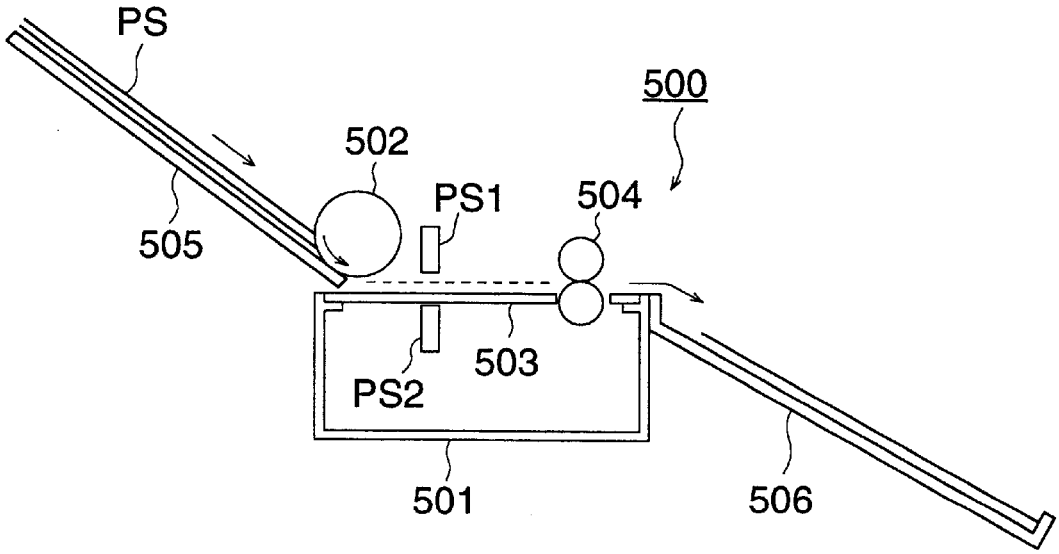

FIG. 3 is a diagram showing an example of an original image reading means.

Figure 4:
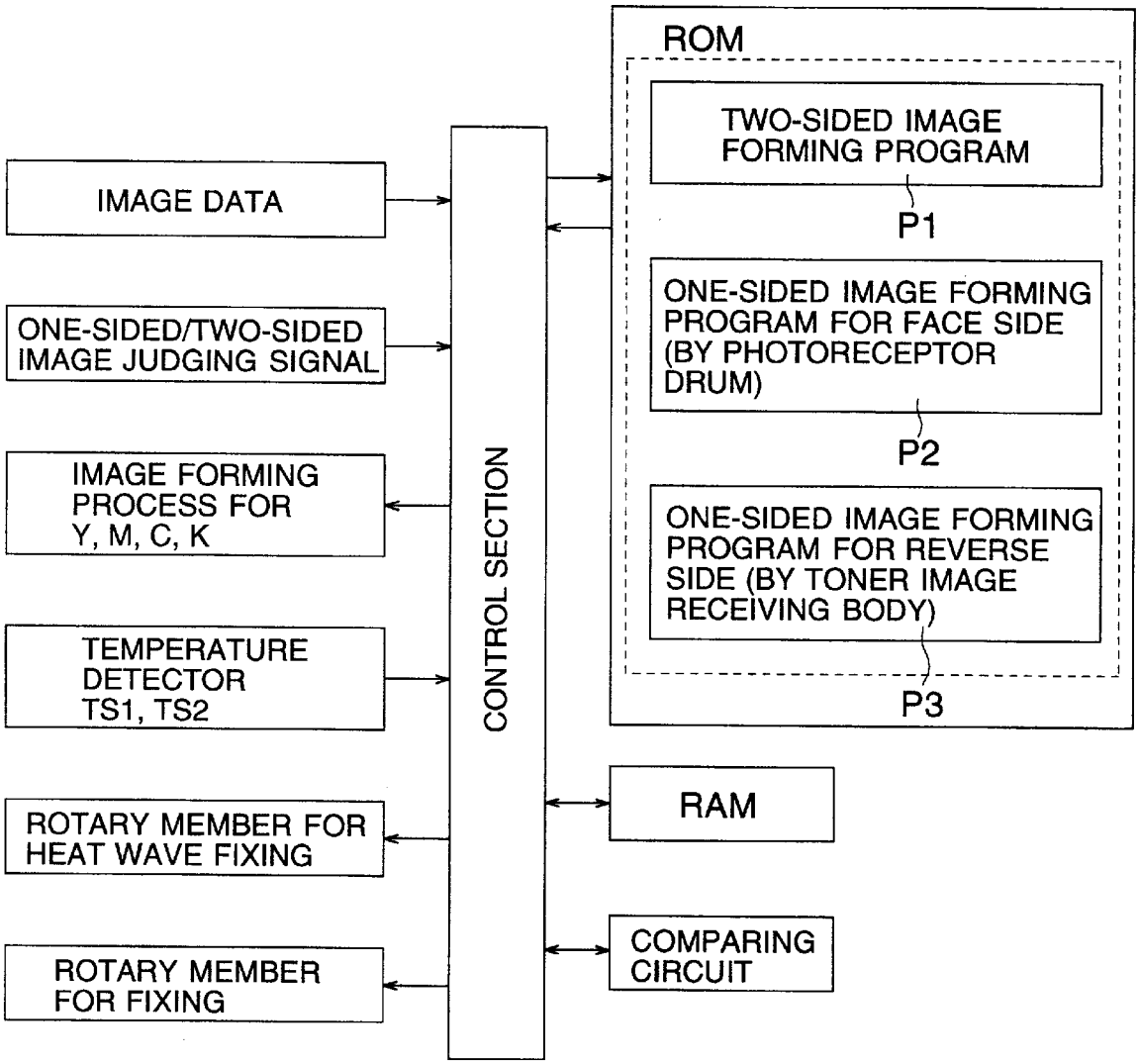

FIG. 4 is a block diagram of a control circuit of an image forming apparatus.

Figure 5:
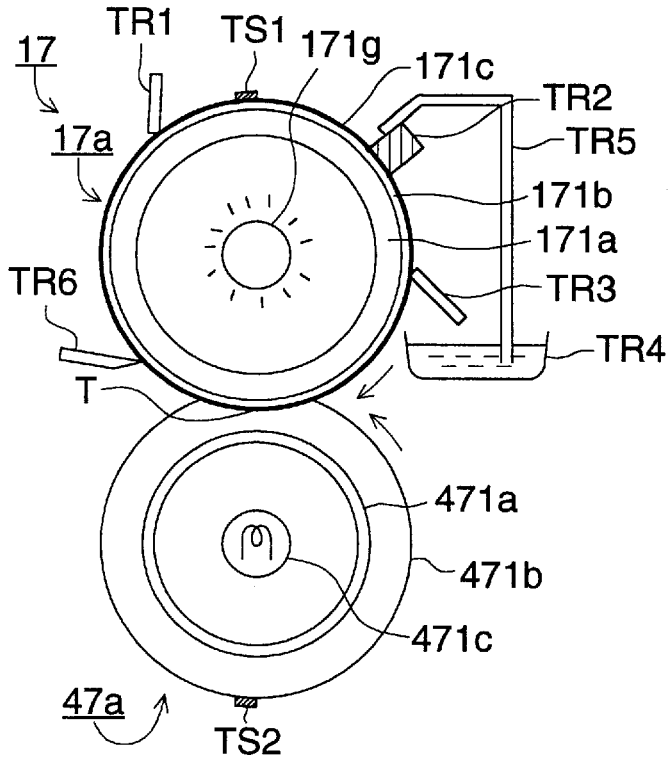

FIG. 5 is an illustration showing the structure of the first example of a fixing apparatus.

Figure 6:
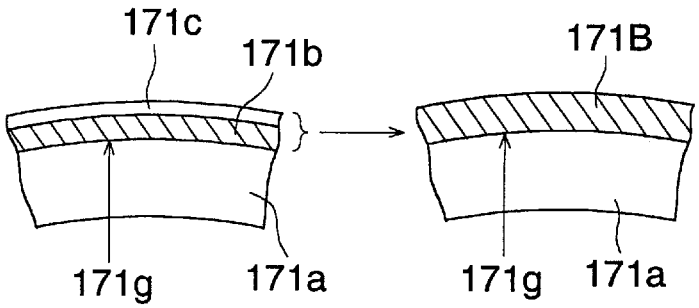

Each of FIGS. 6(*a*) and 6(*b*) is an enlarged sectional structure diagram of the first example of a roll-shaped rotary member for fixing.

Figure 7:
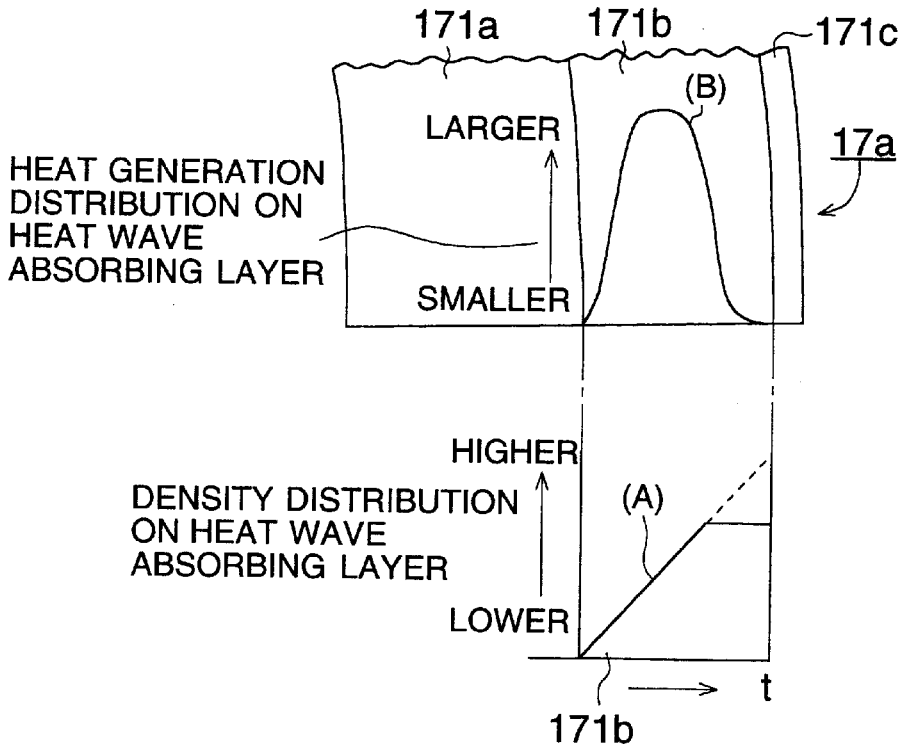

FIG. 7 is a diagram showing density distribution on a ray absorbing layer of the first example of a roll-shaped rotary member for fixing.

Figure 8:
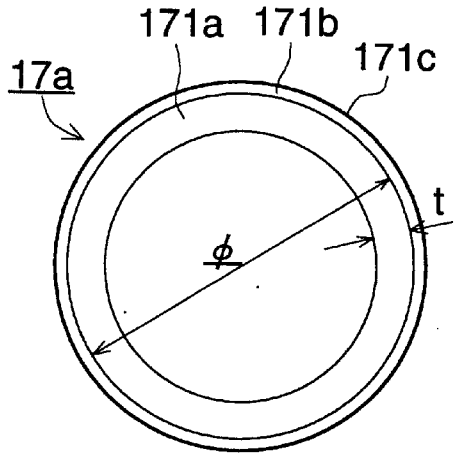

FIG. 8 is a diagram showing an outside diameter and a thickness of a ray-transmitting base member of the first example of a roll-shaped rotary member for fixing.

Figure 9:
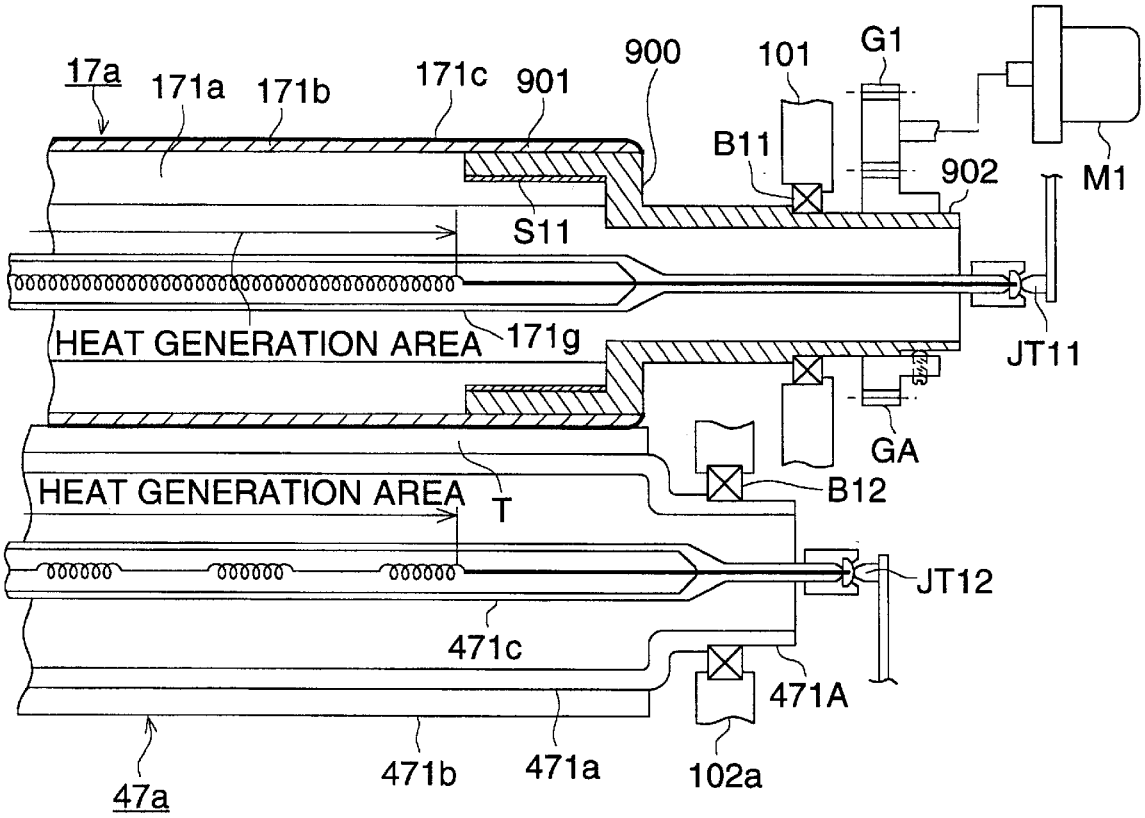

FIG. 9 is a sectional structure diagram of a rollshaped rotary member for fixing provided on the upper side and of a roll-shaped rotary member for fixing provided on the lower side in FIG. 5.

Figure 10:
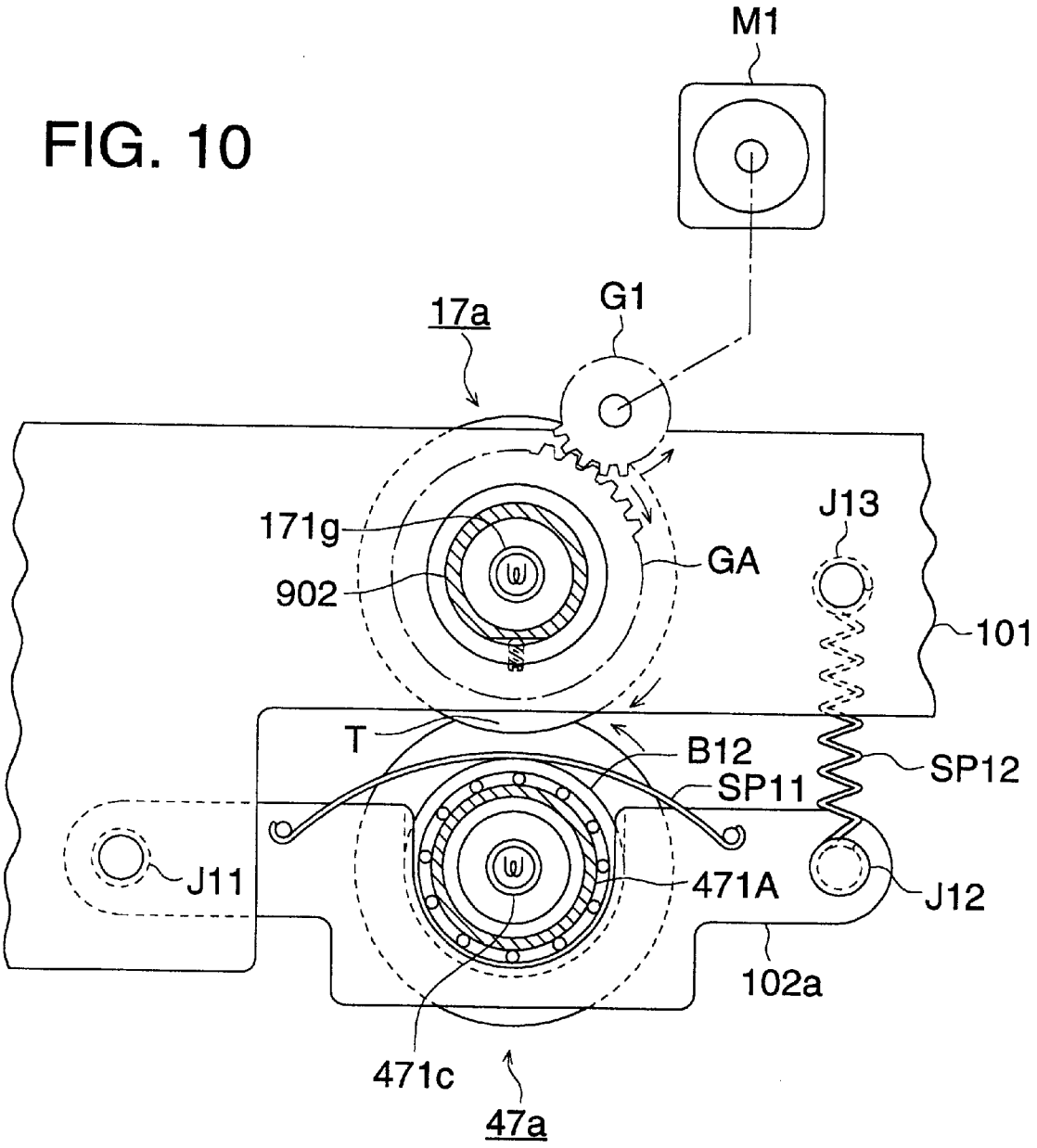

FIG. 10 is a side view showing pressure contact and driving for the upper and lower rollers in FIG. 9.

Figure 11:
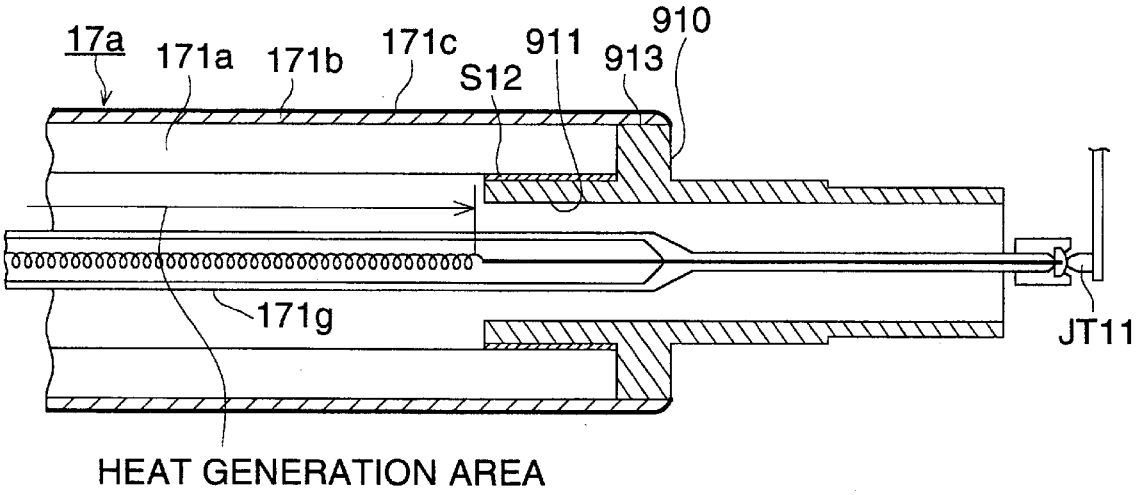

FIG. 11 is a diagram showing another example of the flange member in FIG. 9.

Figure 12:
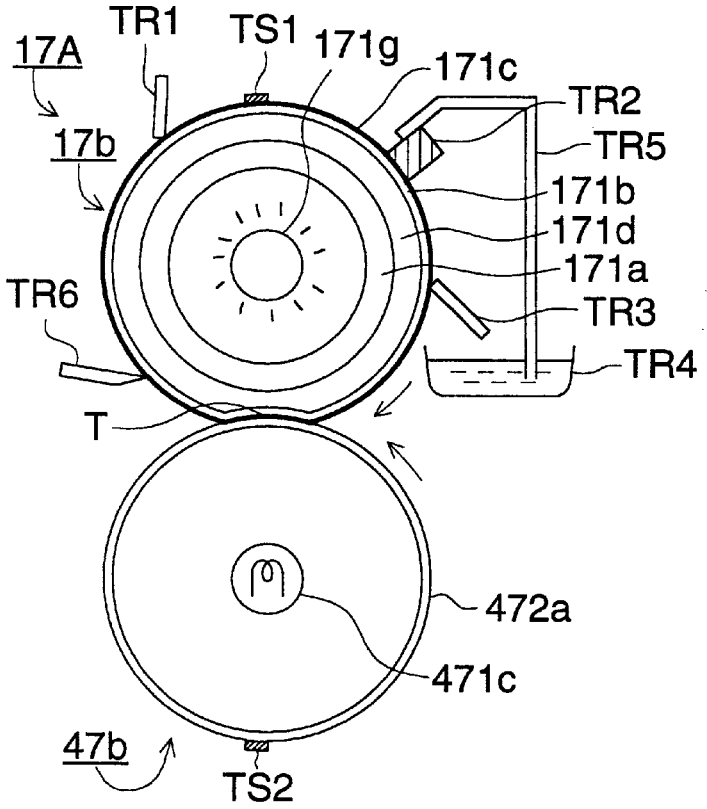

FIG. 12 is an illustration showing the structure of the second example of a fixing apparatus.

Figure 13:
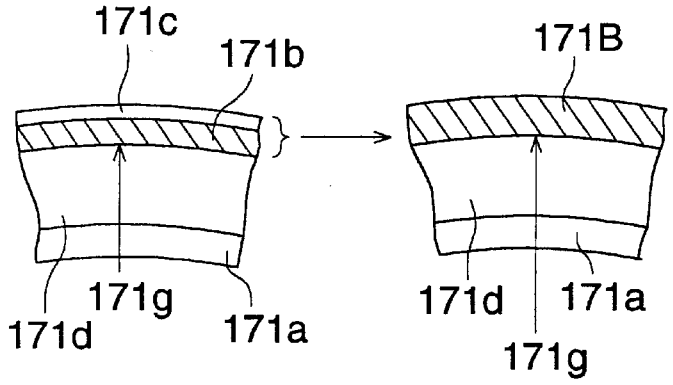

Each of FIGS. 13(*a*) and 13(*b*) is an enlarged sectional structure diagram of the second example of a roll-shaped rotary member for fixing.

Figure 14:
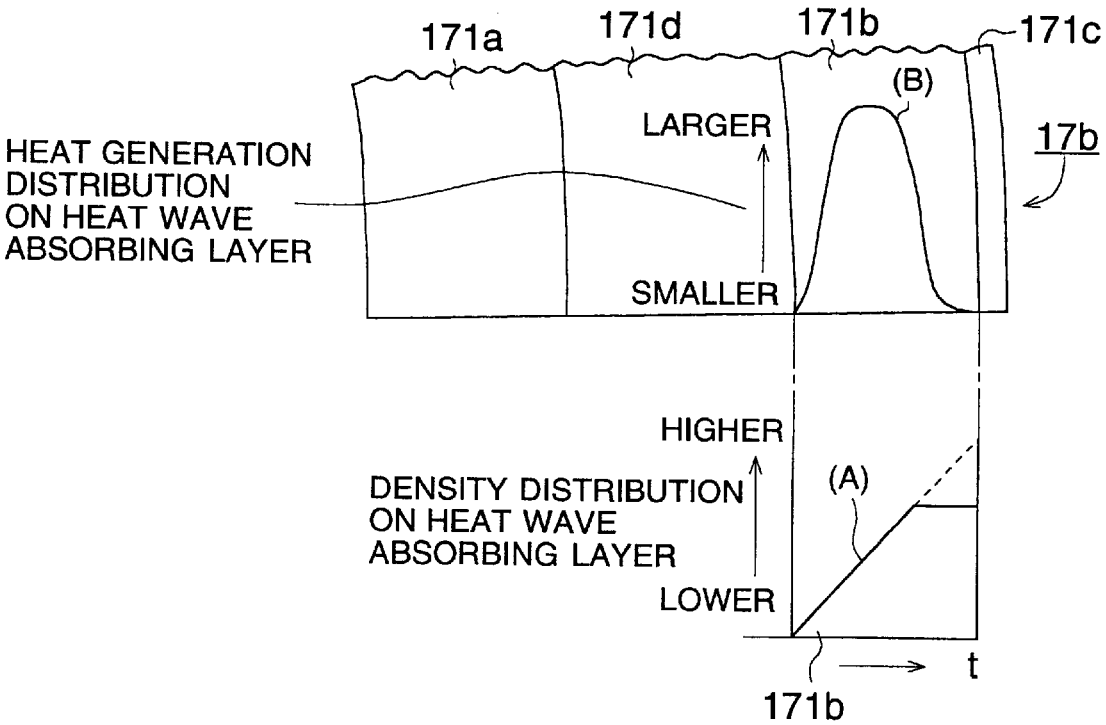

FIG. 14 is a diagram showing density distribution on a ray absorbing layer of the second example of a roll-shaped rotary member for fixing.

Figure 15:
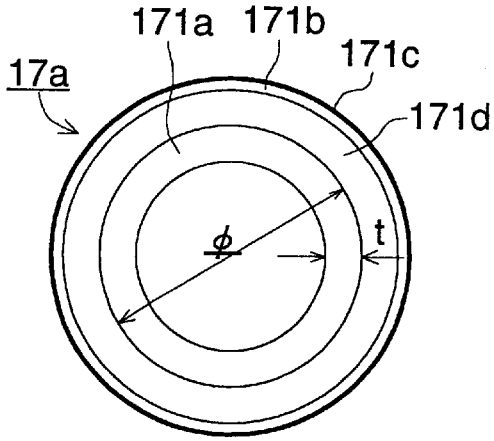

FIG. 15 is a diagram showing an outside diameter and a thickness of a ray-transmitting base member of the second example of a roll-shaped rotary member for fixing.

Figure 16:
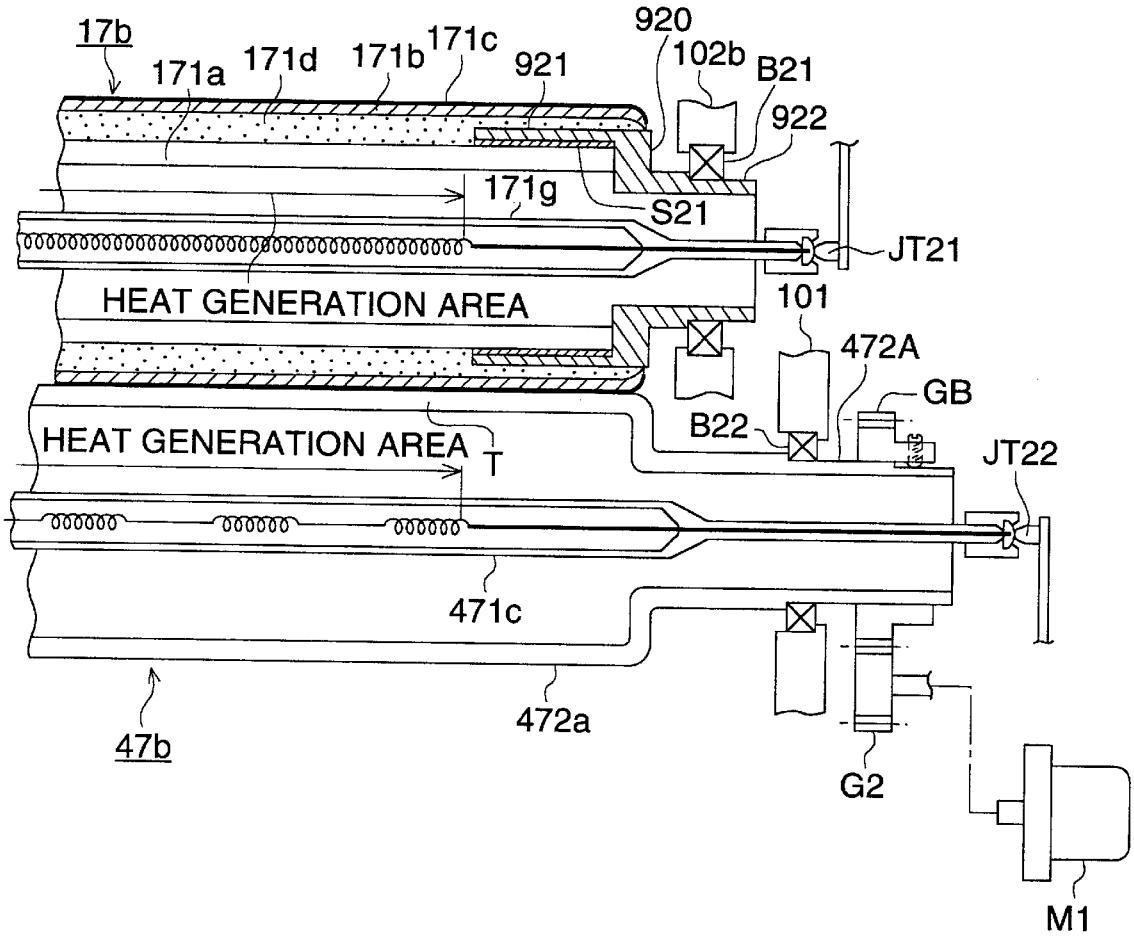

FIG. 16 is a sectional structure diagram of a rollshaped rotary member for fixing provided on the upper side and of a roll-shaped rotary member for fixing provided on the lower side in FIG. 12.

Figure 17:
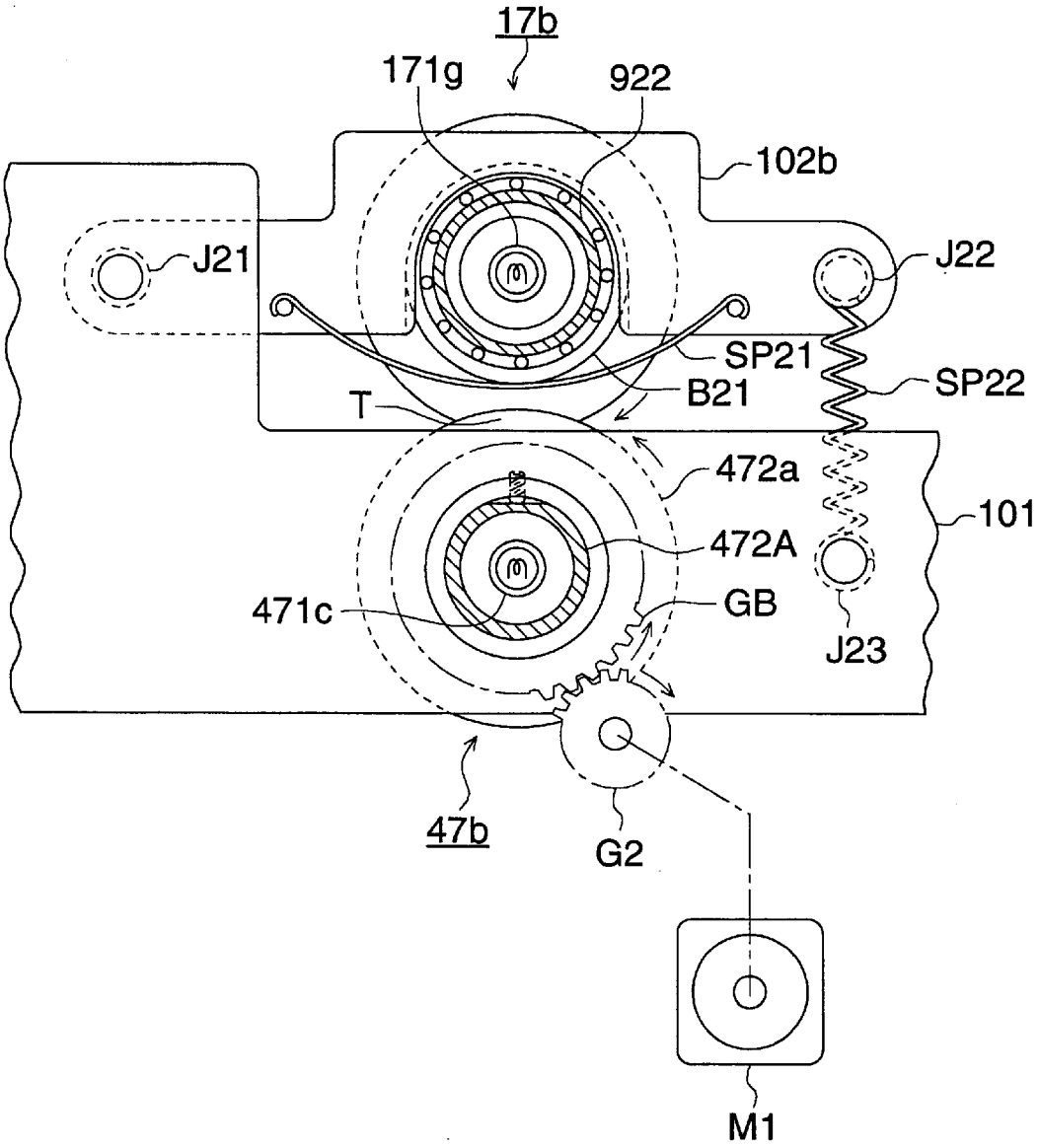

FIG. 17 is a side view showing pressure contact and driving for the upper and lower rollers in FIG. 16.

Figure 18:
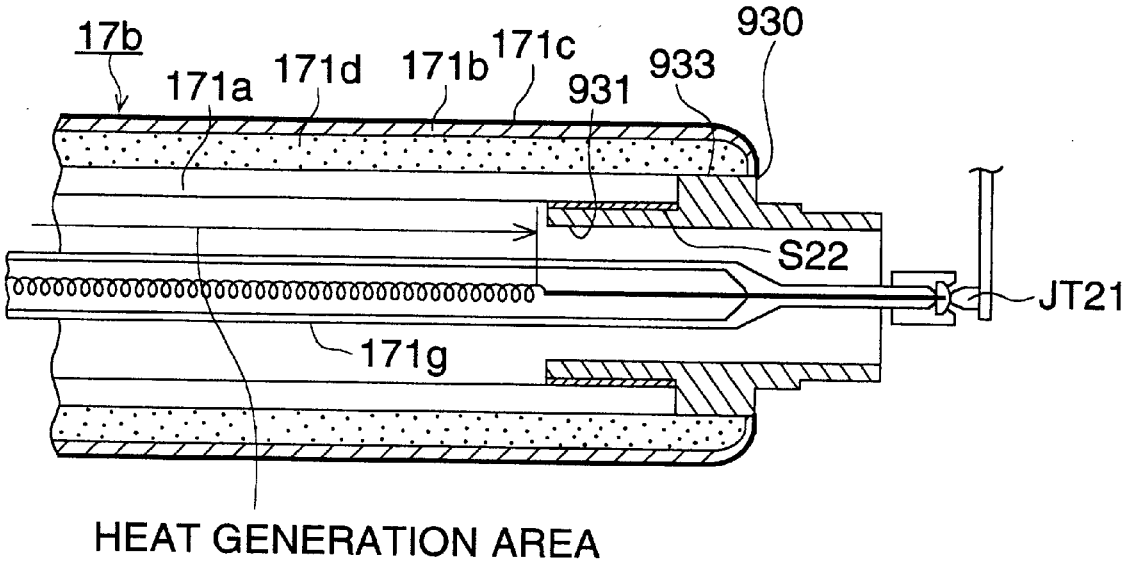

FIG. 18 is a diagram showing another example of the flange member in FIG. 16.

Figure 19:
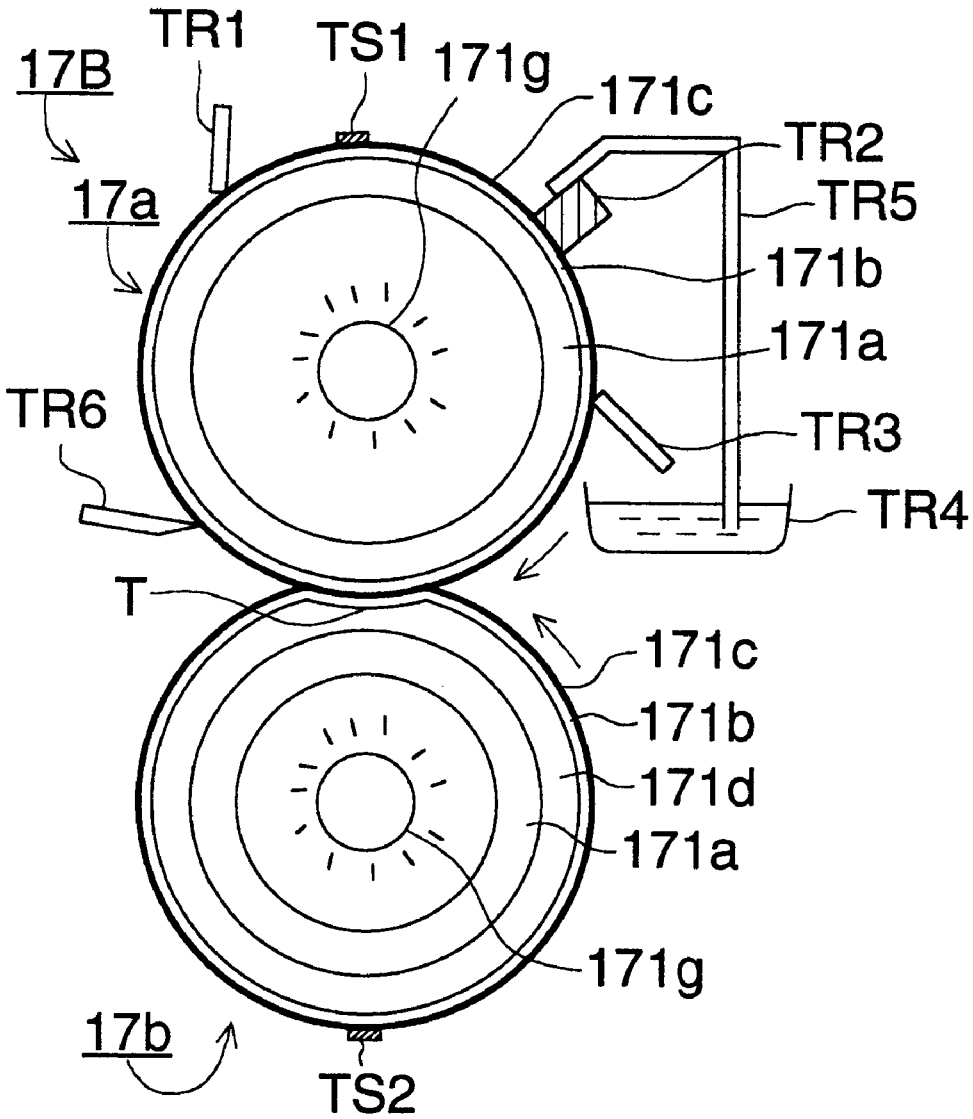

FIG. 19 is a diagram showing a fixing apparatus of the third example of two-sided fixing wherein a roll-shaped rotary member for fixing for instant heating of the first example and a roll-shaped rotary member for fixing for instant heating of the second example are used as a pair.

Figure 20:
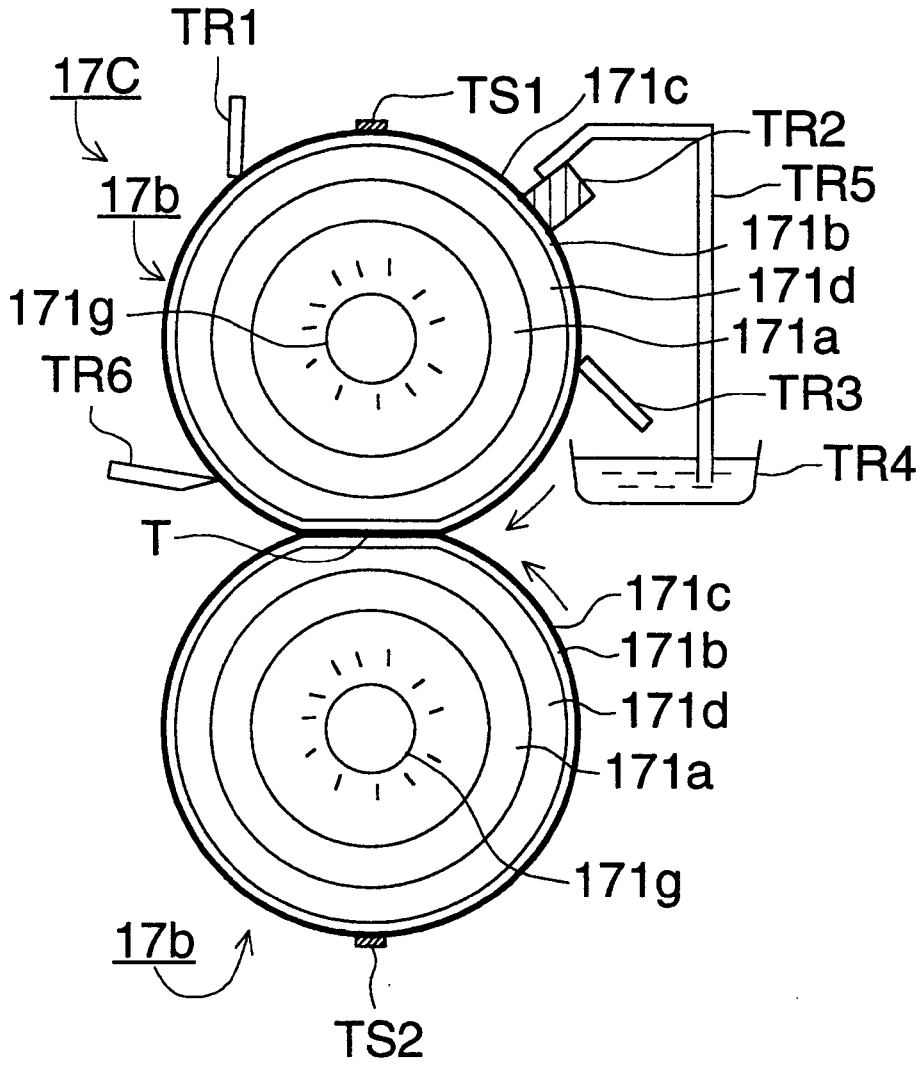

FIG. 20 is a diagram showing a fixing apparatus of the fourth example of two-sided fixing wherein roll-shaped rotary members for fixing for instant heating of the second example are used as a pair.

Figure 21:
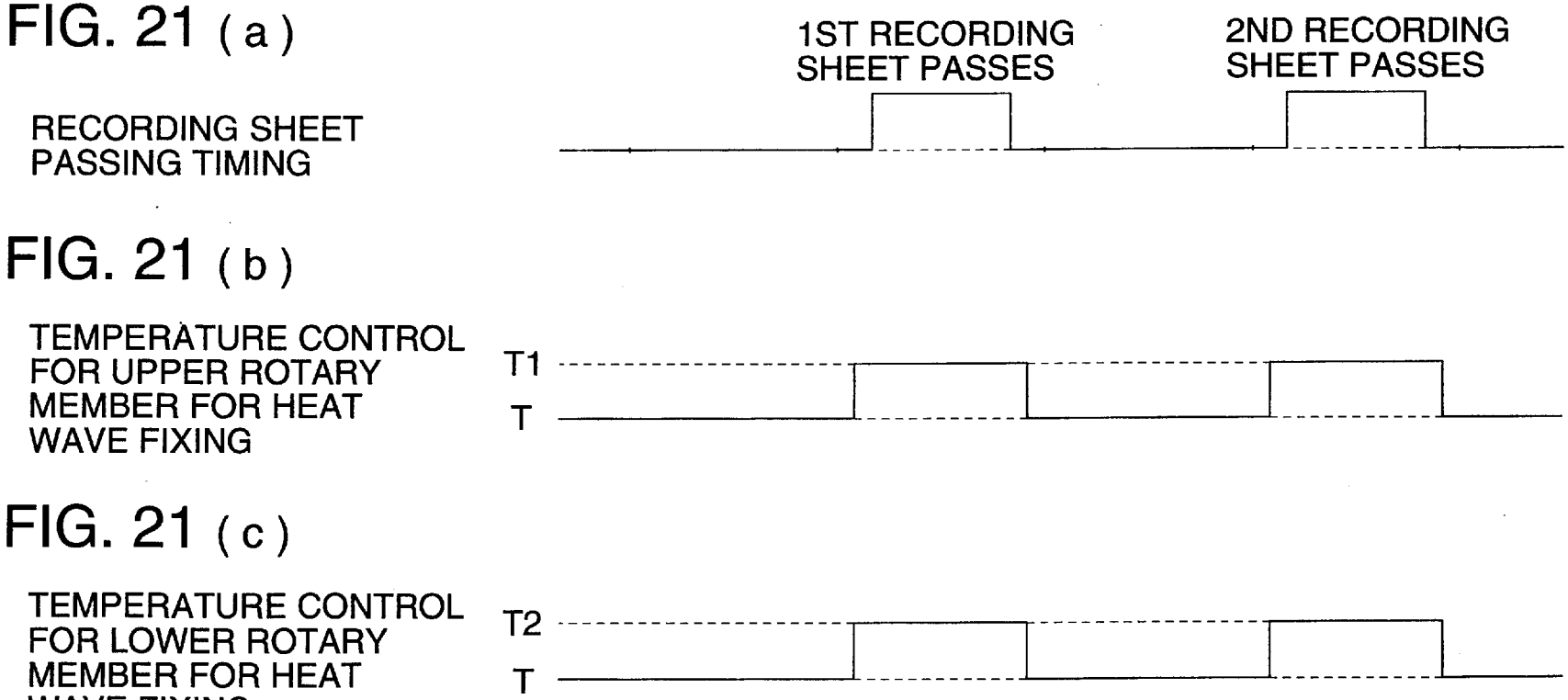

Each of FIGS. 21(*a*), 21(*b*) and 21(*c*) is a temperature control timing chart in two-sided image forming wherein a fixing apparatus of the third or fourth example is used.

Figure 22:
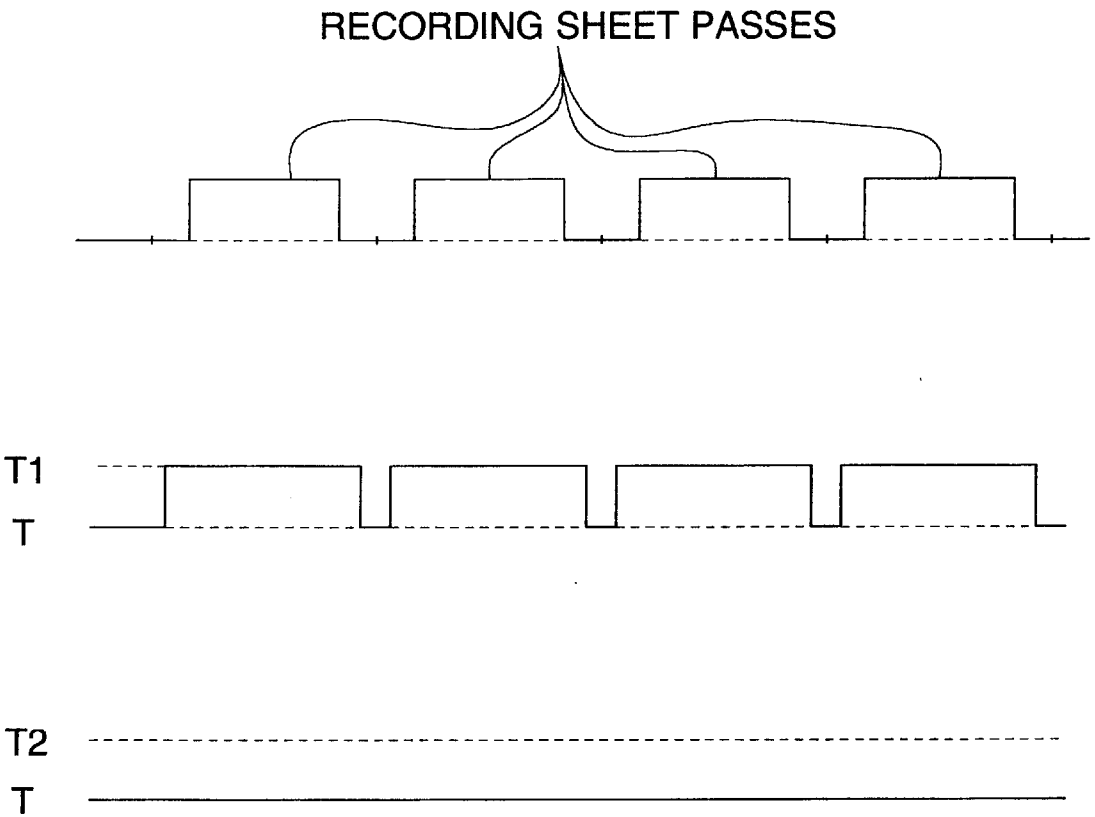

Each of FIGS. 22(*a*), 22(*b*) and 22(*c*) is a temperature control timing chart in forming of single-sided image on the face side wherein a fixing apparatus of the third or fourth example is used.

Figure 23:
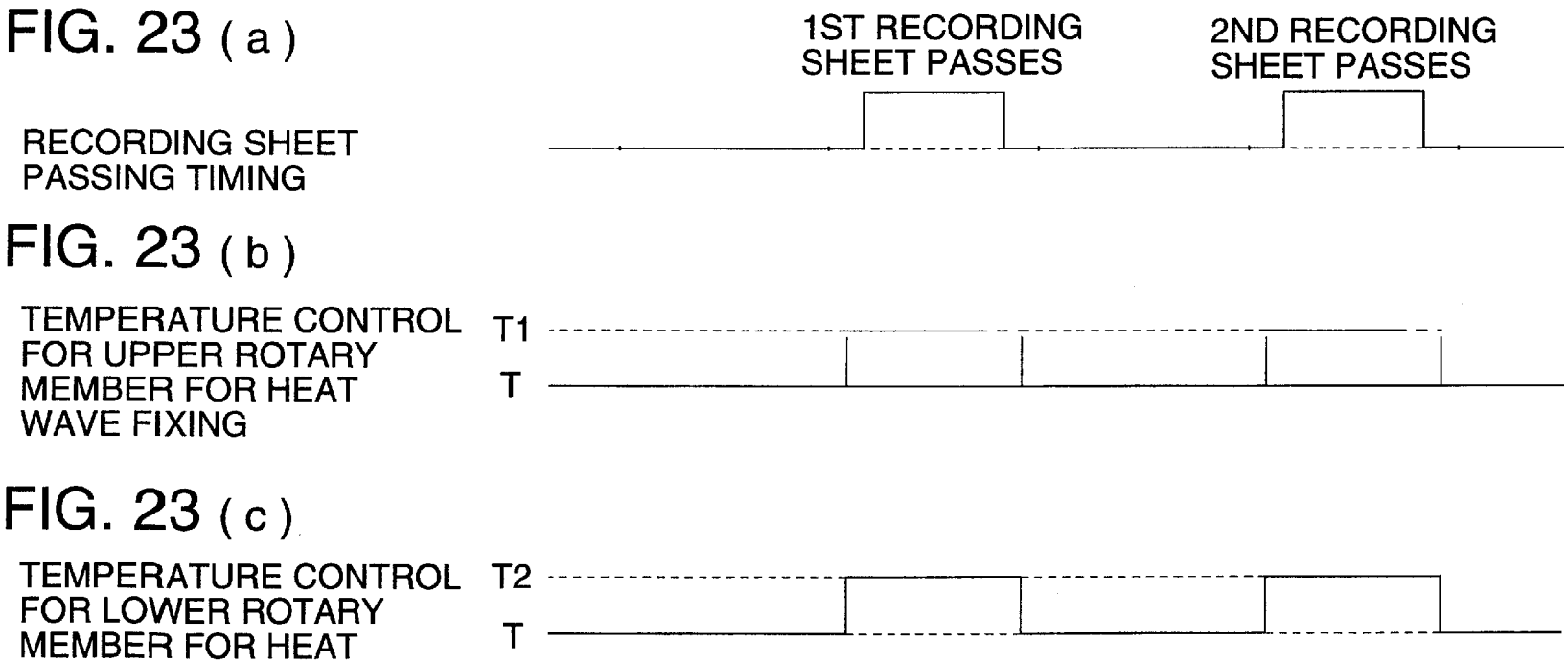

Each of FIGS. 23(*a*), 23(*b*) and 23(*c*) is a temperature control timing chart in forming of single-sided image on the reverse side wherein a fixing apparatus of the third or fourth example is used.

Figure 24:
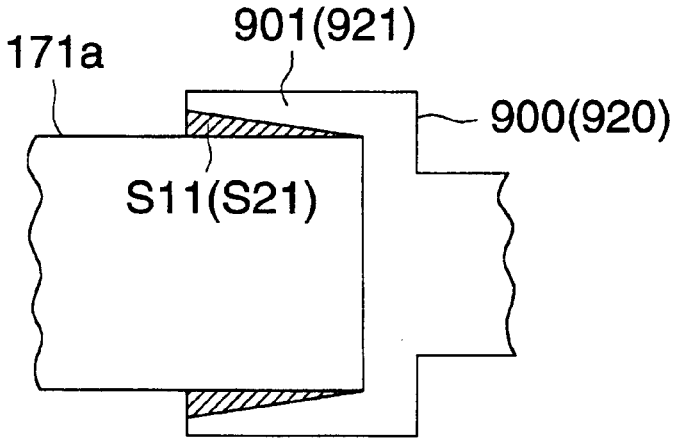

FIG. 24 is a diagram showing an occasion where a ray-transmitting base member is fitted in a flange member.

Figure 25:
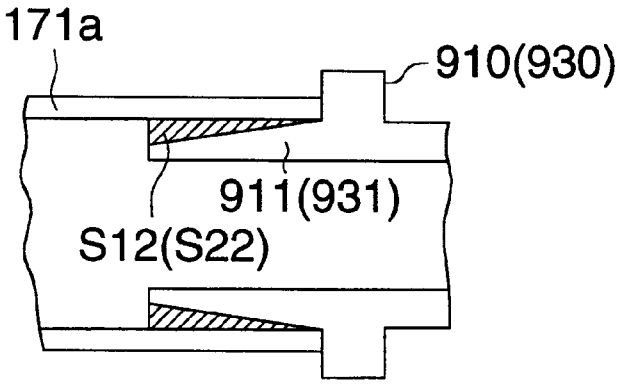

FIG. 25 is a diagram showing an occasion where a flange member is fitted in a ray-transmitting base member.

Figure 26:
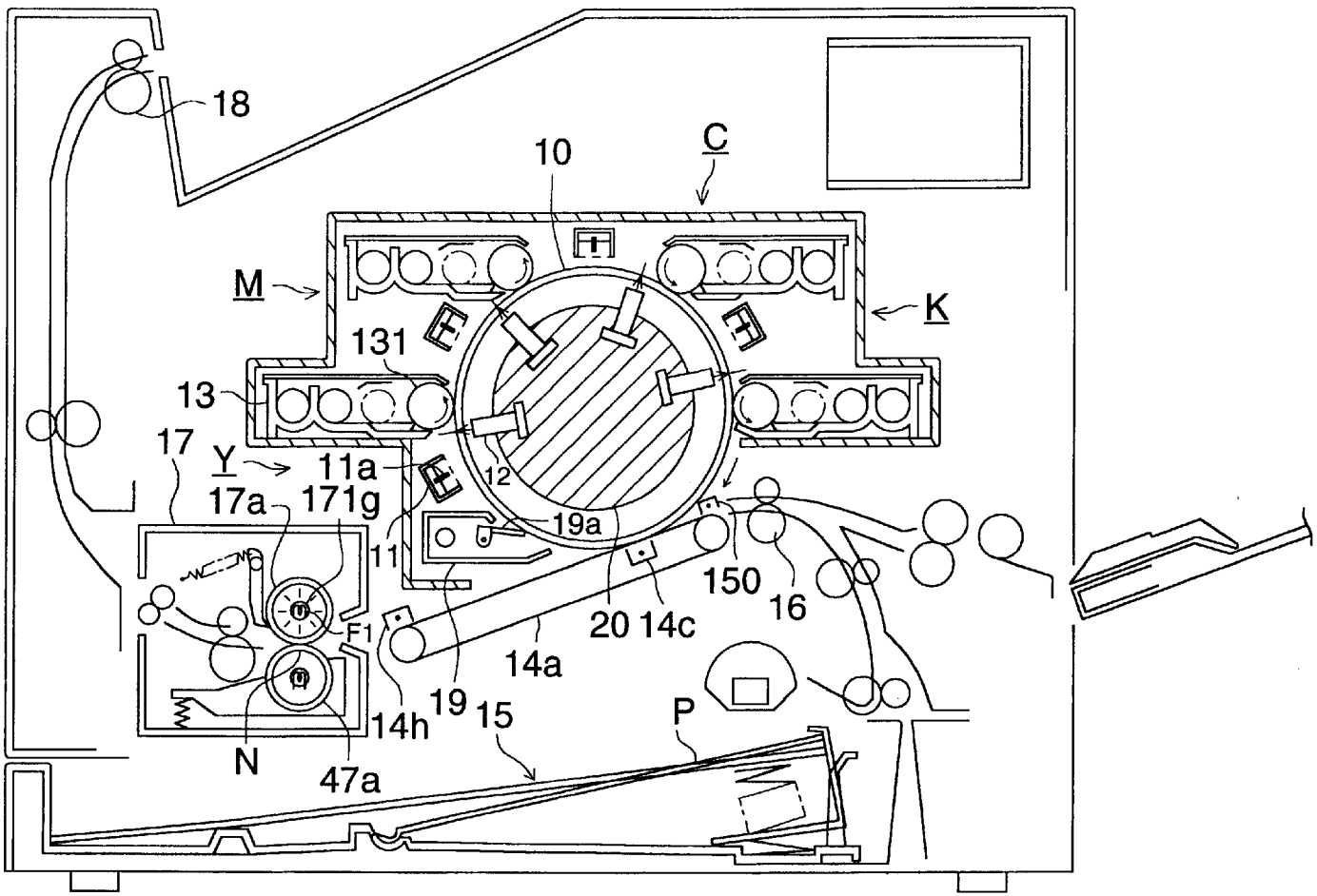

FIG. 26 is a sectional structure diagram showing an embodiment of a color image forming apparatus employing a fixing apparatus related to the invention.

Figure 27:
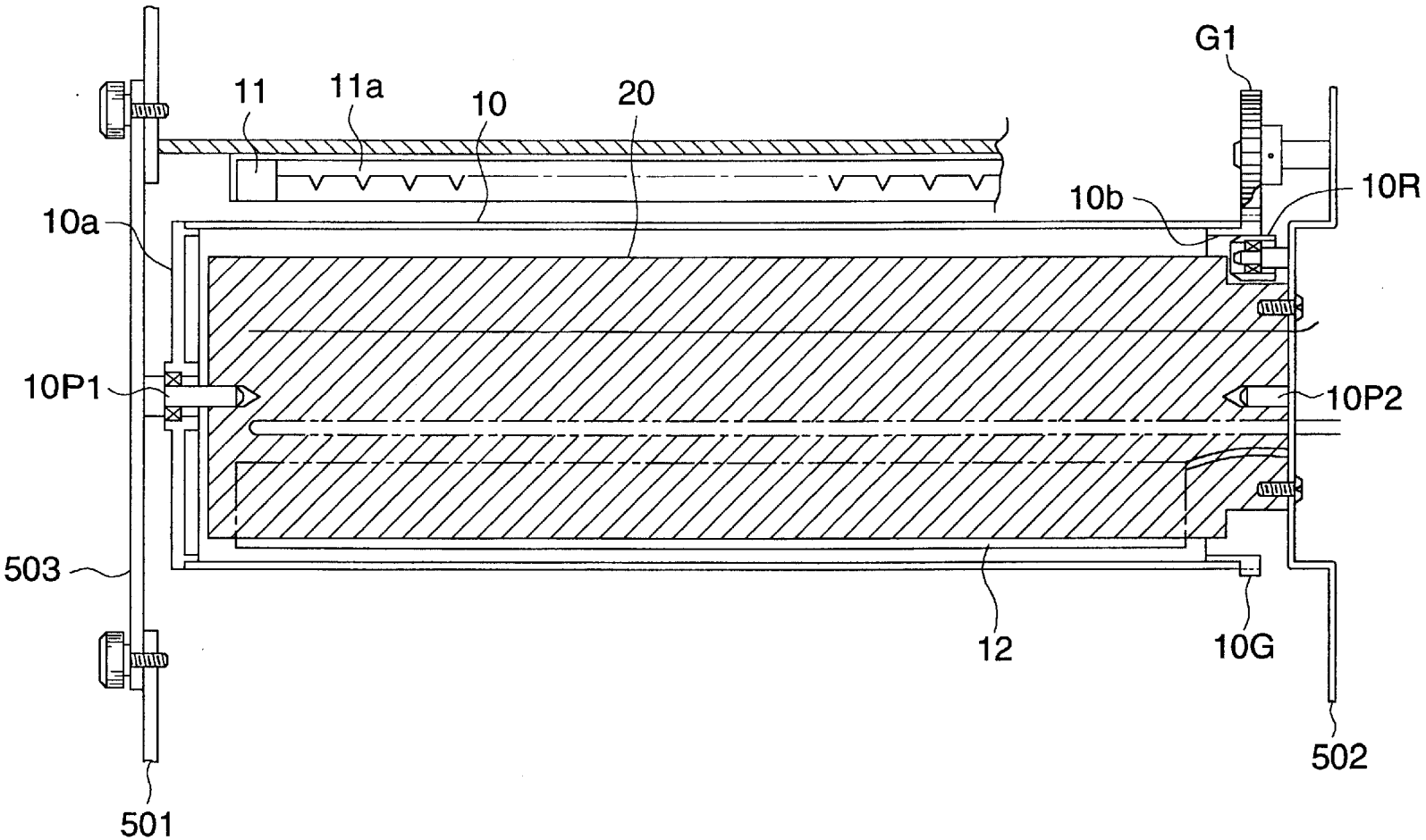

FIG. 27 is a side sectional view of an image carrier shown in FIG. 26.

Figure 28:
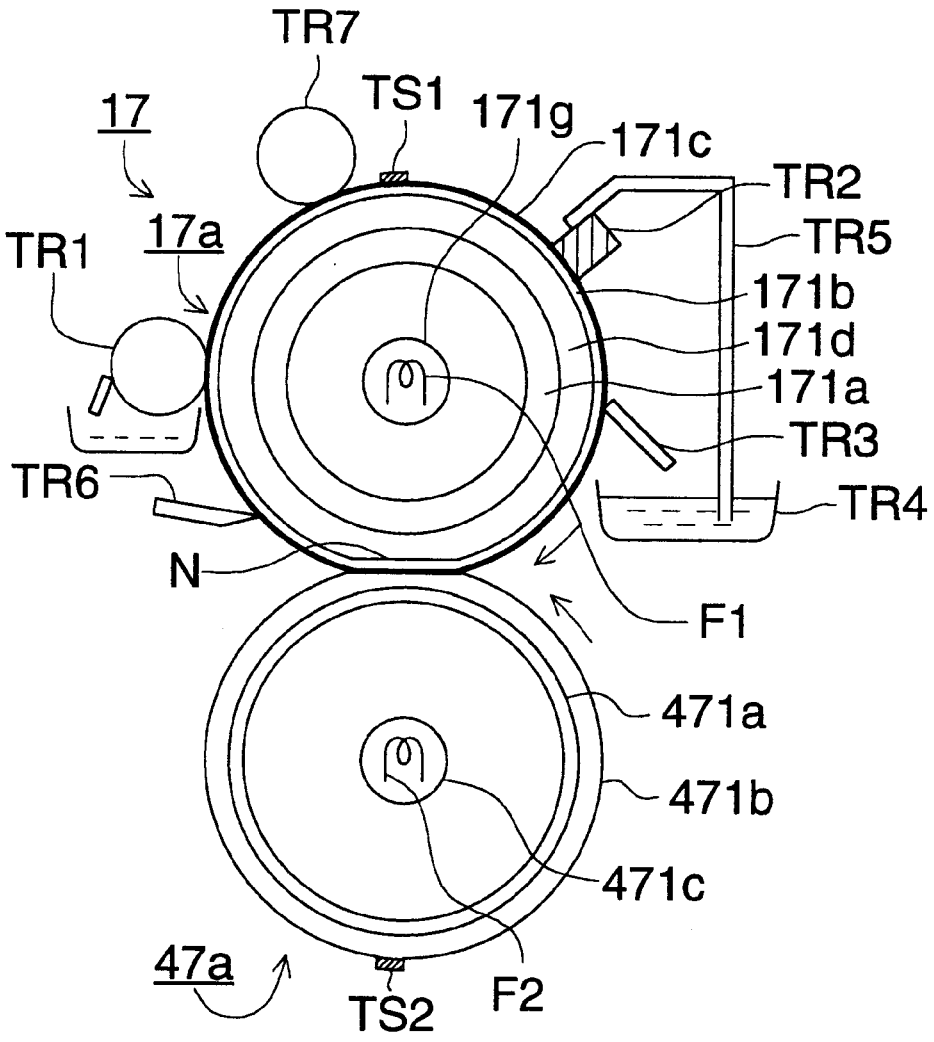

FIG. 28 is a sectional structure diagram of a fixing apparatus employing a roll-shaped rotary member for fixing.

Figure 29:
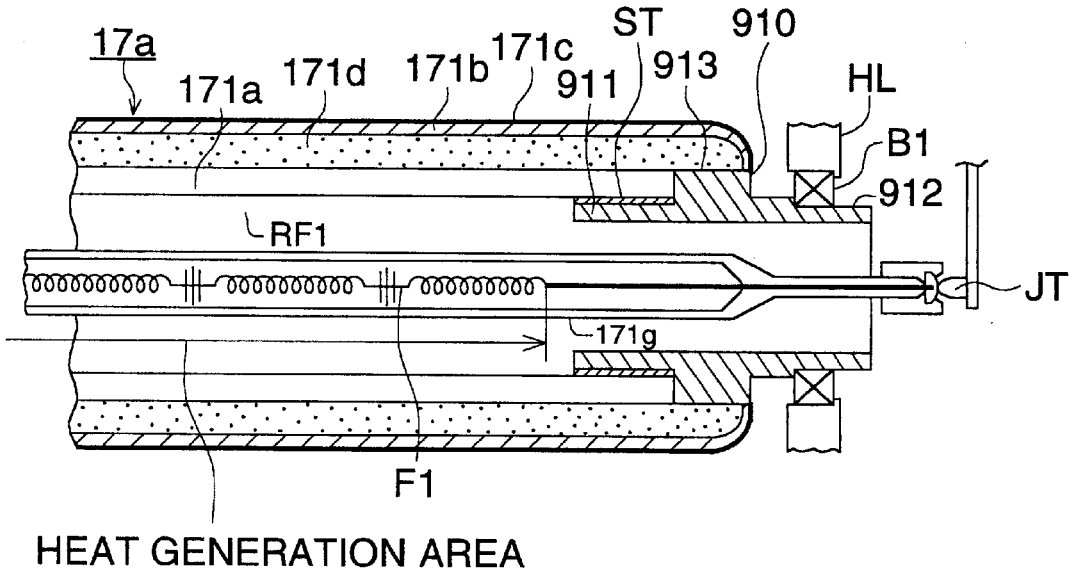

FIG. 29 is a side sectional view of a roll-shaped rotary member for fixing showing how a ray-transmitting base member and a flange member are put together.

Figure 30:
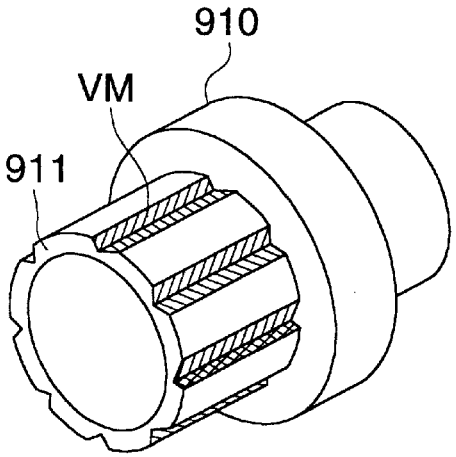
Figure 30:
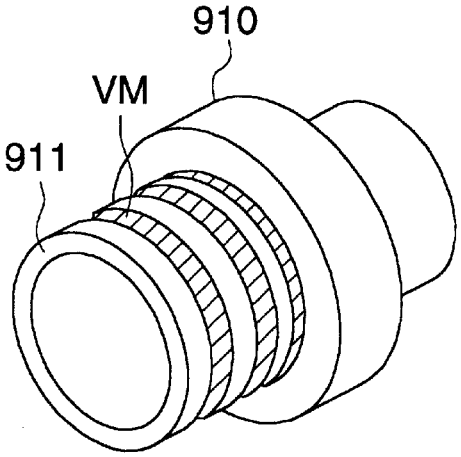

Each of FIGS. 30(*a*) and 30(*b*) is a diagram showing grooves provided on a flange member.

Figure 31:
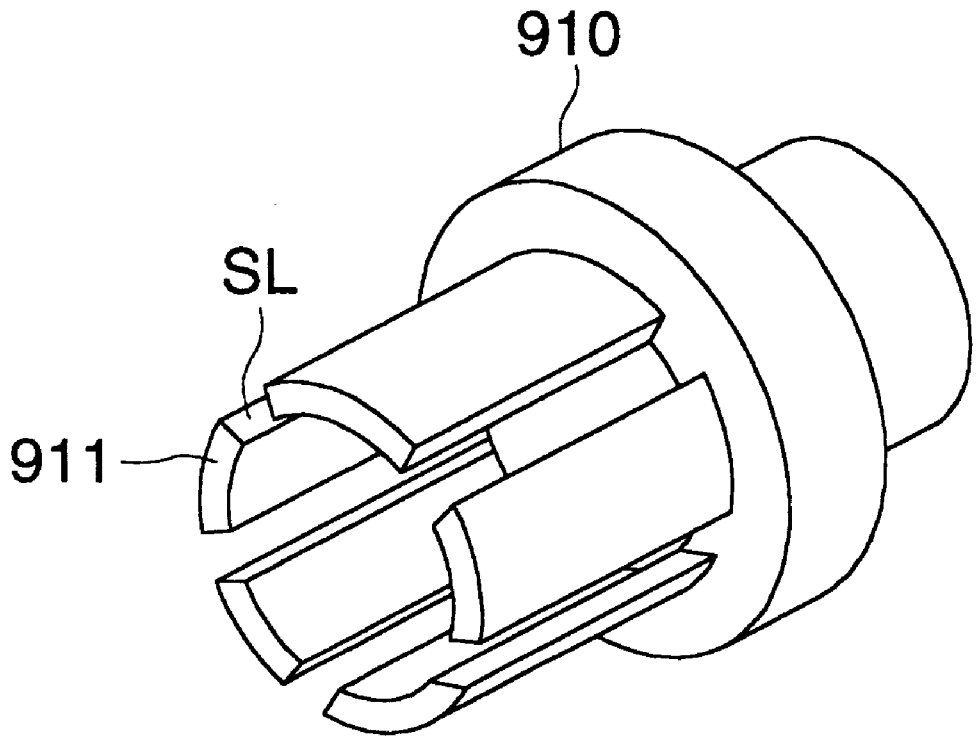

FIG. 31 is a diagram showing slits provided on a flange member.

FIG. 32A is a diagram showing another example of junction of a flange member and a ray-transmitting base member.

FIG. 32B is an enlarged view of a part of FIG. 32A.

Figure 33:
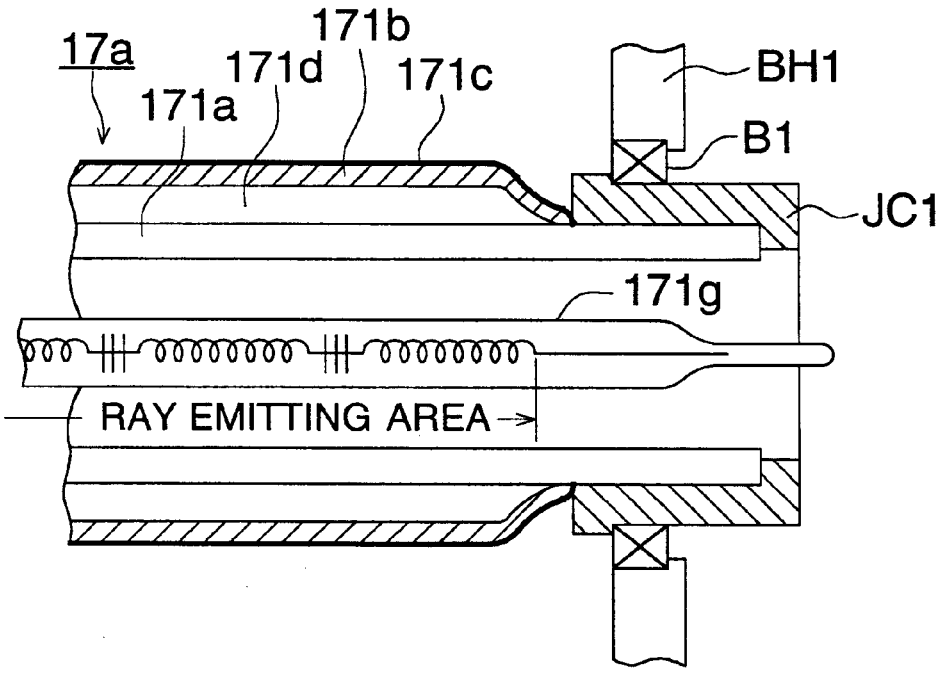

FIG. 33 is a diagram showing the first example of prevention of breakage caused by thermal expansion of a ray-transmitting base member.

Figure 34:
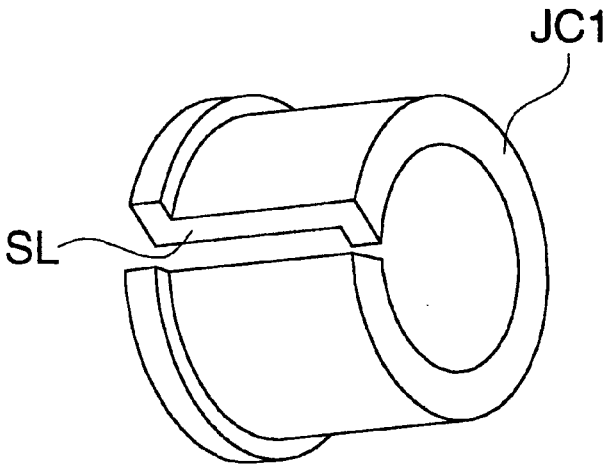

FIG. 34 is a diagram showing a preferable example of a resin-made cap member in FIG. 33.

Figure 35:
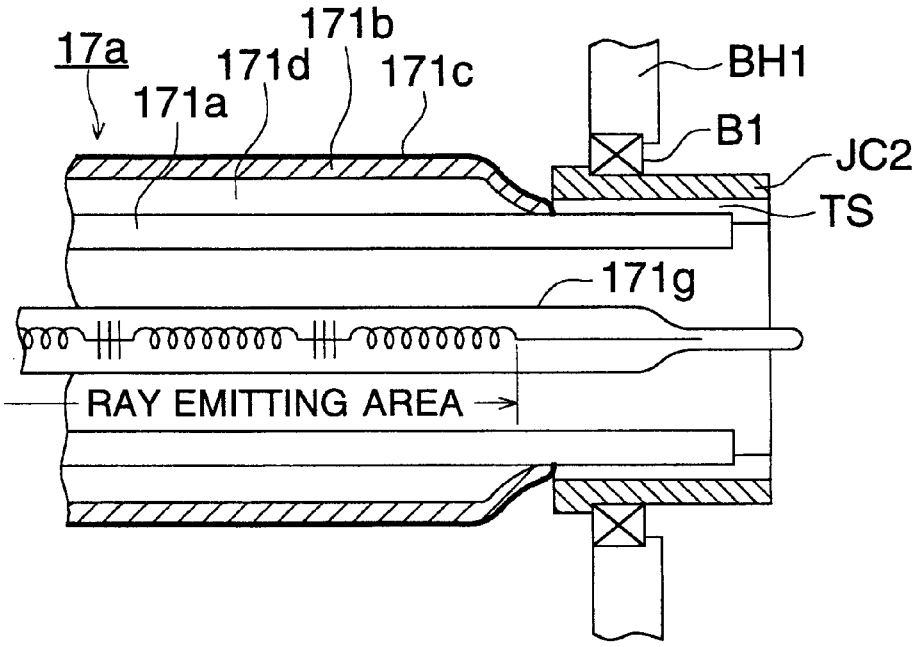

FIG. 35 is a diagram showing the second example of prevention of breakage caused by thermal expansion of a ray-transmitting base member.

Figure 36:
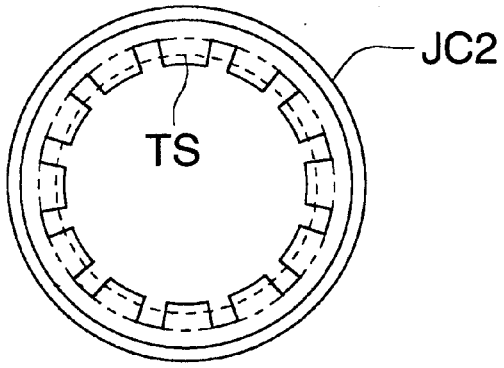

FIG. 36 is an illustration of the fitting portion where a resin-made cap member in FIG. 35 is fitted with a ray-transmitting base member.

Figure 37:
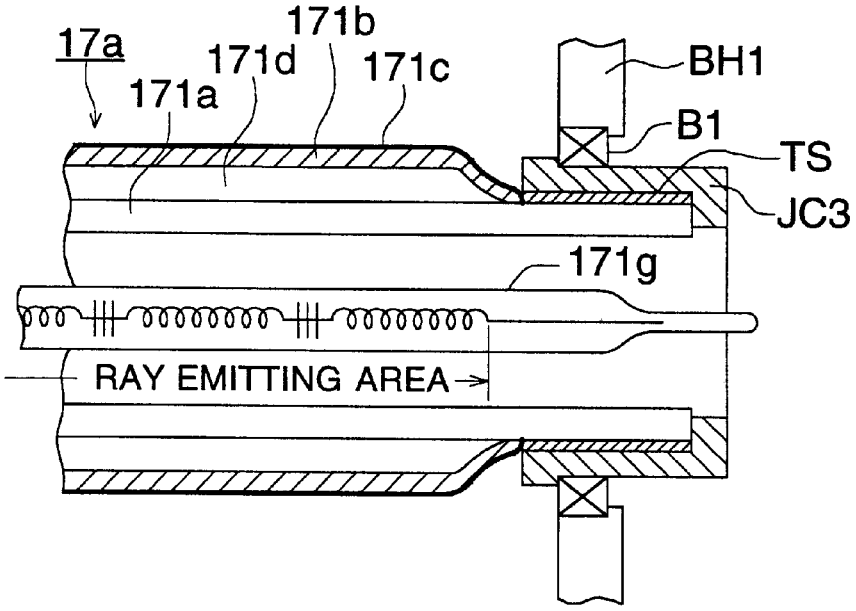

FIG. 37 is a diagram showing the third example of prevention of breakage caused by thermal expansion of a ray-transmitting base member.

Figure 38:
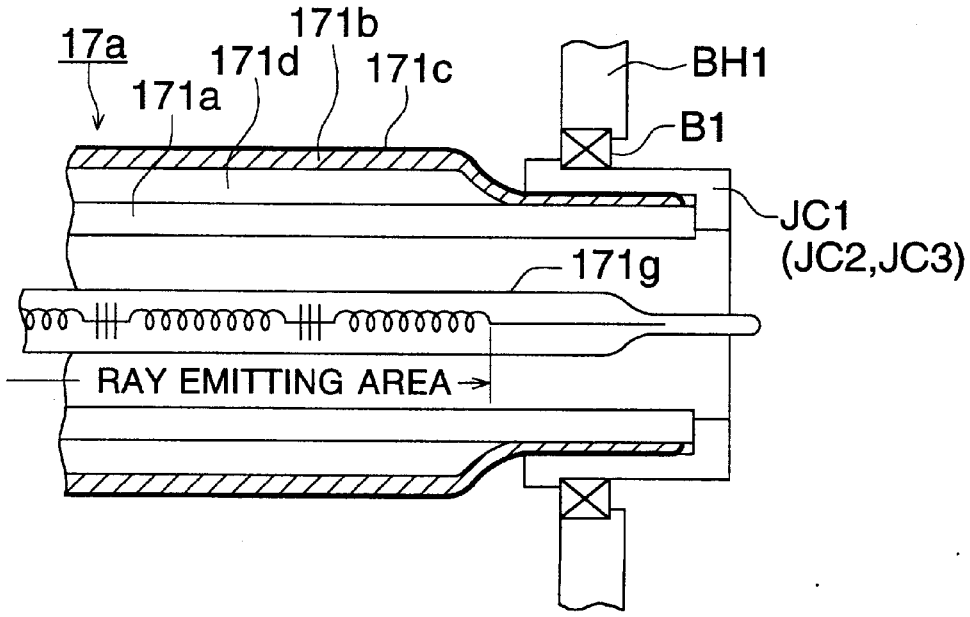

FIG. 38 is a diagram showing another example of how to provide a ray absorbing layer of a rotary member for applying heat, which is common to each example of prevention of breakage caused by thermal expansion of a ray-transmitting base member.

Figure 39:
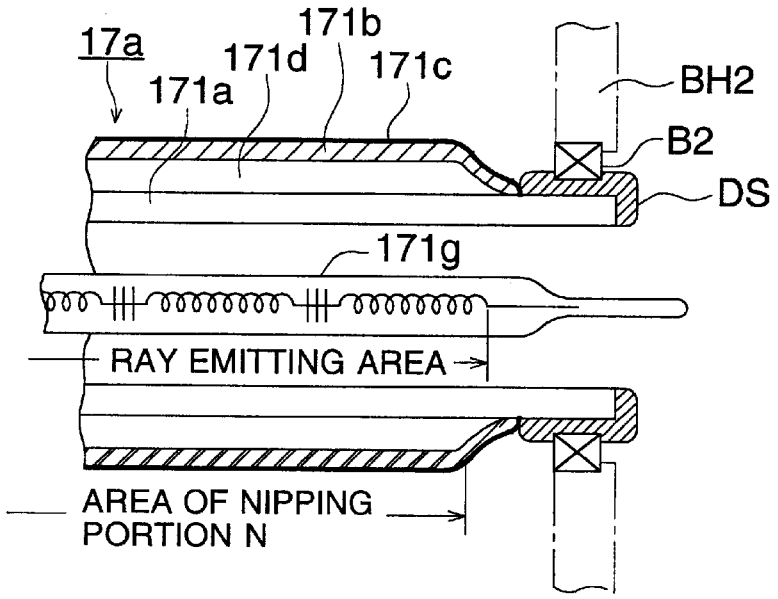

FIG. 39 is a diagram showing the first example of prevention of breakage caused in the course of handling of a ray-transmitting base member.

Figure 40:
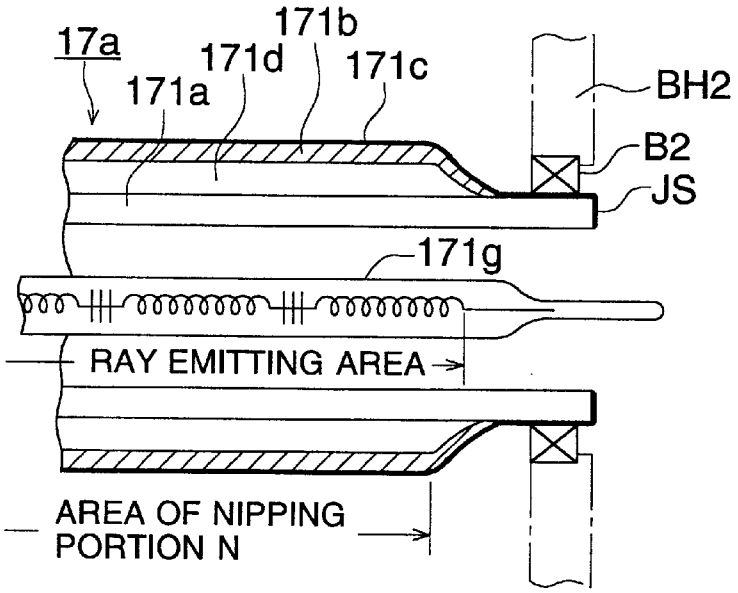

FIG. 40 is a diagram showing the second example of prevention of breakage caused in the course of handling of a ray-transmitting base member.

Figure 41:
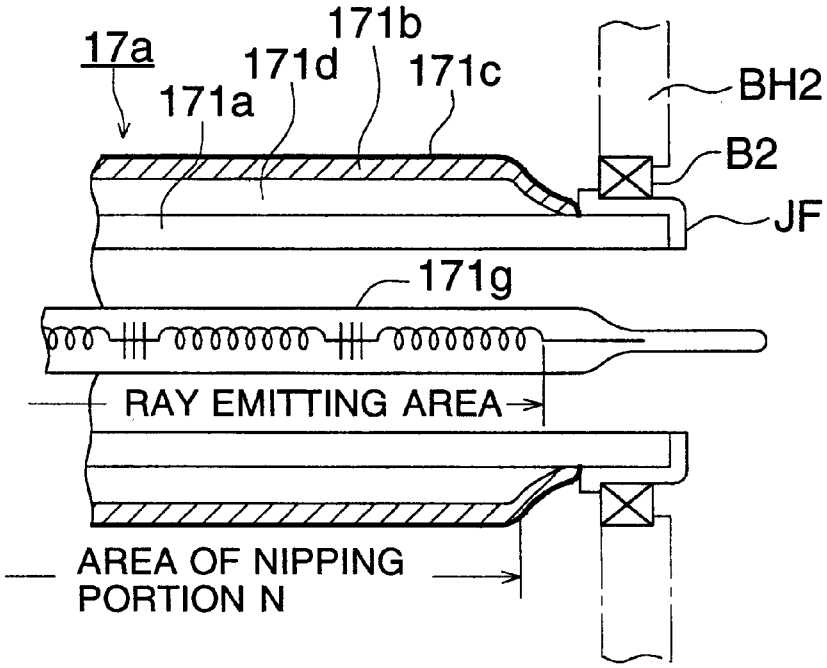

FIG. 41 is a diagram showing the third example of prevention of breakage caused in the course of handling of a ray-transmitting base member.

Figure 42:
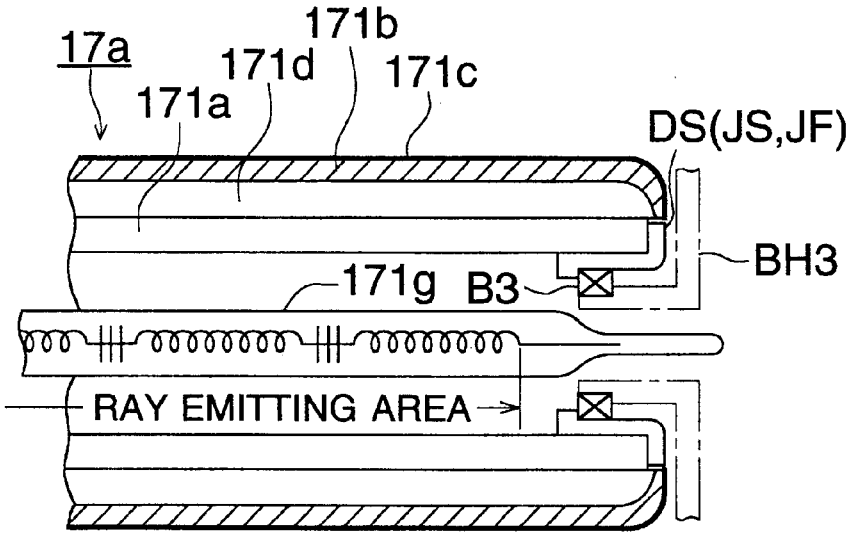

FIG. 42 is a diagram showing another example of how to provide an elastic layer of a rotary member for applying heat, which is common to each example of prevention of breakage caused in the course of handling of a ray-transmitting base member.

Figure 43:
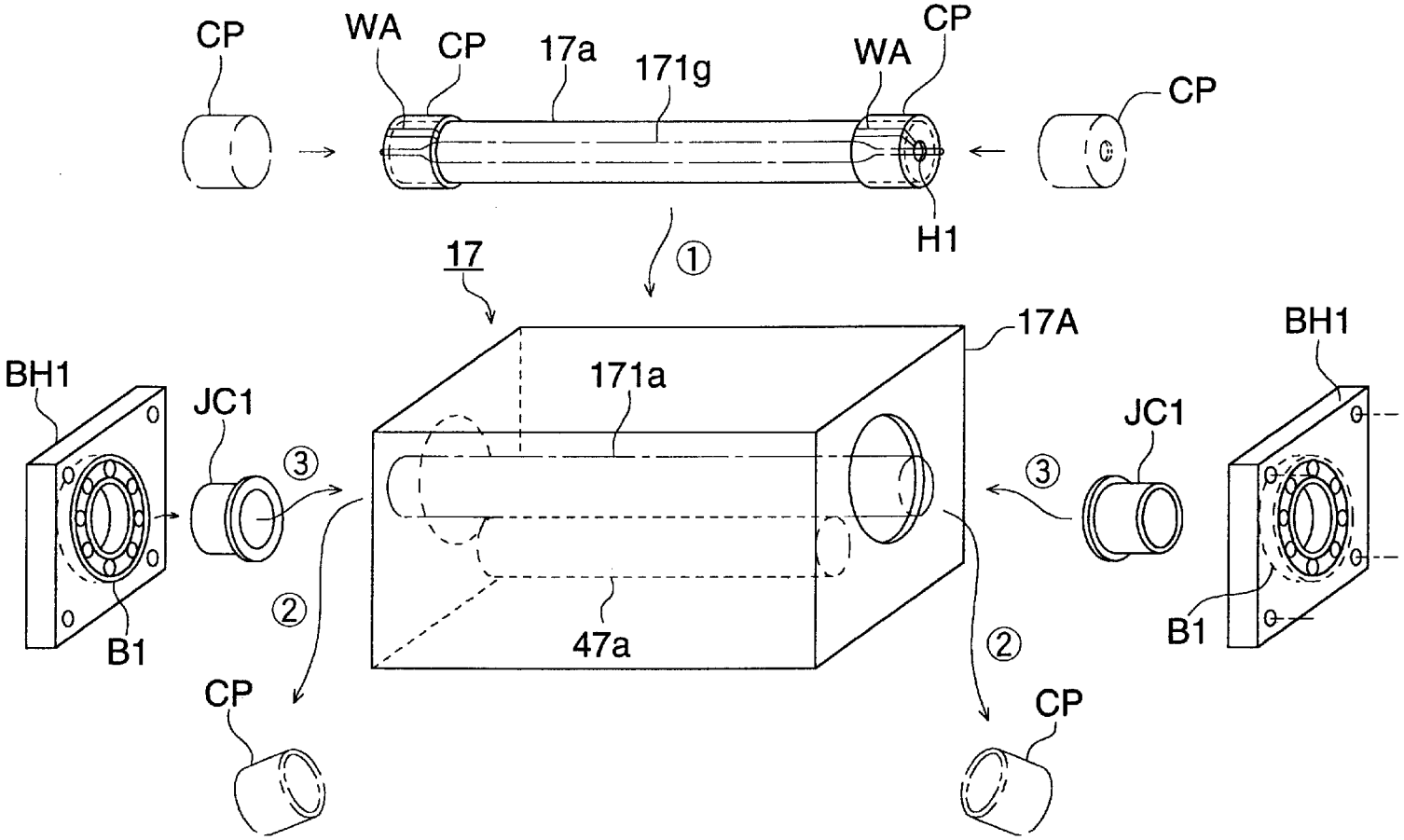

FIG. 43 is a diagram showing how to assemble a fixing apparatus wherein breakage on an end portion of a ray-transmitting base member is prevented.

Figure 44:
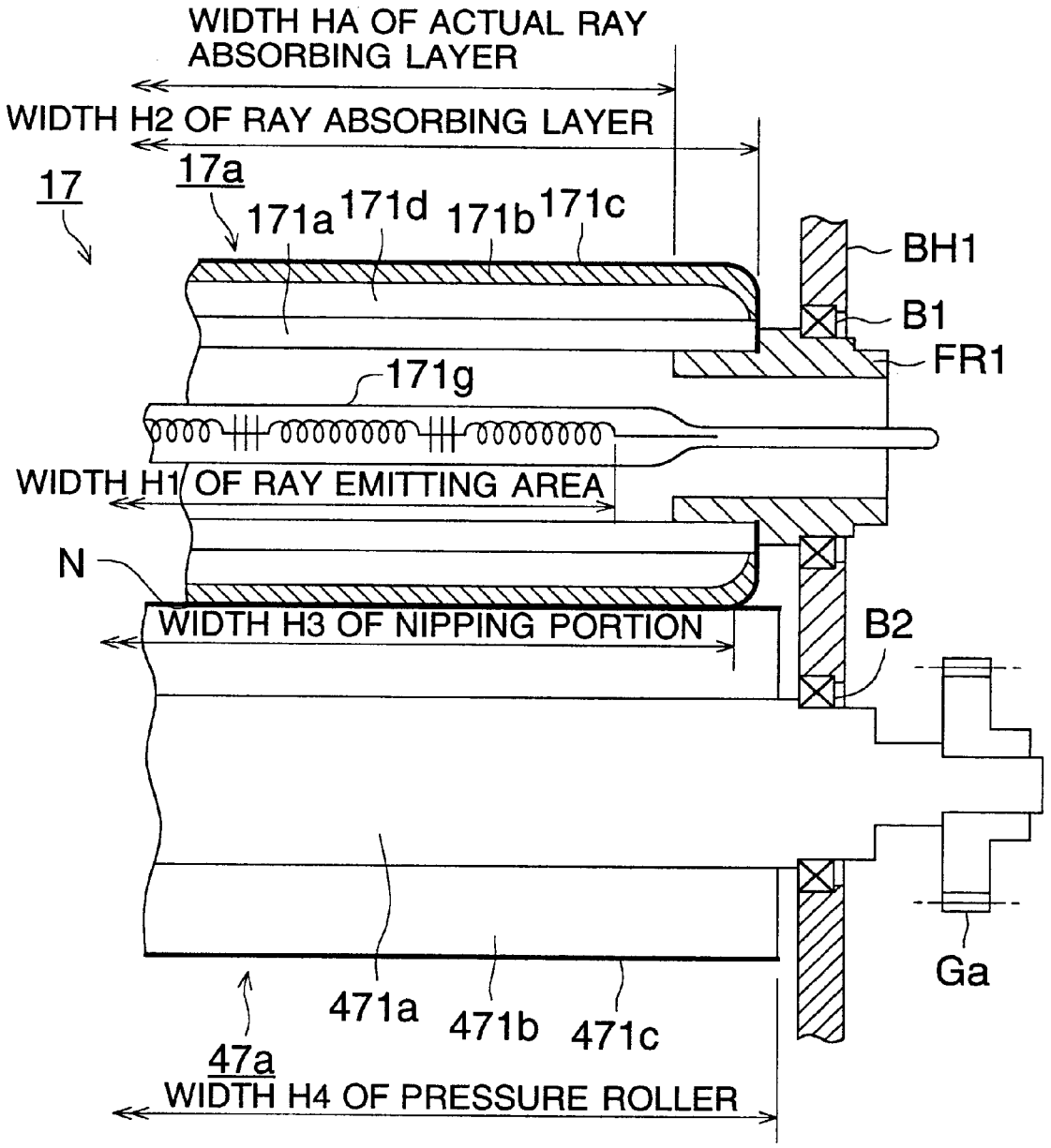

FIG. 44 is a diagram showing how to provide a rotary shaft on a rotary member for applying heat used for a fixing apparatus and a width of a pressure roller.

Figure 45:
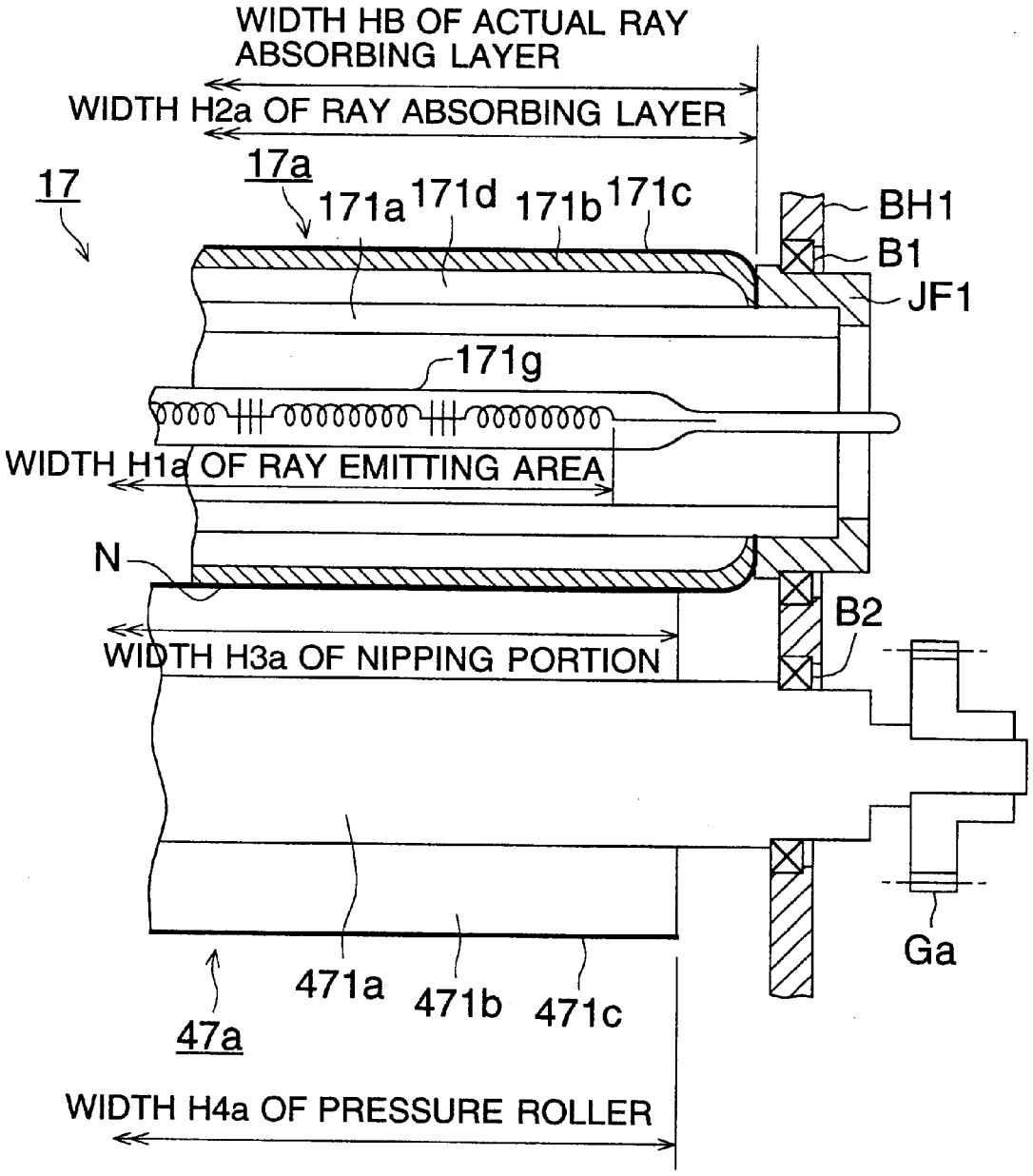

FIG. 45 is a diagram showing another example of how to provide a rotary shaft on a rotary member for applying heat used for a fixing apparatus and a width of a pressure roller.

DETAILED DESCRIPTION OF THE PREFERRED EMBODIMENT

An embodiment attaining the first object of the invention will be explained as follows. Incidentally, in the following explanation of the embodiment, the surface (surface on the upper side) of a transfer material on the side facing an image carrier in the transfer area is defined as a face side, while, the surface on the other side of the transfer material, namely, the surface (surface on the lower side) of a transfer material on the side facing an intermittent transfer body is defined as a reverse side, and an image to be transferred onto the face side of the transfer material is defined as a face side image, while an image to be transferred onto the reverse side of the transfer material is defined as a reverse side image.

An image forming process and each mechanism in an embodiment of a fixing apparatus related to the invention and an image forming apparatus employing the fixing apparatus will be explained, referring to FIG. 1–FIG. 8. FIG. 1 is a sectional structure diagram of a color image forming apparatus showing an embodiment of a fixing apparatus related to the invention and of an image forming apparatus employing the fixing apparatus, and each of FIGS. 2(*a*), 2(*b*) and 2(*c*) is a diagram showing how toner images are formed in the image forming apparatus shown in FIG. 1. FIG. 2(*a*) is a diagram showing how a toner image is formed when a reverse side image formed on an image carrier is transferred onto the intermittent transfer body, and FIG. 2(*b*) is a diagram showing how a toner image is formed when a face side image is formed on the image carrier in synchronization with the reverse side image on the intermittent transfer body. FIG. 2(*c*) is a diagram showing two-sided image forming on a transfer material, FIG. 3 is a diagram showing an example of an original image reading means, FIG. 4 is a block diagram of a control circuit of an image forming apparatus, FIG. 5 is an illustration showing the structure of the first example of a fixing apparatus, each of FIGS. 6(*a*) and 6(*b*) is an enlarged sectional structure diagram of the first example of a rollshaped rotary member for fixing, FIG. 7 is a diagram showing density distribution on a ray absorbing layer of the first example of a roll-shaped rotary member for fixing, and FIG. 8 is a diagram showing an outside diameter and a thickness of a ray-transmitting base member of the first example of a roll-shaped rotary member for fixing.

As shown in FIG. 3 and FIG. 4, original image reading unit 500 representing an original image reading means is composed of reading unit main body 501, original holding tray 505 which holds original PS, original feed-out roller 502, transparent plate 503, original conveyance roller 504, original delivery tray 506 and of original image reading sensors PS1 and PS2 which are linear in shape and are provided on both sides of the transparent plate 503 and read original images on original PS from the top and from the bottom, and it is connected with a control section through signal lines incorporated in an external apparatus or in a color image forming apparatus explained as follows.

When original PS fed out by original feed-out roller 502 passes through the transparent plate 503, the original image reading sensors PS1 and PS2 provided vertically, interposing the transparent plate 503 judge whether the original PS is a single-sided original or a two-sided original (judgment of single-sided and two-sided) and read image data of the original PS.

Though judgment of single-sided and two-sided and reading of image data are conducted by a vertical pair of sensors in the present embodiment, it is also possible to provide plural paired sensors corresponding respectively to reading of image data and to judgment of single-sided and two-sided, and for example, plural sensors corresponding to both or them may be used for reading image data after judging single-sided and two-sided. Image data of a sheaf of original PS are read by original image reading sensor PS1 or PS2 and they are stored in RAM through a control section.

When an original is judged to be of a two-sided image in the foregoing, image data of original PS are read by an original image reading means shown in FIG. 3, and two-sided image forming program P1 stored in ROM shown in FIG. 4 is read into RAM through a control section, thus, two-sided image forming program P1 is executed by the control section and the image forming process is conducted.

In FIG. 1 and FIGS. 2(*a*)–2(*c*), the numeral 10 is a photoreceptor drum representing an image carrier, 11 is a scorotron charger representing a charging means for each color, 12 is an exposure optical system representing an image writing means for each color, 13 is a developing unit representing a developing means for each color, 14*a* is an intermittent transfer belt representing an intermittent transfer body, 14*c* is a transfer unit representing a first and second transfer means, 14*g* is a reverse side transfer unit representing a third transfer means, 14*m* is a neutralizing unit representing a neutralizing means, 150 is a sheet charging unit representing a transfer material charging means, 14*h* is a sheet separation AC neutralizing unit representing a transfer material separating means, 160 is a conveyance section having separation claw 210 representing a claw member and spurred wheel 162 representing a spurred wheel member, 169 is an entrance guide plate representing an entrance guide member, and 17 is a fixing apparatus of the first example.

The photoreceptor drum 10 representing an image carrier, for example, is one wherein a transparent conductive layer and a photosensitive layer (also called a photoconductive layer) such as an a-Si layer or an organic photoconductive layer (OPC) are formed on the outer circumferential surface of a cylindrical base body formed by a transparent member such as optical glass or transparent acrylic resin. and it is rotated in the clockwise direction shown with an arrow mark in FIG. 1 with a conductive layer being grounded.

The scorotron charger 11 representing a charging means for each color, the exposure optical system 12 representing an image writing means for each color and the developing unit 13 representing a developing means for each color are combined to be one set, and four sets are provided for image forming process for yellow (Y), magenta (M), cyan (C) and black (K) colors, and they are arranged in the order of Y, M, C and K for the direction of rotation of photoreceptor drum 10 shown with an arrow mark in FIG. 1.

The scorotron charger 11 representing a charging means for each color has therein a control grid held at respective prescribed voltage and discharge electrode 11*a* composed, for example, of a saw-tooth electrode, and it is mounted to face a photosensitive layer of photoreceptor drum 10 to conduct charging operations through corona discharge having the same polarity as that of toner (negative charging in the present embodiment) and thereby to give uniform voltage to photoreceptor drum 10. As discharge electrode 11*a,* it is also possible to use a wire electrode or a needle electrode.

The exposure optical system 12 representing an image writing means for each color is arranged inside-photoreceptor drum 10 so that an exposure position on the photoreceptor drum 10 may be located on the downstream side of the scorotron charger 11 for each color in the direction of rotation of the photoreceptor drum 10. Each exposure optical system 12 is a unit for exposure which is composed of linear exposure element 12*a* wherein there are arranged in an array form plural LEDs (light emitting diodes) each representing a light emitting element for imagewise exposure light arranged in the main scanning direction to be in parallel with the drum shaft, light-converging light transmitter (SELFOC lens array) 12*b* representing an image forming element, and of an unillustrated lens holder, and it is mounted on holding member 20. On the holding member 20, there are mounted transfer-overlapping exposure unit 12*d* and uniform-exposure unit 12*e,* in addition to the exposure optical system 12 for each color, and all of them are solidly housed in the ray-transmitting base member of the photoreceptor drum 10. The exposure optical system 12 for each color conducts imagewise exposure on the reverse side of the photosensitive layer of photoreceptor drum 10 in accordance with image data for each color stored in a memory after being read by a separate image reading apparatus, and forms an electrostatic latent image on the photoreceptor drum 10. As exposure element 12*a,* it is also possible to use, in addition to LED, one wherein plural light emitting elements are arranged in an array form, such as FL (fluorescent substance luminescence), EL (electroluminescence) and PL (plasma discharge). With regard to a luminescence wavelength of the imagewise exposure light emitting element, those ranging from 780 nm to 900 nm which are highly light-transmissive for toner of Y, M and C are usually used. However, in the present embodiment, it is also possible to use wavelengths within a range of 400–780 nm which are shorter than the foregoing and are less light-transmissive for color toner, because imagewise exposure is conducted through the reverse side. A most part of imagewise exposure light is absorbed in a photosensitive layer.

The developing unit 13 representing a developing means for each color is composed of developing sleeve 131 which keeps a prescribed distance from a circumferential surface of photoreceptor drum 10 and rotates in the forward direction for the rotation of the photoreceptor drum 10, and is formed with a cylindrical and non-magnetic stainless or aluminum material having, for example, a thickness of 0.5–1 mm and an outside diameter of 15–25 mm, and of developing casing 138 in which one-component or two-component developing agents for yellow (Y), magenta (M), cyan (C) and black (K) are housed. Each developing unit 13 is kept by an unillustrated stopper roll to be away from the photoreceptor drum 10 by a prescribed clearance of 100–500 $\mu$m, for example, on a noncontact basis, and when developing bias voltage wherein DC voltage and AC voltage are superposed is impressed on the developing sleeve 131, non-contact reversal development is conducted and a toner image is formed on the photoreceptor drum 10.

The intermittent transfer belt 14*a* representing an intermittent transfer body is an endless belt having volume resistivity of $10^{10}$–$10^{16}$ Ω·cm, preferably of $10^{12}$–$10^{15}$ Ω·cm, and it is a seamless belt of a two-layer structure wherein fluorine coating with a thickness of 5–50 $\mu$m is applied on the outer side of a semi-conductive film base body having a thickness of 0.1–1.0 mm in which conductive material is dispersed in engineering plastic such as, for example, modified polyimide, thermosetting polyimide, ethylene-tetrafluoroethylene copolymer, polyfluorovinylidene, and nylon alloy, preferably as a toner filming preventing layer. In addition to the foregoing, it is also possible to use a semi-conductive rubber belt having a thickness of 0.5–2.0 mm in which conductive material is dispersed in silicone rubber or urethane rubber, as a base body for the belt. The intermittent transfer belt 14*a* is trained about driving roller 14*d* representing a roller member, ground roller 14*j,* driven roller 14*e* and tension roller 14*i,* and is rotated in the counterclockwise direction shown with an arrow mark in FIG. 1. The driven roller 14*e,* the ground roller 14*j* and the driving roller 14*d* are rotated at their fixed positions, while, the tension roller 14*i* is rotated while it is supported movably by elastic force of an unillustrated spring. The driving. roller 14*d* is rotated by an unillustrated driving motor through its driving, and it drives the intermittent transfer belt 14*a* to rotate it. The ground roller 14*j,* the driven roller 14*e* and the tension roller 14*i* are driven to rotate by the rotation of the intermittent transfer belt 14*a*. Belt slack of the running intermittent transfer belt 14*a* eliminated by the tension roller 14*i*. Recording sheet P representing a transfer material is supplied to the position where the intermittent transfer belt 14*a* is trained about the driven roller 14*e,* and the recording sheet P is conveyed by the intermittent transfer belt 14*a*. The recording sheet P is separated from the intermittent transfer belt 14*a* at curved portion KT on the end portion of the intermittent transfer belt 14*a* closer to fixing unit 17.

The transfer unit 14*c* representing a first and second transfer means is a corona discharging unit which is provided to face photoreceptor drum 10 through the intermittent transfer belt 14*a,* and it forms transfer area 14*b* between the intermittent transfer belt 14*a* and the photoreceptor drum 10. On the transfer unit 14*c,* there is impressed DC voltage having polarity (positive polarity in the present embodiment) opposite to that of toner, and thereby, toner images on the photoreceptor drum 10 are transferred onto the intermittent transfer belt 14*a* or on the face side of recording sheet P representing a transfer material.

The reverse side transfer unit 14*g* representing a third transfer means is preferably constituted with a corona discharging unit, and it is provided to face grounded conductive ground roller 14*j* through the intermittent transfer belt 14*a.* DC voltage having the polarity opposite to that of toner (positive polarity in the present embodiment) is impressed on the reverse side transfer unit, and toner images on the intermittent transfer belt 14*a* are transferred onto the reverse side of recording sheet P.

The neutralizing unit 14*m* representing a neutralizing means is preferably constituted with a corona discharging unit, and it is provided to be in parallel with transfer unit 14*c* at the downstream side of the transfer unit 14*c* representing a first and second transfer means in the direction of movement of the intermittent transfer belt 14*a.* AC voltage superposed with DC voltage having the polarity identical to or opposite to that of toner is impressed on the neutralizing unit which then neutralizes electric charges on the intermittent transfer belt 14*a* charged by voltage impression of the transfer unit 14*c*.

The sheet charging unit 150 representing a transfer material charging means is preferably constituted with a corona discharging unit, provided to face the driven roller 14*e* through the intermittent transfer belt 14*a,* impressed with DC voltage having the same polarity as in toner (negative polarity in the present embodiment), and charges recording sheet P so that it is attracted to the intermittent transfer belt 14*a.* As the sheet charging unit 150, it is also possible to use a sheet charging brush or a sheet charging roller which can be brought into contact with and can be removed from the intermittent transfer belt 14*a,* in addition to the corona discharging unit.

The sheet separation AC neutralizing unit 14*h* representing a transfer material separating means is preferably constituted with a corona discharging unit, provided to face the conductive driving roller 14*d* grounded, when necessary, to the end portion of the intermittent transfer belt 14*a* closer to fixing unit 17 through the intermittent transfer belt 14*a,* impressed with AC voltage superposed, when necessary, with DC voltage having the polarity identical to or opposite to that of toner, and neutralizes recording sheet P conveyed by the intermittent transfer belt 14*a* to separate it from the intermittent transfer belt 14*a*.

The conveyance section 160 has separating claw 210 representing a claw member and spurred wheel 162 representing a spurred wheel member, and it is provided between curved portion KT on the end portion of the intermittent transfer belt 14*a* closer to fixing unit 17 and the fixing unit 17. The conveyance section 160 prevents that the intermittent transfer belt 14*a* is deformed, toner images held on the intermittent transfer belt 14*a* are made fusible and hard to be transferred, and toner images are stuck to the intermittent transfer belt 14*a,* all by heat generated from fixing unit 17.

The separation claw 210 representing a claw member is provided to be fixed on supporting shaft 221 in a way that it is close to curved portion KT of the intermittent transfer belt 14*a* with a prescribed distance, preferably 0.1 to 2.0 mm, from the intermittent transfer belt 14*a,* and it helps recording sheet P to be separated by making the leading edge of recording sheet P which tends to be conveyed on the skew toward the intermittent transfer belt 14*a* to touch, when the recording sheet P is separated from the intermittent transfer belt 14*a*.

The spurred wheel 162 representing a spurred wheel member has plural projections 162*a* on its circumferential surface, and is provided to be rotatable on the center of rotation supporting shaft 165. The spurred wheel 162 conveys recording sheet P while guiding its reverse side, thus, it prevents disturbance of toner images on the reverse side of recording sheet P which has on its both sides toner images, and conveys the recording sheet P to fixing unit 17 stably while making the direction for recording sheet P to enter the fixing unit 17 constant.

With regard to plane PL1 (hereinafter referred to as transfer material conveyance plane PL1) connecting curved portion KT of the intermittent transfer belt 14*a* and an entrance portion through which a transfer material enters nip portion T of fixing unit 17, the separation claw 210 and the spurred wheel 162 are arranged to be in contact with or to be close to the transfer material conveyance plane PL1 on the part of the transfer material conveyance plane PL1 opposite to that for photoreceptor drum 10. It is also possible to provide the spurred wheels 162 representing a spurred wheel member on both sides of the transfer material conveyance plane PL1.

The entrance guide plate 169 representing an entrance guide member is arranged to be in contact with or to be close to the transfer material conveyance plane PL1 on the part of the transfer material conveyance plane PL1 opposite to that for photoreceptor drum 10, and it makes the leading edge of recording sheet P to enter nip portion T of fixing unit 17 so that its edge portion may guide recording sheet P to prevent creases in the course of fixing operations.

Fixing apparatus 17 in the first example is composed of first ray irradiating roller 17*a* representing a roll-shaped rotary member for fixing on the upper side (face side) for fixing toner images on a face side image (an image on the upper side) and of first fixing roller 47*a* representing a roll-shaped rotary member for fixing on the lower side (reverse side) for fixing toner images on a reverse side image (an image on the lower side), and recording sheet P is nipped by nipping section T formed between the first ray irradiating roller 17*a* and the first fixing roller 47*a,* where heat and pressure are applied to the recording sheet P so that toner images thereon may be fixed. Inside the first ray irradiating roller 17*a,* there is provided ray irradiating member 171*g* representing a ray irradiating device employing, for example, a halogen lamp or a xenon lamp emitting mainly rays such as infrared radiation or far infrared radiation.

Next, an image forming process will be explained as follows.

When the image recording is started, photoreceptor drum 10 is rotated in the clockwise direction shown with an arrow mark in FIG. 1 by the started photoreceptor driving motor which is not illustrated, and simultaneously with this, scorotron charging unit 11 for yellow (Y) starts giving voltage to the photoreceptor drum 10 through the charging operations.

After the photoreceptor drum 10 is given voltage, image writing by means of electric signals corresponding to the first color signals, namely to image data for Y is started by exposure optical system 12 for Y, thus, electrostatic latent images corresponding to Y images of an original image are formed on the surface of the photoreceptor drum 10.

The latent images mentioned above are subjected to reversal development on a non-contact basis conducted by developing unit 13 for Y, and toner images for yellow (Y) are formed on the photoreceptor drum 10.

Then, scorotron charging unit 11 for magenta (M) gives voltage, through its charging operations, to the photoreceptor drum 10 through Y toner images, then, image writing by means of electric signals corresponding to the second color signals, namely to image data for M is conducted by exposure optical system 12 for M, and toner images for magenta (M) are formed to be superposed on the toner images for yellow (Y) by reversal-development on a non-contact basis conducted by developing unit 13 for M.

In the same process, cyan (C) toner images corresponding to the third color signals are formed to be superposed by scorotron charging unit 11 for cyan (C), exposure optical system for C and developing unit 13 for C, and further thereon, black (K) toner images corresponding to the fourth color signals are formed successively to be superposed by scorotron charging unit 11 for black (K), exposure optical system 12 for K and developing unit 13 for K, thus, superposed color toner images for four colors of yellow (Y), magenta (M), cyan (C) and black (K) are formed on the circumferential surface of photoreceptor drum 10 while it makes one turn.

Image writing on a photosensitive layer of the photoreceptor drum 10 by the exposure optical systems 12 for Y, M, C and K is conducted from the inside of the drum through the aforesaid ray-transmitting base member. Therefore, image writing corresponding to each of the second, third and fourth color signals can be conducted without being affected by the toner image formed previously at all, and electrostatic latent images which are the same as the image corresponding to the first color signals can be formed.

Superposed color toner images to be a reverse side image formed on photoreceptor drum 10 representing an image carrier by the aforesaid image forming process are transferred (primary transfer) collectively onto intermittent transfer belt 14*a* representing an intermittent transfer body by transfer unit 14*c* representing the first transfer means in transfer area 14*b* (FIG. 2(*a*)). In this case, it is also possible to arrange so that uniform exposure may be conducted for better transfer by transfer-overlapping exposure unit 12*d* provided inside the photoreceptor drum 10.

Toner remaining on the circumferential surface of the photoreceptor drum 10 after the transfer is subjected to neutralizing by photoreceptor drum AC neutralizing unit 16, then the toner arrives at cleaning unit 19 representing an image carrier cleaning means where it is removed by cleaning blade 19*a* composed of rubber material which is in contact with the photoreceptor drum 10, and is collected in an unillustrated waste toner container by screw 19*b*. On the other hand, the circumferential surface of the photoreceptor drum 10 is subjected to exposure conducted by pre-charging uniform exposure unit 12*e* employing, for example, a light emitting diode so-that hysteresis caused on the photoreceptor drum 10 by previous image forming is erased.

Electric charges on intermittent transfer belt 14*a* charged by transfer unit 14*c* are neutralized by neutralizing unit 14*m* representing a neutralizing means provided to be in parallel with the transfer unit 14*c*.

After the superposed color toner images (second toner images) to be a reverse side image are formed on the intermittent transfer belt 14*a* in the aforesaid manner, superposed color toner images (first toner images) to be a face side image are successively formed on the photoreceptor drum 10 in the same manner as in the aforesaid color image forming process (FIG. 2(*b*)). Incidentally, image data are changed so that a face side image to be formed on the photoreceptor drum 10 and the reverse side image formed on the photoreceptor drum 10 may be in a mirror-image relation.

When a reverse side image is formed on photoreceptor drum 10, recording sheet P representing a transfer material is fed out of sheet-feeding cassette 15 representing a transfer material housing means by feed-out roller 15*a*, then is conveyed to timing roller 15*b* representing a transfer material feeding means, and then is fed to transfer area 14*b*, with color toner images to be a face side image representing the first toner image formed on the photoreceptor drum 10 and color toner images to be a reverse side image representing the second toner image carried on the intermittent transfer belt 14*a*, both synchronized by the driving of the timing roller 15. In this case, the recording sheet P to be fed is charged to be of the same polarity as that of toner by sheet charging unit 150 representing a transfer material charging means which is provided on the part of a face side of the recording sheet P to be attracted to the intermittent transfer belt 14*a*, and is fed to transfer area 14*b*. By conducting sheet-charging to be of the same polarity as that of toner, attraction for toner images on the intermittent transfer belt 14*a* and for those on the photoreceptor drum 10 can be prevented, and thereby disturbance of toner images can be prevented.

In the transfer area 14*b*, face side images on the photoreceptor drum 10 are collectively transferred (secondary transfer) onto the face side of recording sheet P by transfer unit 14*c* representing the second transfer means on which voltage with polarity opposite to that of toner (positive polarity in the present embodiment) is impressed. In this case, the reverse side image on the intermittent transfer belt 14*a* stays on the intermittent transfer belt 14*a* without being transferred onto the recording sheet P. In the case of the secondary transfer conducted by the transfer unit 14*c* representing the second transfer means, it is also possible to arrange so that uniform exposure may be conducted for better transfer by transfer-overlapping exposure unit 12*d* employing, for example, a light emitting diode which is provided inside the photoreceptor drum 10 to face the transfer area 14*b*.

Electric charges on the intermittent transfer belt 14*a* charged by the transfer unit 14*c* are neutralized by neutralizing unit 14*m*.

The recording sheet P wherein a color toner image has been transferred on its face side is conveyed to reverse side transfer unit 14*g* representing the third transfer means on which voltage with polarity (positive polarity in the present embodiment) opposite to that of toner is impressed, and reverse side images on the circumferential surface of the intermittent transfer belt 14*a* are collectively transferred (tertiary transfer) onto the reverse side of the recording sheet P (FIG. 2(*c*)).

The recording sheet P on both side of which color toner images have been formed is separated from the intermittent transfer belt 14*a* by curvature of curved portion KT of the intermittent transfer belt 14*a*, neutralizing operations of sheet separation AC neutralizing unit 14*h* representing a transfer material separating means provided, when necessary, at an end portion of the intermittent transfer belt

14*a* and by separation claw 210 provided on conveyance section 160 to be away from the intermittent transfer belt 14*a* by a prescribed clearance, and then is conveyed stably to fixing apparatus 17 through spurred wheel 162 and entrance guide plate 169 both provided on conveyance section 160. The leading edge portion of the recording sheet is inserted in nipping portion T of the fixing apparatus 17 by the entrance guide plate 169, and when heat and pressure are applied to the recording sheet P in the nipping section T between first ray irradiating roller 17*a* arranged at the upper side to fix toner images of the face side image (image on the upper side) and first fixing roller 47*a* arranged at the lower side to fix toner images of the reverse side image (image on the lower side), toner images on the recording sheet P are fixed. The recording sheet P on both sides of which images have been recorded is reversed inside out and is conveyed to be ejected to the tray outside an apparatus by sheet ejection roller 18. It is also possible to arrange to provide an unillustrated switching member at an exit of fixing apparatus 17 and to eject to the tray outside an apparatus without reversing inside out, as shown with one-dot chain lines in FIG. 1.

Toner remaining on the circumferential surface of the intermittent transfer belt 14*a* after the transfer is removed by intermittent transfer body cleaning unit 140 representing an intermittent transfer body cleaning means which is provided to face driven roller 14*e* through the intermittent transfer belt 14*a* and has an intermittent transfer body cleaning blade 141 which can swivel on the rotation fulcrum of supporting shaft 142 to come in contact with and to leave the intermittent transfer belt 14*a*.

Toner remaining on the circumferential surface of photoreceptor drum 10 after the transfer is neutralized by photoreceptor drum AC neutralizing unit 16, and then is removed by cleaning unit 19. Then, the hysteresis which is related to the preceding image forming and is remaining on the photoreceptor drum 10 is erased by pre-charging uniform exposure unit 12*e,* which makes the photoreceptor drum 10 to be ready for the following cycle.

When the above-mentioned method is used, color doubling of color images on intermittent transfer belt 14*a* and scattering and scrubbing of toner hardly take place because superposed color toner images are collectively transferred, and two-sided color image forming with less image deterioration can be carried out.

In the original image reading apparatus 500 stated above, when image data of original PS read by the original image reading apparatus shown in FIG. 3 are copied as a single-sided image for the face side only by photoreceptor drum 10, in the case of judgment for a single-sided image or for two-sided images, single-sided image forming program P2 for the face side by photoreceptor drum 10 representing an image carrier stored in ROM shown in FIG. 4 is read into RAM through the control section, the single-sided image forming program P2 for the face side is executed by the control section, and image forming process for the face side only by photoreceptor drum 10 explained in FIG. 1 is carried out continuously.

Further, when image data of original PS read by the original image reading apparatus shown in FIG. 3 are copied as a single-sided image for the reverse side only by intermittent transfer belt 14*a,* in the case of judgment for a single-sided image or for two-sided images, single-sided image forming program P3 for the reverse side by intermittent transfer belt 14*a* representing an intermittent transfer body stored in ROM shown in FIG. 4 is read into RAM through the control section, the single-sided image forming program P3 for the reverse side is executed by the control section, and image forming process for the reverse side only by intermittent transfer belt 14*a* explained in FIG. 1 is carried out continuously.

Though color image forming has been explained as an embodiment of an image forming apparatus employing a fixing apparatus of the invention, the invention can also be applied to single-sided or two-sided monochromatic image forming through the same process as those explained in FIG. 1 and FIGS. 2(*a*)–2(*c*), without being limited to the color image forming stated above. Though a two-sided image forming apparatus has been explained as an embodiment of an image forming apparatus employing a fixing apparatus of the invention, the fixing apparatus of the invention is not always limited to this, and it can be applied also to an image forming apparatus for the single-sided only. Though the fixing apparatus explained below will be explained as one for two-sided fixing, it is not limited to this and can be used as a single-sided fixing apparatus.

As shown in FIG. 5, fixing apparatus 17 of the first example is composed of first ray irradiating roller 17*a* representing a roll-shaped rotary member for fixing located on the upper side (face side) for fixing toner images of a face side image (an image on the upper side) and of fixing roller 47*a* representing a roll-shaped rotary member for fixing located on the lower side (reverse side) for fixing toner images of a reverse side image (an image on the lower side), and recording sheet p is nipped by nipping section T which is formed between the first ray irradiating roller 17*a* and the first fixing roller 47*a* and has width of about 2–10 mm, where heat and pressure are applied to the recording sheet P so that toner images thereon may be fixed.

The first ray irradiating roller 17*a* representing a rotary member for fixing toner images of a face side image is structured as a hard roller having therein cylindrical ray-transmitting base member 171*a* which is provided thereon (outer circumferential surface) with ray absorbing layer 171*b* and releasing layer 171*c* in this order and is provided therein with ray irradiating member 17l*g* representing a ray irradiating device employing, for example, a halogen lamp or a xenon lamp emitting mainly rays such as infrared radiation or far infrared radiation. Rays emitted from the ray irradiating member 171*g* are absorbed by the ray absorbing layer 171*b,* and thereby, a roll-shaped rotary member for fixing capable of heating instantly is formed (first example of a roll-shaped rotary member for fixing for instant heating). On the first ray irradiating roller 17*a* representing a roll-shaped rotary member for fixing provided on the upper side, there are provided, in the direction of rotation of the first ray irradiating roller 17*a* from the position of nipping section T, fixing oil cleaning blade TR1, oil coating felt TR2 and oil quantity regulating blade TR3, and oil supplied to the oil coating felt TR2 from oil tank TR4 through capillary pipe TR5 is coated on the first ray irradiating roller 17*a* by the oil coating felt TR2. Oil on the circumferential surface of the first ray irradiating roller 17*a* is removed by the fixing oil cleaning blade TR1. Therefore, temperature sensor TS1 which measures temperature of the first ray irradiating roller 17*a* described afterwards is provided on the cleaned circumferential surface of the first ray irradiating roller 17*a* located between the fixing oil cleaning blade TR1 and the oil coating felt TR2. The transfer material after fixing is separated by fixing separation claw TR6.

The first fixing roller 47*a* representing a roll-shaped rotary member for fixing which fixes toner images of a reverse side image is structured as a soft roller wherein rubber roller

471*b* which is made of silicone material and has a thickness of 2–20 mm, for example, is formed on the outer circumferential surface of cylindrical metal pipe 471*a* made of aluminum, for example, and halogen heater 471*c* is arranged inside the metal pipe 471*a*.

Between a hard roller on the upper side and a soft roller on the lower side, there is formed nipping section T whose lower side is convex, and toner images are fixed therein.

TS1 represents a temperature sensor which is mounted on the first ray irradiating roller 17*a* on the upper side and employs, for example, a thermistor for controlling temperature, while TS2 represents a temperature sensor which is mounted on the first fixing roller 47*a* on the lower side and employs, for example, a thermistor for controlling temperature.

With regard to the structure of the first ray irradiating roller 17*a* in FIGS. 6(*a*) and 6(*b*), ceramic materials (thermal conductivity is $(5.5–19.0)\times10^{-3}$ J/cm·s·k, thermal expansion coefficient is $(0.4–8)\times10^{-6}$ /·C) such as Pyrex glass, sapphire ($Al_2O_3$) and $CaF_2$ which transmit rays such as infrared radiation or far infrared radiation emitted from the ray irradiating member 171*g* are mainly used for cylindrical ray-transmitting base member 171*a* as shown in the sectional view in FIG. 6(*a*), and it is further possible to use light-transmitting resins (thermal conductivity is $(2.5–3.4)\times10^{-3}$ J/cm·s·k, coefficient of linear expansion is $(40–130)\times10^{-6}$/°C.) employing polyimide or polyamide. The wavelength of a ray transmitted through the ray-transmitting base member 171*a* is 0.1–20 μm and it preferably is 0.3–3 μm. Therefore, agents for adjusting hardness and thermal conductivity are added as a filler, but, the ray-transmitting base member 171*a* may also be formed by those wherein fine particles of metallic oxide which has a particle size that is a half of a wavelength of a ray, preferably not more than 1 μm representing ⅕ of the wavelength and preferably not more than 0.1 μm and is ray transmitting (mainly infrared radiation transmitting or far infrared radiation transmitting) such as titanium oxide, aluminum oxide, zinc oxide, silicon oxide, magnesium oxide and calcium carbonate are dispersed in a resin binder. It is preferable for preventing light scattering and for making the radiation to reach ray absorbing layer 171*b* in the layer that mean particle size including primary and secondary particles is not more than 1 μm, preferably not more than 0.1 μm. Therefore, thermal conductivity of the ray-transmitting base member 17*a* is not so high.

With regard to the ray absorbing layer 171*b*, it is formed by baking or coating ray absorbing member having a thickness of 10–200 μm, preferably of 20–100 μm on the outside (outer circumferential surface) of ray-transmitting base member 171*a* by using ray absorbing member wherein powder of carbon black, graphite, tri-iron tetroxide ($Fe_3O_4$) and various ferrite and its compound, copper oxide, cobalt oxide or red iron oxide ($Fe_2O_3$) is mixed in a resin binder, so that there may be formed a rotary member for fixing which absorbs rays of 90–100%, preferably of 95–100% equivalent mostly to 100% of rays emitted from ray irradiating member 171*g* and are transmitted through ray-transmitting base member 171*a* by means of ray absorbing layer 171*b* and is capable of heating instantly. When thermal conductivity in the ray absorbing layer 171*b* is lower than about 90% to be, for example, about 20–80%, rays may leak, and when first ray irradiating roller 17*a* representing a rotary member for fixing is used for monochromatic image forming by the leaked rays, and when black toner is stuck to the surface in specific position of the first ray irradiating roller 17*a* through filming, heat is generated by the leaked rays from the portion where black toner is sticking, and further heat generation caused by ray absorption takes place at that portion repeatedly, to damage the ray absorbing layer 171*b*. When used for color image forming, absorbing efficiency of color toner is generally low, and there is a difference of absorbing efficiency between color toners, which thereby causes failure of fixing and uneven fixing. Accordingly, ray absorbing rate of ray absorbing layer 171*b* is made to be 90–100%, preferably 95–100% equivalent mostly to 100% so that rays emitted from ray irradiating member 171*g* and are transmitted through ray-transmitting base member 171*a* may be absorbed in first ray irradiating roller 17*a* completely. When the thickness of the ray absorbing layer 171*b* is thin to be less than 10 μm, damage and insufficient strength of ray absorbing layer 171*b* are caused by local heating which is caused by a thinner film although heating speed by ray absorption in ray absorbing layer 171*b* is high, while when the thickness of the ray absorbing layer 171*b* is too thick to exceed 200 μm, failure of heat conduction is caused and heat capacity is made to be greater, which makes it difficult to heat instantly. When the ray absorbing rate of the ray absorbing layer 171*b* is made to be 90–100%, preferably 95–100% equivalent mostly to 100%, and when the thickness of the ray absorbing layer 171*b* is made to be 10–200 μm, preferably to be 20–100 μm, local heat generation on the ray absorbing layer 171*b* can be prevented and uniform heating is carried out. The wavelength of a ray irradiated on the ray absorbing layer 171*b* is 0.1–20 μm and it preferably is 0.3–3 μm. Therefore, agents for adjusting hardness and thermal conductivity are added as a filler, but, the ray absorbing layer 171*b* may also be formed by those wherein fine particles of metallic oxide which has a mean particle size of 1 μm or less, preferably of 0.1 μm or less including primary and secondary particles whose particle size is ½, preferably ⅕ of the wavelength of rays or less and is ray transmitting (mainly infrared radiation transmitting or far infrared radiation transmitting) such as titanium oxide, aluminum oxide, zinc oxide, silicon oxide, magnesium oxide and calcium carbonate are dispersed in a resin binder at the rate of 5–50% by weight. Thus, the ray absorbing layer 171*b* is made to have small heat capacity so that temperature may rise instantly, which prevents the problem that temperature fall is caused on the first ray irradiating roller 17*a* representing a rotary member for fixing and uneven fixing is caused.

Further, there is provided releasing layer 171*c* wherein the outside (outer circumferential surface of ray absorbing layer 171*b* is covered by PFA (fluorine resin) tube with a thickness of 30–100 μm separately from the ray absorbing layer 171*b* for improving the property for releasing from toner, or fluorine resin (PFA or PTFE) coating is coated to be the thickness of 20–30 μm (separation type).

As a sectional view is shown in FIG. 6(*b*), a ray absorbing member wherein powder of carbon black, graphite, tri-iron tetroxide ($Fe_3O_4$), various ferrite and their compounds, copper oxide, cobalt oxide and red iron oxide ($Fe_2O_3$) are mixed and fluorine resin (PFA or PTFE) coating serving both as a binder and releasing agent are mixed and arranged, and combination layer 171B having releasing property in which ray absorbing layer 171*b* and releasing layer 171*c* stated in FIG. 6(*a*) are united solidly is formed on the outer side (outer circumferential surface) of ray-transmitting base member 171*a* to form a roll-shaped rotary member for fixing. In the same way as in the foregoing, the ray absorbing rate of the combination layer 171B is made to be 90–100% equivalent mostly to 100%, preferably to be 95–100%, so that rays emitted from ray irradiating member 171*g* and transmitted through ray-transmitting base member 171*a* may be absorbed completely. When thermal conductivity in the combination layer 171B is lower than about 90% to be, for example, about 20–80%, rays may leak, and when a rotary member for fixing is used for monochromatic image forming by the leaked rays, and when black toner is stuck to the surface in specific position of the rotary member for fixing through filming, heat is generated by the leaked rays from the portion where black toner is sticking, and further heat generation caused by ray absorption takes place at that portion repeatedly, to damage the combination layer 171B. When used for color image forming, absorbing efficiency of color toner is generally low, and there is a difference of absorbing efficiency between color toners, which thereby causes failure of fixing and uneven fixing. Accordingly, ray absorbing rate of the combination layer 171B is made to be 90–100%, preferably 95–100% equivalent mostly to 100% so that rays emitted from ray irradiating member 171*g* and are transmitted through ray-transmitting base member 171*a* may be absorbed in the rotary member for fixing completely. Further, local heat generation on the combination layer 171B can be prevented and uniform heating is carried out. The wavelength of a ray irradiated on the combination layer 171B is 0.1–20 μm and it preferably is 0.3–3 μm. Therefore, agents for adjusting hardness and thermal conductivity are added as a filler, but, the combination layer 171B may also be formed by those wherein fine particles of metallic oxide such as ray transmitting (mainly infrared radiation transmitting or far infrared radiation transmitting) titanium oxide, aluminum oxide, zinc oxide, silicon oxide, magnesium oxide and calcium carbonate, having a particle size which is a half of a wavelength of a ray, preferably ⅕ of the wavelength or less and a mean particle size of 1 μm or less, preferably of 0.1 μm or less including primary and secondary particles, are dispersed in a resin binder at the rate of 5–50% by weight.

FIG. 7 shows that it is preferable to generate heat inside ray absorbing layer 171*b* by providing density distribution of ray absorbing member stated above on ray absorbing layer 171*b* of the first ray irradiating roller 17*a* representing a roll-shaped rotary member for fixing. As shown in graph (A), in the density distribution of the ray absorbing layer 171*b*, the density is low at the interface on the part of ray-transmitting base member 171 which is inscribed, and the density is made to be higher gradually toward the outer circumferential surface with an inclination to be saturated to be the density for 100% absorption at the position just before the outer circumferential surface (the position corresponding approximately to ⅔ to ⅘ of thickness t of the ray absorbing layer 171*b* from the ray-transmitting base member 171*a*). Due to this, as shown in a graph (B), heat generation distribution caused by ray absorption in the ray absorbing layer 171*b* is formed to be a parabola which shows the maximum value in the vicinity of the center portion of the ray absorbing layer 171*b* and shows the minimum value at the interface and in the vicinity of the outer circumferential surface of the ray absorbing layer 171*b*. Due to this, heat generation caused by ray absorption on the aforesaid interface is made to be small, and damage of a joining elastic layer at the interface and damage of the ray absorbing layer 171*b* are prevented. Further, density distribution from the position just before the outer circumferential surface (the position corresponding approximately to ⅔ to ⅘ of thickness t of the ray absorbing layer 171*b* from the ray-transmitting base member 171*a*) is made to be saturated, so that no influence is exerted even when a layer on the outer circumferential surface is scraped off when the combination layer 171B, for example, is used. Incidentally, a saturation layer may also be formed as shown with dotted lines. In short, no influence of density is exerted on the outer side if absorption is carried out inside sufficiently. No influence of scraping off is exerted either. It is further possible to provide an inclination on density distribution and thereby to adjust heat generation distribution by changing the inclination.

As shown in FIG. 8, as outside diameter ϕ of cylindrical ray-transmitting base member 171*a* of the first ray irradiating roller 17*a* representing a roll-shaped rotary member for fixing, those ranging from 15 mm to 60 mm are used, and with regard to thickness t, the thicker one is better in terms of strength, and thinner one is better in terms of heat capacity. From relationship between strength and heat capacity, the relation between outside diameter ϕ and thickness t of the cylindrical ray-transmitting base member 171*a* is made to be as follows, $$0.02 \leqq t/\phi \leqq 0.20$$

and is made preferably to be as follows.

$$0.04 \leqq t/\phi \leqq 0.10$$

When the outside diameter of the ray-transmitting base member 171*a* is 40 mm, thickness t of the ray-transmitting base member 171*a* satisfying 0.8 mm≦t≦8 mm, and preferably satisfying 1.0 mm≦t≦4.0 mm is used. When t/ϕ on the ray-transmitting base member 171*a* is less than 0.02, strength is insufficient, while when t/ϕ exceeds 0.20, heat capacity is made greater to make the time to heat the first ray irradiating roller 17*a* to be longer. Regardless of the ray-transmitting base member, it sometimes absorbs about 1–20% of rays depending on the material, and the thinner one is better, provided that the strength can be maintained.

Due to the foregoing, a fixing apparatus which can stand the deformation in the fixing section (nipping section) and is for quick start fixing by instant heating is made possible by using fixing apparatus 17 explained in FIG. 5, and instant heating fixing of quick start for toner images in the case of single-sided image forming on the face side which is used frequently is made possible by using the image forming apparatus explained in FIG. 1 in particular, and an effect of energy conservation is also obtained.

Pressure contact and driving for a flange member provided on a rotary member for fixing, the rotary member for fixing and a rotary member for fixing will be explained, referring to FIG. 9–FIG. 11. FIG. 9 is a sectional structure diagram for the roll-shaped rotary member for fixing provided on the upper side in FIG. 5 and for the roll-shaped rotary member for fixing provided on the lower side, FIG. 10 is a side view showing pressure contact and driving of the upper and lower rollers in FIG. 9, and FIG. 11 is a diagram showing another example of the flange member in FIG. 9. Incidentally, in the following explanation, an end portion on one side of each roller will be explained, but an end portion on the other side is the same in terms of structure.

In FIG. 9 or FIG. 10, the first ray irradiating roller 17*a* representing a roll-shaped rotary member for fixing for fixing toner images of a face side image is structured, as stated above, as a hard roller having cylindrical ray-transmitting base member 171*a* wherein ray absorbing layer 171*b* and releasing layer 171*c* are provided in this order on the outer side (outer circumferential surface) of the ray-transmitting base member 171*a*, and ray irradiating member 171*g* representing a ray irradiating device employing, for example, a halogen lamp or a xenon lamp is provided inside the ray-transmitting base member 171*a*. Thus, there is formed a roll-shaped rotary member for fixing wherein rays emitted from the ray irradiating member 171*g* are absorbed by the ray absorbing layer 171*b* and instant heating is made possible (first example of the rotary member for fixing for instant heating use).

The first fixing roller 47*a* representing a roll-shaped rotary member for fixing for fixing toner images of a reverse side image is structured as a soft roller having cylindrical metal pipe 471*a* made of, for example, aluminum wherein rubber roller 471*b* which is made of, for example, silicone material and has a thickness of 2–20 mm is formed on the outer circumferential surface of the metal pipe 471*a*, and halogen heater 471*c* is arranged inside the metal pipe 471*a*.

Between the upper hard roller and the lower soft roller, there is formed nipping section T whose lower side is convex where toner images are fixed.

As the cylindrical ray-transmitting base member 171*a* of the first ray irradiating roller 17*a* representing a rotary member for fixing toner images of a face side image, there are used ceramic materials with a wall thickness of about 2–10 mm (coefficient of linear expansion is $(0.4–8)\times10^{-6}/°$ C., thermal conductivity is $(5.5–19.0)\times10^{-3}$J/cm·s·k) mainly transmitting rays such as infrared radiation or far infrared radiation emitted from ray irradiating member 171*g* such as Pyrex glass, sapphire ($Al_2O_3$) and $CaF_2$ flange 900 representing a cylindrical flange member which is made of metal member (coefficient of linear expansion is $(10–30)\times10^{-6}/°$ C.) such as, for example, aluminum or stainless steel and has a thickness of about 1–3 mm is fitted in ground portion on the outer circumferential surface end portion of cylindrical ray-transmitting base member 171*a* having a width of about 10–50 mm, then, joining elastic layer S11 is formed by rubber type filling agent having elasticity or by adhesive between the ground portion outer circumferential surface of the ray-transmitting base member 171*a* and the inner side (inner circumferential surface) of fitting section 901 of the flange 900, and the flange 900 is fixed on the outer circumferential surface end portion of the cylindrical ray-transmitting base member 171*a* through the joining elastic layer S11.

As a rubber type filling agent or an adhesive, heat-resistant silicon and urethane type one are preferably used. It is preferable that the clearance of the fitting section 901 is made to be 100–1000 $\mu$m and filling agents or adhesives are filled in the clearance. With regard to hardness of the joining elastic layer S11, it is preferable that it is joined with flange 900 with appropriate hardness for the necessity to absorb stress of the ray-transmitting base member 171*a* and flange 900 and to minimize an amount of deformation, and hardness of 30–80 Hs (JIS A rubber hardness) is preferable.

On the outer side (outer circumferential surface) of the ray-transmitting base member 171*a* in which the flange 900 is fitted, there are formed ray absorbing layer 171*b* and releasing layer 171*c* in this order in a way that they cover fitting section 901 between the flange 900 and the ray-transmitting base member 171*a*.

Edge portion 902 representing the axis of rotation of the flange 900 is fitted in bearing B11 representing a bearing member fitted in side plate 101, and first ray irradiating roller 17*a* is mounted on the side plate 101. Further, fixing driving gear GA is fitted in the edge portion 902, and the fixing driving gear GA is fixed on the end portion of the first ray irradiating roller 17*a* with screws or pins.

On the other hand, cylindrical drawn portion 471A on the end portion of metal pipe 471*a* of the first fixing roller 47*a* representing a rotary member for fixing which fixes toner images of a reverse side image is fitted in bearing B12 representing a bearing member fitted in a groove (having no symbolic numeral) on lever 102*a,* and the first fixing roller 47*a* is mounted on the lever 102*a*.

With the bearing B12 holding the first fixing roller 47*a* being supported by stopper spring SP11 which is made of, for example, a piano wire or a flat spring and is attached to the lever 102*a*, one end of the lever 102*a* is rotatably mounted on stud Jil which is fixed on the side plate 101 while engaging with lever 102*a* and serves as a fulcrum for rotation. Further, coiled spring for pressure contact SP12 which is made of a piano wire having a diameter of, for example, about 1.5–3.0 mm and is hooked on stud J12 that is fixed on the other end of the lever 102*a* is hooked on stud J13 fixed on the side plate 101, thus, the first fixing roller 47*a* is brought into pressure contact with the first ray irradiating roller 17*a*.

Ray irradiating member 171*g* is inserted into the first ray irradiating roller 17*a*, and is held at the center position of the first ray irradiating roller 17*a* by terminals JT11 on both ends, and halogen heater 471*c* is inserted into the first fixing roller 47*a,* and is held at the center position of the first fixing roller 47*a* by terminals JT12 on both ends.

A light emitting area of the ray irradiating member 171*g* of the first ray irradiating roller 17*a* is mostly the same as a heat generating area of the halogen heater 471*c* of the first fixing roller 47*a,* and it is provided to be of a width broader than a passing area for the transfer material size (maximum transfer material size) inside fitting section 901 of flange 900.

The fixing driving gear GA fixed on the first ray irradiating roller 17*a* representing a rotary member for fixing which is used as a upper hard roller is driven to rotate by gear Gl through a driving system connected to fixing driving motor M1, thereby the first fixing roller 47*a* representing a rotary member for fixing which is used as a lower soft roller is driven to rotate through nipping section T.

By providing a joining elastic layer having elasticity on the joining section as stated above, deformation and pressure applied directly to a ray-transmitting base member of a rotary member for fixing are reduced, separation and damage on the end portion of the ray-transmitting base member are prevented, and the center of the ray-transmitting base member can be positioned highly accurately. Further, by providing a joining elastic layer, torque and pressure coming from a driving system which joins the rotary member for fixing and the ray-transmitting base member are lightened and are not applied directly to the ray-transmitting base member, and thereby, damage of the ray-transmitting base member and separation of a flange member both in the case of driving the rotary member for fixing are prevented. In particular, by providing a flange member which employs a metallic member on the outer side of a ray-transmitting base member employing mainly a ceramic pipe, the ray-transmitting base member is protected by the flange member which is provided outside and employs a metallic member even when thermal expansion of the flange member employing the metal member is greater than that of the ray-transmitting base member, thus, damage of the end portion of the ray-transmitting base member and separation of the flange member both caused by deformation and pressure applied to the end portion of the rotary member for fixing are prevented.

As cylindrical ray-transmitting base member 171*a* of first ray irradiating roller 17*a* representing a rotary member for fixing which fixes toner images of a face side image, it is possible that there is used heat-resistant light-transmitting resin (coefficient of linear expansion is about $(40–130)\times10^{-}$ $_6$/° C.) having a wall thickness of about 2–10 mm such as polyimide and polyamide transmitting rays of infrared radiation or far infrared radiation coming from ray irradiating member 171*g,* then, flange 910 representing a cylindrical flange member having a wall thickness of about 1–3 mm which is made of heat-resistant engineering plastic (coefficient of linear expansion is about $(40–130)\times10^{-6}$/° C.) such as, for example, modified polyimide, thermosetting polyimide, ethylene-tetrafluoroethylene copolymer, polyfluorovinylidene or nylon alloy is fitted in an end portion on the inner side (inner circumferential surface) of cylindrical ray-transmitting base member 171*a* of the first ray irradiating roller 17*a* representing a rotary member for fixing, as shown in FIG. 11, and under the state that they are centered by an unillustrated jig, joining elastic layer S12 is formed between the inner side (inner circumferential surface) at am end portion of the ray-transmitting base member 171*a* and the outer side (outer circumferential surface) of the fitting section 911 of the flange 910 with elastic rubber type filling agents or adhesives, thus, the flange 910 is fixed on the end portion on the inner circumferential surface of the cylindrical ray-transmitting base member 171*a* through the joining elastic layer S12.

As a rubber type filling agent or adhesive, heat-resistant silicon and those of urethane type are preferably used. It is preferable that a clearance of the fitting section 911 is made to be 100–1000 $\mu$m and filling agents or adhesives are filled in the clearance. With regard to hardness of the joining elastic layer S12, it is preferable that it is joined with flange 910 with appropriate hardness for the necessity to absorb stress of the ray-transmitting base member 171*a* and flange 910 and to minimize an amount of deformation, and hardness of 30–80 Hs (JIS A rubber hardness) is preferable.

On the outer side (outer circumferential surface) of the ray-transmitting base member 171*a* in which the flange 910 is fitted, there are formed ray absorbing layer 171*b* and releasing layer 171*c* in this order in a way that they cover even the outer circumferential surface of combination section 913 with ray-transmitting base member 171*a* of the flange 910.

In the same way as in the description in FIG. 9, the first ray irradiating roller 17*a* representing a rotary member for fixing is driven to rotate.

Due to the foregoing, by providing a joining elastic layer having elasticity on the joining section, deformation and pressure applied directly to a ray-transmitting base member of a rotary member for fixing are reduced, separation and damage of the edge portion of the ray-transmitting base member are prevented, and the ray-transmitting base member can be centered accurately. Further, by providing a joining elastic layer, torque and pressure applied to the ray-transmitting base member of a rotary member for fixing from the driving system are lightened not to be applied directly to the ray-transmitting base member, thus, damage of the ray-transmitting base member and separation of the flange member both caused when the rotary member for fixing is driven can be prevented. In particular, by using a resin member for both of the ray-transmitting base member and flange member, they are mostly the same in terms of thermal expansion, thus, deformation and pressure caused by the flange member are not applied to the edge portion of the rotary member for fixing, and damage on the edge portion of the ray-transmitting base member and separation from the flange member are prevented. Further, the rotary member for fixing whose axis of rotation is a flange member attached on the ray-transmitting base member through the joining elastic layer can be centered accurately, and creases on the transfer material in the course of fixing can be prevented.

Another example of the fixing apparatus will be explained as follows, referring to FIGS. 12–15. FIG. 12 is an illustration showing the structure of the second example of a fixing apparatus, each of FIGS. 13(*a*) and 13(*b*) is an enlarged sectional structure diagram of the second example of a roll-shaped rotary member for fixing, FIG. 14 is a diagram showing density distribution on a ray absorbing layer in the second example of the roll-shaped rotary member for fixing, and FIG. 15 is a diagram showing an outside diameter and a thickness of the ray-transmitting base member in the second example of the roll-shaped rotary member for fixing.

As shown in FIG. 12, fixing apparatus 17A in the second example is composed of the second ray irradiating roller 17*b* representing a roll-shaped rotary member for fixing on the upper side (face side) which fixes toner images of a face side image (image on the upper side) and the second fixing roller 47*b* representing a roll-shaped rotary member for fixing on the lower side (reverse side) which fixes toner images of a reverse side image (image on the lower side), and recording sheet P is nipped by nipping section T which is formed between the second ray irradiating roller 17*b* and the second fixing roller 47*b* and has a width of about 2–10 mm wherein heat and pressure are applied on the recording sheet P and toner images thereon are fixed.

The second ray irradiating roller 17*b* representing a rotary member for fixing which fixes toner images of a face side image is structured as a soft roller having cylindrical ray-transmitting base member 171*a* wherein resilient layer 171*d*, ray absorbing layer 171*b* and releasing layer 171*c* are provided in this order on the outer side (outer circumferential surface) of the ray-transmitting base member 171*a,* and ray irradiating member 171*g* representing a ray irradiating device employing, for example, a halogen lamp or a xenon lamp emitting mainly infrared radiation or far infrared radiation is provided inside the ray-transmitting base member 171*a*. Thus, there is formed a roll-shaped rotary member for fixing wherein rays emitted from the ray irradiating member 171*g* are absorbed by the ray absorbing layer 171*b* and thereby instant heating is made possible (second example of the roll-shaped rotary member for fixing for instant heating use). On the second ray irradiating roller 17*b* representing a roll-shaped rotary member for fixing provided on the upper side, there are provided fixing separation claw TR6, fixing oil cleaning blade TR1, oil coating felt TR2 and oil quantity regulating blade TR3 to be on the downstream side from nipping section T in the direction of rotation of the second ray irradiating roller 17*b,* and oil supplied from oil tank TR4 to the oil coating felt TR2 through capillary pipe TR5 is coated on the second ray irradiating roller 17*b* by the oil coating felt TR2. Oil on the circumferential surface of the second ray irradiating roller 17*b* is removed by the fixing oil cleaning blade TR1. Therefore, temperature sensor TS1 for measuring temperature of the second ray irradiating roller 17*b* which will be stated later is provided on the cleaned circumferential surface on the second ray irradiating roller 17*b* located between the fixing oil cleaning blade TR1 and the oil coating felt TR2. The transfer material which has been subjected to fixing is separated by the fixing separation claw TR6.

Second fixing roller 47*b* representing a rotary member for fixing which fixes toner images of a reverse side image is formed with cylindrical metal pipe 472*a* which is made of, for example, aluminum materials or steel materials and is subjected to Teflon coating on its outer circumferential surface through baking or coating, and it is structured as a hard roller wherein halogen heater 471*c* is arranged inside the metal pipe 472*a*.

Between the soft roller on the upper side and the hard roller on the lower side, there is formed nipping section T whose upper side is convex by which toner images are fixed.

TS1 represents a temperature sensor which is mounted on second ray irradiating roller 17*b* on the upper side and employs, for example, a thermistor for temperature control, while TS2 represents a temperature sensor which is mounted on second fixing roller 47*b* on the lower side and employs, for example, a thermistor for temperature control.

With regard to the structure of the second ray irradiating roller 17*b* in FIGS. 13(*a*) and 13(*b*), ceramic materials (thermal conductivity is $(5.5–19.0)\times10^{-3}$ J/cm·s·k, thermal expansion coefficient is $(0.4–8)\times10^{-6}$/° C.) such as Pyrex glass, sapphire ($Al_2O_3$) and $CaF_2$ which transmit rays such as infrared radiation or far infrared radiation emitted from the ray irradiating member 171*g* are mainly used for cylindrical ray-transmitting base member 171*a* as shown in the sectional view in FIG. 13(*a*), and it is further possible to use light-transmitting resins (thermal conductivity is $(2.5–3.4)\times10^{-3}$ J/cm·s·k, coefficient of linear expansion is $(40–130)\times10^{-6}$/° C.) employing polyimide or polyamide. The wavelength of a ray transmitted through the ray-transmitting base member 171*a* is 0.1–20 μm and it preferably is 0.3–3 μm. Therefore, agents for adjusting hardness and thermal conductivity are added as a filler, but, the ray-transmitting base member 171*a* may also be formed by those wherein fine particles of metallic oxide such as ray transmitting (mainly infrared radiation transmitting or far infrared radiation transmitting) ITO, titanium oxide, aluminum oxide, zinc oxide, silicon oxide, magnesium oxide and calcium carbonate, having a particle size which is a half of a wavelength of a ray, preferably ⅕ of the wavelength or less and a mean particle size of 1 μm or less, preferably of 0.1 μm or less including primary and secondary particles, are dispersed in a resin binder. It is preferable for preventing light scattering and for making the radiation to reach ray absorbing layer 171*b* that a mean particle size including primary and secondary particles is not more than 1 μm, preferably not more than 0.1 μm in the layer. Therefore, thermal conductivity of the ray-transmitting base member 17*a* is not so high.

The resilient layer 171*d* is formed with a ray transmitting robber layer (base layer) which employs, for example, silicone rubber having a thickness of about 0.5–20 mm and preferably 1–5 mm, and transmits the aforesaid rays (mainly infrared radiation or far infrared radiation). To comply with high speed operations, the resilient layer 171*d* is subjected to a method to combine powder of metallic oxide such as silica, alumina and magnesium oxide with base rubber (silicone rubber) as a filler, and thereby to improve thermal conductivity, and it is preferable that the elastic layer is made to be a rubber layer having the thermal conductivity is about $(1.3–1.6)\times10^{-3}$ J/cm·s·k. When the thermal conductivity is enhanced, rubber hardness generally tends to be higher, and the rubber hardness which is normally 40 Hs, for example, is raised to be nearly 60 Hs (JIS A rubber hardness). It is preferable that rubber hardness is within a range of 40–60 Hs. The most part of the resilient layer 171*d* is occupied by this base layer, and an amount of compression in the case of application of the pressure is determined by the rubber hardness of the base layer. As an intermittent layer of the resilient layer 171*d*, fluorine type rubber is coated to be of a thickness of 20–300 μm as an oilproof layer for prevention of oil swelling. As silicone rubber for the top layer of the resilient layer 171*d*, RTV (room temperature vulcanizing) and LTV (low temperature vulcanizing) which are better in terms of releasing property than HTV (HIGH temperature vulcanizing) are used to be of the same thickness as that on the intermittent layer. Since the wavelength of a ray transmitted through the resilient layer 171*d* is 0.1–20 μm and it preferably is 0.3–3 μm, the resilient layer 171*d* may also be formed by those wherein fine particles of metallic oxide such as ray transmitting (mainly infrared radiation transmitting or far infrared radiation transmitting) titanium oxide, aluminum oxide, zinc oxide, silicon oxide, magnesium oxide and calcium carbonate, having a particle size which is a half of a wavelength of a ray, preferably ⅕ of the wavelength or less and a mean particle size of 1 μm or less, preferably of 0.1 μm or less including primary and secondary particles, are dispersed in a resin binder as an adjusting agent for hardness and thermal conductivity. It is preferable for preventing light scattering and for making the radiation to reach ray absorbing layer 171*b* that a mean particle size including primary and secondary particles is not more than 1 μm, preferably not more than 0.1 μm in the layer. By providing the resilient layer 171*d*, the second ray irradiating roller 17*b* representing a rotary member for fixing can be structured as a soft roller having high elasticity.

With regard to the ray absorbing layer 171*b*, it is formed by blasting or coating ray absorbing member having a thickness of 10–200 μm, preferably of 20–100 μm on the outside (outer circumferential surface) of resilient layer 171*d* by using ray absorbing member wherein powder of carbon black, graphite, tri-iron tetroxide ($Fe_3O_4$) and various ferrite and its compound, copper oxide, cobalt oxide or red iron oxide ($Fe_2O_3$) is mixed in a resin binder, so that there may be formed a rotary member for fixing which absorbs rays of 90–100%, preferably of 95–100% equivalent mostly to 100% of rays emitted from ray irradiating member 171*g* and are transmitted through ray-transmitting base member 171*a* and resilient layer 171*d* by means of ray absorbing layer 171*b* and is capable of heating instantly. When thermal conductivity in the ray absorbing layer 171*b* is lower than about 90% to be, for example, about 20–80%, rays may leak, and when second ray irradiating roller 17*b* representing a rotary member for fixing is used for monochromatic image forming by the leaked rays, and when black toner is stuck to the surface in specific position of the second ray irradiating roller 17*b* through filming, heat is generated by the leaked rays from the portion where black toner is sticking, and further heat generation caused by ray absorption takes place at that portion repeatedly, to damage the ray absorbing layer 171*b*. When used for color image forming, absorbing efficiency of color toner is generally low, and there is a difference of absorbing efficiency between color toners, which thereby causes failure of fixing and uneven fixing. Accordingly, ray absorbing rate of ray absorbing layer 171*b* is made to be 90–100% preferably 95–100% equivalent mostly to 100% so that rays emitted from ray irradiating member 171*g* and are transmitted through resilient layer 171*d* may be absorbed in second ray irradiating roller 17*b* completely. When the thickness of the ray absorbing layer 171*b* is thin to be less than 10 μm, damage and insufficient strength of ray absorbing layer 171*b* are caused by local heating which is caused by a thinner film although heating speed by ray absorption in ray absorbing layer 171*b* is high, while when the thickness of the ray absorbing layer 171*b* is too thick to exceed 200 μm, failure of heat conduction is caused and heat capacity is made to be greater, which makes it difficult to heat instantly. When the ray absorbing rate of the ray absorbing layer 171*b* is made to be 90–100%, preferably 95–100% equivalent mostly to 100%, and when the thickness of the ray absorbing layer 171*b* is made to be 10–200 μm, preferably to be 20–100 μm, local heat generation on the ray absorbing layer 171*b* can be prevented and uniform heating is carried out. The wavelength of a ray irradiated on the ray absorbing layer 171*b* is 0.1–20 μm and it preferably is 0.3–3 μm. Therefore, agents for adjusting hardness and thermal conductivity are added as a filler, but, the ray absorbing layer 171*b* may also be formed by those wherein fine particles of metallic oxide which has a mean particle size of 1 μm or less, preferably of 0.1 μm or less including primary and secondary particles whose particle size is ½, preferably ⅕ of the wavelength of rays or less and is ray transmitting (mainly infrared radiation transmitting or far infrared radiation transmitting) such as titanium oxide, aluminum oxide, zinc oxide, silicon oxide, magnesium oxide and calcium carbonate are dispersed in a resin binder at the rate of 5–50% by weight. Thus, the ray absorbing layer 171*b* is made to have small heat capacity so that temperature may rise instantly, which prevents the problem that temperature fall is caused on the second ray irradiating roller 17*b* representing a rotary member for fixing and uneven fixing is caused.

Further, there is provided releasing layer 171*c* wherein the outside (outer circumferential surface of ray absorbing layer 171*b* is covered by PFA (fluorine resin) tube with a thickness of 30–100 μm separately from the ray absorbing layer 171*b* for improving the property for releasing from toner, or fluorine resin (PFA or PTFE) coating is coated to be the thickness of 20–30 μm (separation type).

As a sectional view is shown in FIG. 13(*b*), a ray absorbing member wherein powder of carbon black, graphite, tri-iron tetroxide ($Fe_3O_4$), various ferrite and their compounds, copper oxide, cobalt oxide and red iron oxide ($Fe_2O_3$) are mixed and fluorine resin (PFA or PTFE) coating serving both as a binder and releasing agent are mixed and arranged, and combination layer 171B having releasing property in which ray absorbing layer 171*b* and releasing layer 171*c* stated in FIG. 13(*a*) are united solidly is formed on the outer side (outer circumferential surface) of the resilient layer 171*d* which is formed on the outer side (outer circumferential surface) of ray-transmitting base member 171*a* to form a roll-shaped rotary member for fixing. In the same way as in the foregoing, the ray absorbing rate of the combination layer 171B is made to be 90–100% equivalent mostly to 100%, preferably to be 95–100%, so that rays emitted from ray irradiating member 171*g* and transmitted through ray-transmitting base member 171*a* and resilient layer 171*d* may be absorbed completely. When thermal conductivity in the combination layer 171B is lower than about 90% to be, for example, about 20–80%, rays may leak, and when a rotary member for fixing is used for monochromatic image forming by the leaked rays, and when black toner is stuck to the surface in specific position of the rotary member for fixing through filming, heat is generated by the leaked rays from the portion where black toner is sticking, and further heat generation caused by ray absorption takes place at that portion repeatedly, to damage the combination layer 171B. When used for color image forming, absorbing efficiency of color toner is generally low, and there is a difference of absorbing efficiency between color toners, which thereby causes failure of fixing and uneven fixing. Accordingly, ray absorbing rate of the combination layer 171B is made to be 90–100%, preferably 95–100% equivalent mostly to 100% so that rays emitted from ray irradiating member 171*g* and are transmitted through ray-transmitting base member 171*a* may be absorbed in the rotary member for fixing completely. Further, local heat generation on the combination layer 171B can be prevented and uniform heating is carried out. The wavelength of a ray irradiated on the combination layer 171B is 0.1–20 μm and it preferably is 0.3–3 μm. Therefore, agents for adjusting hardness and thermal conductivity are added as a filler, but, the combination layer 171B may also be formed by those wherein fine particles of metallic oxide such as ray transmitting (mainly infrared radiation transmitting or far infrared radiation transmitting) titanium oxide, aluminum oxide, zinc oxide, silicon oxide, magnesium oxide and calcium carbonate, having a particle size which is a half of a wavelength of a ray, preferably ⅕ of the wavelength or less and a mean particle size of 1 μm or less, preferably of 0.1 μm or less including primary and secondary particles, are dispersed in a resin binder.

According to FIG. 14, it is preferable to provide density distribution of the ray absorbing member on ray absorbing layer 171*b* of the second ray irradiating roller 17*b* representing a roll-shaped rotary member for fixing, and thereby to cause heat to be generated inside the ray absorbing layer 171*b*. As shown in graph (A), in the density distribution of the ray absorbing layer 171*b*, the density is low at the interface on the part of resilient layer 171*d* which is inscribed, and the density is made to be higher gradually toward the outer circumferential surface with an inclination to be saturated to be the density for 100% absorption at the position just before the outer circumferential surface (the position corresponding approximately to ⅔ to ⅘ of thickness t of the ray absorbing layer 171*b* from the resilient layer 171*d*). Due to this, as shown in a graph (B), heat generation distribution caused by ray absorption in the ray absorbing layer 171*b* is formed to be a parabola which shows the maximum value in the vicinity of the center portion of the ray absorbing layer 171*b* and shows the minimum value at the interface and in the vicinity of the outer circumferential surface of the ray absorbing layer 171*b*. Due to this, heat generation caused by ray absorption on the aforesaid interface is made to be small, and damage of a joining elastic layer at the interface and damage of the ray absorbing layer 171*b* are prevented. Further, density distribution from the position just before the outer circumferential surface (the position corresponding approximately to ⅔ to ⅘ of thickness t of the ray absorbing layer 171*b* from the ray-transmitting base member 171*a*) is made to be saturated, so that no influence is exerted even when a layer on the outer circumferential surface is scraped off when the combination layer 171B, in particular, is used. Incidentally, a saturation layer may also be formed as shown with dotted lines. In short, no influence of density is exerted on the outer side if absorption is carried out inside sufficiently. No influence of scraping off is exerted either. It is further possible to provide an inclination on density distribution and thereby to adjust heat generation distribution by changing the inclination.

As shown in FIG. 15, as outside diameter ϕ of cylindrical ray-transmitting base member 171*a* of the second ray irradiating roller 17*b* representing a roll-shaped rotary member for fixing, those ranging from 15 mm to 60 mm are used, and with regard to thickness t, the thicker one is better in terms of strength, and thinner one is better in terms of heat capacity. From relationship between strength and heat capacity, the relation between outside diameter ϕ and thickness t of the cylindrical ray-transmitting base member 171*a* is made to be as follows, $$0.02 \leqq t/\phi \leqq 0.20$$

and is made preferably to be as follows.

$$0.04 \leqq t/\phi \leqq 0.10$$

When the outside diameter of the ray-transmitting base member 171*a* is 40 mm, thickness t of the ray-transmitting base member 171*a* satisfying 0.8 mm≦t≦8 mm, and preferably satisfying 1.0 mm≦t≦4.0 mm is used. When t/ϕ on the ray-transmitting base member 171*a* is less than 0.02, strength is insufficient, while when t/ϕ exceeds 0.20, heat capacity is made greater to make the time to heat the second ray irradiating roller 17*b* to be longer. Regardless of the ray-transmitting base member, it sometimes absorbs about 1–20% of rays depending on the material, and the thinner one is better, provided that the strength can be maintained.

A fixing apparatus which can stand the deformation in the fixing section (nipping section) and is for quick start fixing by instant heating is made possible by using fixing apparatus 17A explained in FIG. 12, and further, pressurization at a soft fixing section (nipping section) by elasticity of a rotary member for fixing and heating by a ray absorbing layer of the rotary member for fixing make it possible to fuse satisfactorily color toner which is difficult to be fixed by rays due to different spectral characteristics, and make it possible for color toner to be fixed through instant heating or to be fixed through quick start with shorter heating time. When the fixing apparatus stated above is used for the image forming apparatus explained in FIG. 1, in particular, fixing of toner images under quick start and instant heating in the course of fixing control in frequently-used single-sided image forming for the face side which will be stated later referring to FIGS. 22(*a*), 22(*b*) and 22(*c*) can be made possible, and an effect of energy conservation is obtained. Further, pressurization at a soft fixing section (nipping section) by elasticity of a rotary member for fixing and heating by a ray absorbing layer of the rotary member for fixing make it possible to fix toner images on a transfer material under quick start and instant heating in the course of fixing control in frequently-used single-sided image forming for the face side which will be stated in detail referring to FIGS. 22(*a*) to 22(*c*), and further, fixing by pressurization at a soft fixing section (nipping section) by elasticity of a rotary member for fixing and heating by a ray absorbing layer of the rotary member for fixing makes it possible to fuse satisfactorily superposed color toner images on a transfer material with a thick toner layer which are difficult to be fixed by rays due to different spectral characteristics, thus, fixing of color toner images with shorter heating time are made possible.

A flange member provided on the rotary member for fixing explained in FIG. 12, and pressure contact between the rotary member for fixing and a rotary member for fixing as well as driving therefor will be explained as follows, referring to FIGS. 16–18. FIG. 16 is a sectional structure diagram of a roll-shaped rotary member for fixing provided on the upper side in FIG. 12 and a roll-shaped rotary member for fixing provided on the lower side, FIG. 17 is a side view showing pressure contact and driving for the upper and lower rollers in FIG. 16, and FIG. 18 is a diagram showing another example of the flange member in FIG. 16. Incidentally, in the following explanation, an end portion on one side of each roller will be explained, but an end portion on the other side thereof is the same in terms of structure.

In FIG. 16 or FIG. 17, the second ray irradiating roller 17*b* representing a rotary member for fixing which fixes toner images of a face side image is structured, as stated above, as a soft roller having cylindrical ray-transmitting base member 171*a* wherein resilient layer 17*d*, ray absorbing layer 171*b* and releasing layer 171*c* are provided in this order on the outer side (outer circumferential surface) of the ray-transmitting base member 171*a*, and ray irradiating member 171*g* representing a ray irradiating device employing, for example, a halogen lamp or a xenon lamp is provided inside the ray-transmitting base member 171*a*. The ray-transmitting base member 171*a* representing a rotary member for fixing is structured in the aforesaid method as a soft roller having high elasticity. There is formed a roll-shaped rotary member for fixing wherein rays emitted from the ray irradiating member 171*g* are absorbed by the ray absorbing layer 171*b* and instant heating is made possible accordingly (second example of the rotary member for fixing for instant heating).

Second fixing roller 47*b* representing a rotary member for fixing which fixes toner images of a reverse side image is formed with cylindrical metal pipe 472*a* employing, for example, iron material or steel material (thermal conductivity is $(0.15–0.76)\times10^{-3}$ J/cm·s·k) whose outer circumferential surface is baked or coated with a Teflon coat, and is structured as a hard roller wherein halogen heater 471*c* is arranged inside the metal pipe 472*a*.

Between the upper soft roller and the lower hard roller, there is formed nipping section T whose upper side is convex by which toner images are fixed.

As cylindrical ray-transmitting base member 171*a* of the second ray irradiating roller 17*b* representing a rotary member for fixing which fixes toner images of a face side image, there are used ceramic materials (coefficient of linear expansion is $(0.4–8)\times10^{-6}$/° C.), and thermal conductivity is $(5.5–19.0)\times10^{-3}$ J/cm·s·k) having a wall thickness of 2–10 mm which mainly transmits rays such as infrared radiation or far infrared radiation from ray irradiating member 171*g* such as Pyrex glass, sapphire ($Al_2O_3$) and $CaF_2$, and for example, flange 920 representing a cylindrical flange member which is made of metallic member (coefficient of linear expansion is $(10–30)\times10^{-6}$/° C.) such as aluminum or stainless steel and has a wall thickness of about 1–3 mm is fitted in an end portion of the outer circumferential surface of cylindrical ray-transmitting base member 171*a* with a width of about 10–50 mm, then, joining elastic layer S21 is formed by rubber type filling agent having elasticity or by adhesive between the outer circumferential surface end portion of the ray-transmitting base member 171*a* and the inner side (inner circumferential surface) of fitting section 921 of the flange 920, and the flange 920 is fixed on the outer circumferential surface end portion of the cylindrical ray-transmitting base member 171*a* through the joining elastic layer S21.

As a rubber type filling agent or an adhesive, heat-resistant silicon and urethane type one are preferably used. It is preferable that the clearance of the fitting section 921 is made to be 100–1000 μm and filling agents or adhesives are filled in the clearance. With regard to hardness of the joining elastic layer S21, it is. preferable that it is joined with flange 920 with appropriate hardness for the necessity to absorb stress of the ray-transmitting base member 171*a* and flange 920 and to minimize an amount of deformation, and hardness of 30–80 Hs (JIS A rubber hardness) is preferable.

On the outer side (outer circumferential surface) of the ray-transmitting base member 171*a* in which the flange 920 is fitted, there are formed resilient layer 171*d*, ray absorbing layer 171*b* and releasing layer 171*c* in this order in a way that they cover fitting section 921 between the flange 920 and the ray-transmitting base member 171*a*.

Edge portion 922 representing the axis of rotation of the flange 920 is fitted in bearing B21 representing a bearing member fitted in a groove (having no symbolic number) of lever 102*b*, and second ray irradiating roller 17*b* is mounted on the lever 102*b*.

On the other hand, cylindrical drawn portion 472A on the end portion of metal pipe 472*a* of the second fixing roller 47*b* representing a rotary member for fixing which fixes toner images of a reverse side image is fitted in bearing B22 representing a bearing member fitted in side plate 101, and the second fixing roller 47*b* is mounted on the side plate 101. Further, fixing driving gear GB is fitted on the drawn portion 472A, and the fixing driving gear GB is fixed on the end portion of the second fixing roller 47*b* by means of screws or pins.

With the bearing B21 holding the second ray irradiating roller 17*b* being supported by stopper spring SP21 which is made of, for example, a piano wire or a flat spring and is attached to the lever 102*b*, one end of the lever 102*b* is rotatably mounted on stud J21 which is fixed on the side plate 101 while engaging with lever 102*b* and serves as a fulcrum for rotation. Further, coiled spring for pressure contact SP22 which is made of a piano wire having a diameter of, for example, about 1.5–3.0 mm and is hooked on stud J22 that is fixed on an end on the other side of the lever 102*b* is hooked on stud J23 fixed on side plate 101, thus, the second ray irradiating roller 17*b* is brought into pressure contact with the second fixing roller 47*b*.

Ray irradiating member 171*g* is inserted into the second ray irradiating roller 17*b*, and is held at the center position of the second ray irradiating roller 17*b* by terminals JT21 on both ends, and halogen heater 471*c* is inserted into the second fixing roller 47*b*, and is held at the center position of the second fixing roller 47*b* by terminals JT22 on both ends.

A light emitting area of the ray irradiating member 171*g* of the second ray irradiating roller 17*b* is mostly the same as a heat generating area of the halogen heater 471*c* of the second fixing roller 47*b*, and it is provided to be of a width broader than a passing area for the transfer material size (maximum transfer material size) inside fitting section 921 of flange 920.

The fixing driving gear GB fixed on the second ray irradiating roller 47*b* representing a rotary member for fixing which is used as a lower hard roller is driven to rotate by gear G2 through a driving system connected to fixing driving motor M1, thereby the second ray irradiating roller 17*b* representing a rotary member for fixing which is used as an upper soft roller is driven to rotate through nipping section T. Due to this, pressure from the driving system is not applied directly on the rotary member for fixing, and thereby, damage of a ray-transmitting base member in the case of driving the rotary member for fixing is prevented.

By providing a joining elastic layer having elasticity on the joining section as stated above, deformation and pressure applied directly to a ray-transmitting base member of a rotary member for fixing are reduced, separation and damage on the end portion of the ray-transmitting base member are prevented, and the center of the ray-transmitting base member can be positioned highly accurately. Further, by providing a joining elastic layer, torque and pressure coming from a driving system which joins the rotary member for fixing and the ray-transmitting base member are lightened and are not applied directly to the ray-transmitting base member, and thereby, damage of the ray-transmitting base member and separation of a flange member both in the case of driving the rotary member for fixing are prevented. In particular, by providing a flange member which employs a metallic member on the outer side of a ray-transmitting base member employing mainly a ceramic pipe, the ray-transmitting base member is protected by the flange member which is provided outside and employs a metallic member even when thermal expansion of the flange member employing the metal member is greater than that of the ray-transmitting base member, thus, damage of the end portion of the ray-transmitting base member and separation of the flange member both caused by deformation and pressure applied to the end portion of the rotary member for fixing are prevented. Further, the rotary member for fixing whose axis of rotation is a flange member attached on the ray-transmitting base member through the joining elastic layer can be centered accurately, and creases on the transfer material in the course of fixing can be prevented.

As cylindrical ray-transmitting base member 171*a* of second ray irradiating roller 17*b* representing a rotary member for fixing which fixes toner images of a face side image, it is possible that there is used heat-resistant light-transmitting resin (coefficient of linear expansion is about $(40–130)\times10^{-6}/°$ C.) having a wall thickness of about 2–10 mm such as polyimide and polyamide transmitting rays of infrared radiation or far infrared radiation coming from ray irradiating member 171*g*, then, flange 930 representing a cylindrical flange member having a wall thickness of about 1–3 mm which is made of heat-resistant engineering plastic (coefficient of linear expansion is about $(40–130)\times10^{-6}/°$ C.) such as, for example, modified polyimide, thermosetting polyimide, ethylene-tetrafluoroethylene copolymer, polyfluorovinylidene or nylon alloy is fitted in an end portion on the inner side (inner circumferential surface) of cylindrical ray-transmitting base member 171*a* of the second ray irradiating roller 17*b* representing a rotary member for fixing, as shown in FIG. 18, and under the state that they are centered by an unillustrated jig, joining elastic layer S22 is formed between the inner side (inner circumferential surface) at an end portion of the ray-transmitting base member 171*a* and the outer side (outer circumferential surface) of the fitting section 931 of the flange 930 with elastic rubber type filling agents or adhesives, thus, the flange 930 is fixed on the end portion on the inner circumferential surface of the cylindrical ray-transmitting base member 171*a* through the joining elastic layer S22.

As a rubber type filling agent or adhesive, heat-resistant silicon and those of urethane type are preferably used. It is preferable that a clearance of the fitting section 931 is made to be 100–1000 $\mu$m and filling agents or adhesives are filled in the clearance.

With regard to hardness of the joining elastic layer S22, it is preferable that it is joined with flange 930 with appropriate hardness for the necessity to absorb stress of the ray-transmitting base member 171*a* and flange 930 and to minimize an amount of deformation, and hardness of 30–80 Hs (JIS A rubber hardness) is preferable.

On the outer side (outer circumferential surface) of the ray-transmitting base member 171*a* in which the flange 930 is fitted, there are formed resilient layer 171*d*, ray absorbing layer 171*b* and releasing layer 171*c* in this order in a way that they cover the outer circumferential surface of combination section 933 with ray-transmitting base member 171*a* of the flange 930.

In the same way as in the description in FIG. 16, the second ray irradiating roller 17*b* representing a rotary member for fixing is driven to rotate.

Due to the foregoing, by providing a joining elastic layer having elasticity on the joining section, deformation and pressure applied directly to a ray-transmitting base member of a rotary member for fixing are reduced, separation and damage of the edge portion of the ray-transmitting base member are prevented, and the ray-transmitting base member can be centered accurately. Further, by providing a joining elastic layer, torque and pressure applied to the ray-transmitting base member of a rotary member for fixing from the driving system are lightened not to be applied directly to the ray-transmitting base member, thus, damage of the ray-transmitting base member and separation of the flange member both caused when the rotary member for fixing is driven can be prevented. In particular, by using a resin member for both of the ray-transmitting base member and flange member, they are mostly the same in terms of thermal expansion, thus, deformation and pressure caused by the flange member are not applied to the edge portion of the rotary member for fixing, and damage on the edge portion of the ray-transmitting base member and separation from the flange member are prevented. Further, the rotary member for fixing whose axis of rotation is a flange member attached on the ray-transmitting base member through the joining elastic layer can be centered accurately, and creases on the transfer material in the course of fixing can be prevented.

Referring to FIG. 19–FIG. 23(*c*), there will be explained a fixing apparatus for two-sided fixing employing a roll-shaped rotary member for fixing for instant heating stated in FIG. 12 or in FIG. 5. FIG. 19 is a diagram showing the third example of the fixing apparatus for two-sided fixing wherein a roll-shaped rotary member for fixing for instant heating in the first example and a roll-shaped rotary member for fixing for instant heating in the second example are used as a pair, while, FIG. 20 is a diagram showing the fourth example of the fixing apparatus for two-sided fixing wherein roll-shaped rotary members for fixing for instant heating in the second example are used as a pair. Each of FIGS. 21(*a*), 21(*b*) and 21(*c*) is a temperature-control timing chart for two-sided image forming wherein a fixing apparatus in the third or fourth example is used, each of FIGS. 22(*a*), 22(*b*) and 22(*c*) is a temperature-control timing chart for single-sided image forming for the face side wherein a fixing apparatus in the third or fourth example is used, and each of FIGS. 23(*a*), 23(*b*) and 23(*c*) is a temperature-control timing chart for single-sided image forming for the reverse side wherein a fixing apparatus in the third or fourth example is used.

As shown in FIG. 19, fixing apparatus 17B representing the third example as an example of a fixing apparatus employing a roll-shaped rotary member for fixing for two-sided fixing and instant heating is composed of first ray irradiating roller 17*a* (the first example of a roll-shaped rotary member for fixing for instant heating) which is the same as one explained in FIG. 5 as a roll-shaped rotary member for fixing on the upper side (face side) which fixes toner images of a face side image (image on the upper side) and second ray irradiating roller 17*b* (the second example of a roll-shaped rotary member for fixing for instant heating) which is the same as one explained in FIG. 12 as a roll-shaped rotary member for fixing on the lower side (reverse side) which fixes toner images of a reverse side image (image on the lower side), and recording sheet P is nipped by nipping section T having a width of about 2–10 mm formed between the upper and lower rotary members for fixing to be given heat and pressure so that toner images on the recording sheet P are fixed.

The first ray irradiating roller 17*a* used as an upper rotary member for fixing for fixing toner images of a face side image is structured as a hard roller having therein cylindrical ray-transmitting base member 171*a* which is provided on its outer side (outer circumferential surface) with ray absorbing layer 171*b* and releasing layer 171*c* in this order and is provided therein with ray irradiating member 171*g* representing a ray irradiating device employing, for example, a halogen lamp or a xenon lamp emitting mainly rays such as infrared radiation or far infrared radiation. Rays emitted from the ray irradiating member 171*g* are absorbed by the ray absorbing layer 171*b*, and thereby, a roll-shaped rotary member for fixing capable of heating instantly is formed (first example of a roll-shaped rotary member for fixing for instant heating). The roll-shaped rotary member for fixing for instant heating employing the combination layer 171B stated above is also used as an upper rotary member for fixing. On the first ray irradiating roller 17*a* representing a roll-shaped rotary member for fixing provided on the upper side, there are provided, in the direction of rotation of the first ray irradiating roller 17*a* from the position of nipping section T, fixing separation claw TR6, fixing oil cleaning blade TR1, oil coating felt TR2 and oil quantity regulating blade TR3, and oil supplied to the oil coating felt TR2 from oil tank TR4 through capillary pipe TR5 is coated on the first ray irradiating roller 17*a* by the oil coating felt TR2. Oil on the circumferential surface of the first ray irradiating roller 17*a* is removed by the fixing oil cleaning blade TR1. Therefore, temperature sensor TS1 which measures temperature of the first ray irradiating roller 17*a* described afterwards is provided on the cleaned circumferential surface of the first ray irradiating roller 17*a* located between the fixing oil cleaning blade TR1 and the oil coating felt TR2. The transfer material after fixing is separated by fixing separation claw TR6.

The second ray irradiating roller 17*b* used as a lower rotary member for fixing which fixes toner images of a reverse side image is structured as a soft roller having cylindrical ray-transmitting base member 171*a* wherein resilient layer 171*d*, ray absorbing layer 171*b* and releasing layer 171*c* are provided in this order on the outer side (outer circumferential surface) of the ray-transmitting base member 171*a*, and ray irradiating member 171*g* representing a ray irradiating device employing, for example, a halogen lamp or a xenon lamp emitting mainly infrared radiation or far infrared radiation is provided inside the ray-transmitting base member 171*a*. Thus, there is formed a rotary member for fixing wherein rays emitted from the ray irradiating member 171*g* are absorbed by the ray absorbing layer 171*b* and thereby instant heating is made possible (second example of the rotary member for fixing for instant heating use). The roll-shaped rotary member for fixing for instant heating employing the combination layer 171B stated above is also used as an upper rotary member for fixing.

Between the rotary member for fixing of the upper hard roller and the rotary member for fixing of the lower soft roller, there is formed nipping section T whose lower side is convex in where toner images are fixed.

TS1 represents a temperature sensor which is mounted on the first ray irradiating roller 17*a* on the upper side and employs, for example, a thermistor for controlling temperature, while TS2 represents a temperature sensor which is mounted on the second ray irradiating roller 17*b* on the lower side and employs, for example, a thermistor for controlling temperature.

In the fixing apparatus 17C representing the fourth example as another example of a fixing apparatus employing a roll-shaped rotary member for fixing for two-sided fixing and for instant heating, the second ray irradiating roller 17*b* (second example of a roll-shaped rotary member for fixing for instant heating) which is the same as that explained in FIG. 12 is used to constitute the upper (face side) roll-shaped rotary member for fixing which fixes toner images of a face side image (image on the upper side) and the lower (reverse side) roll-shaped rotary member for fixing which fixes toner images of a reverse side image (image on the lower side), as shown in FIG. 20, and recording sheet P is nipped by nipping section T having a width of about 2–10 mm formed between the upper and lower rotary members for fixing to be given heat and pressure so that toner images on the recording sheet P are fixed.

The second ray irradiating roller 17*b* used as an upper rotary member for fixing for fixing toner images of a face side image or as a lower rotary member for fixing for fixing toner images of a reverse side image is structured as a soft roller having therein cylindrical ray-transmitting base member 171*a* which is provided on its outer side (outer circumferential surface) with resilient layer 171*d,* ray absorbing layer 171*b* and releasing layer 171*c* in this order, and is provided therein ray irradiating member 171*g* representing a ray irradiating device employing, for example, a halogen lamp or a xenon lamp emitting mainly rays such as infrared radiation or far infrared radiation. Rays emitted from the ray irradiating member 171*g* are absorbed by the ray absorbing layer 171*b,* and thereby, a roll-shaped rotary member for fixing capable of heating instantly is formed (second example of a roll-shaped rotary member for fixing for instant heating). The roll-shaped rotary member for fixing for instant heating employing the combination layer 171B stated above is also used as an upper or a lower rotary member for fixing. Between upper and lower soft roller rotary members for fixing, there is formed flat nipping section T where toner images are fixed. On the second ray irradiating roller 17*b* representing a roll-shaped rotary member for fixing provided on the upper side, there are provided, in the direction of rotation of the second ray irradiating roller 17*b* from the position of nipping section T, fixing separation claw TR6, fixing oil cleaning blade TR1, oil coating felt TR2 and oil quantity regulating blade TR3, and oil supplied to the oil coating felt TR2 from oil tank TR4 through capillary pipe TR5 is coated on the second ray irradiating roller 17*b* by the oil coating felt TR2. Oil on the circumferential surface of the second ray irradiating roller 17*b* is removed by the fixing oil cleaning blade TR1. Therefore, temperature sensor TS1 which measures temperature of the second ray irradiating roller 17*b* described afterwards is provided on the cleaned circumferential surface of the second ray irradiating roller 17*b* located between the fixing oil cleaning blade TR1 and the oil coating felt TR2. The transfer material after fixing is separated by fixing separation claw TR6.

TS1 represents a temperature sensor which is mounted on the second ray irradiating roller 17*b* on the upper side and employs, for example, a thermistor for controlling temperature, while TS2 represents a temperature sensor which is mounted on the second fixing roller 17*b* on the lower side and employs, for example, a thermistor for controlling temperature.

Fixing temperature control which is conducted when fixing apparatus 17B in FIG. 19 or fixing apparatus 17C in FIG. 20 is applied to an image forming apparatus for two-sided image forming in FIG. 1 will be explained as follows.

As shown in FIGS. 21(*a*), 21(*b*) and 21(*c*), with regard to conveyance timing for recording sheet P which passes through fixing apparatus 17B or fixing apparatus 17C responding to image forming for the face side and reverse side conducted by photoreceptor drum 10, in the case of two-sided image forming, the recording sheet P is conveyed intermittently every other sheet, which is different from continuous printing for single-sided image forming of the face side. While, for the upper roll-shaped rotary member for fixing which fixes toner images of a face side image (first ray irradiating roller 17*a* in the case of fixing apparatus 17B, and second ray irradiating roller 17*b* in the case of fixing apparatus 17C), ray irradiating member 171*g* representing an upper ray irradiating device is turned on to be heated, in synchronization with passage timing of the recording sheet P, and thereby, the temperature of the upper rotary member for fixing is controlled so that fixing temperature set value T for non-image-forming and appropriate fixing temperature set value T1 for image forming may be taken alternately.

In the same way as in the foregoing, for the lower roll-shaped rotary member for fixing which fixes toner images of a reverse side image (second ray irradiating roller 17*b* for both fixing apparatus 17B and fixing apparatus 17C), ray irradiating member 171*g* representing an upper ray irradiating device is turned on to be heated, in synchronization with passage timing of the recording sheet P, and thereby, the temperature of the lower rotary member for fixing is controlled so that fixing temperature set value T for non-image forming and appropriate fixing temperature set value T2 for image forming may be taken alternately. In that case, two-sided image forming is conducted every other sheet, and non-passing time for recording sheet P is long accordingly. Therefore, it is possible to control temperature and to uniformalize temperature, and it is further possible to conduct fixing for two-sided images with upper and lower rotary members for fixing for instant heating each having small heat capacity.

Temperature control is conducted by a control section through a comparison circuit where fixing temperature set values T, T1 and T2 stored in ROM in advance are compared with values detected by temperature sensors TS1 and TS2 (see FIG. 4).

In FIGS. 21(*a*), 21(*b*) and 21(*c*), temperature control for the upper and lower rotary members for fixing is conducted in the area where both leading edge and trailing edge of recording sheet P are sandwiched in synchronization with passage timing of the recording sheet P, and when a linear speed is high, it is necessary to establish the temperature control timing to be earlier, or further to set temperature to be fixing temperature set values T1 and T2 constantly during printing operations.

As shown in FIGS. 22(*a*), 22(*b*) and 22(*c*), with regard to conveyance timing for recording sheet P which passes through fixing apparatus 17B or fixing apparatus 17C responding to image forming for the face side conducted by photoreceptor drum 10, in the case of single-sided image forming for the face side, the recording sheet P is conveyed continuously in response to continuous image forming for the face side by photoreceptor drum 10, which is different from continuous printing in two-sided image forming and single-sided image forming for the reverse side. While, for the upper roll-shaped rotary member for fixing which fixes toner images of a face side image (first ray irradiating roller 17*a* in the case of fixing apparatus 17B, and second ray irradiating roller 17*b* in the case of fixing apparatus 17C), ray irradiating member 171*g* representing an upper ray irradiating device is turned on to be heated, in synchronization with passage timing of the recording sheet P, and thereby, the temperature of the upper rotary member for fixing is controlled so that fixing temperature set value T for non-image forming and appropriate fixing temperature set value T1 for image forming may be taken alternately.

On the contrary, the lower roll-shaped rotary member for fixing (second ray irradiating roller 17*b* for both fixing apparatus 17B and fixing apparatus 17C) is left as it is without being subjected to heating control during copying in single-sided image forming for the face side, or, temperature control is conducted for the lower rotary member for fixing so that it is maintained at fixing temperature set value T for non-image-forming.

Temperature control is conducted by a control section through a comparison circuit where fixing temperature set values T and T1 stored in ROM in advance are compared with values detected by temperature sensors TS1 and TS2 (see FIG. 4).

In FIGS. 22(*a*), 22(*b*) and 22(*c*), temperature control for the upper rotary member for fixing is conducted in the area where both leading edge and trailing edge of recording sheet P are sandwiched in synchronization with passage timing of the recording sheet P, and when a linear speed is high, it is necessary to establish the temperature control timing to be earlier, or further to set temperature to be fixing temperature set value T1 constantly during printing operations.

As shown in FIGS. 23(*a*), 23(*b*) and 23(*c*), with regard to conveyance timing for recording sheet P which passes through fixing apparatus 17B or fixing apparatus 17C in response to image forming for the reverse side conducted by intermittent transfer belt 14*a,* in the case of single-sided image forming for the reverse side, the recording sheet P is conveyed intermittently every other sheet, which is different from continuous printing for single-sided image forming of the face side. While, for the lower roll-shaped rotary member for fixing which fixes toner images of a reverse side image (second ray irradiating roller 17*b* for both fixing apparatus 17B and fixing apparatus 17C), ray irradiating member 171*g* representing a lower ray irradiating device is turned on to be heated, in synchronization with passage timing of the recording sheet P, and thereby, the temperature of the lower rotary member for fixing is controlled so that fixing temperature set value T for non-image-forming and appropriate fixing temperature set value T2 for image forming may be taken alternately.

On the contrary, the upper roll-shaped rotary member for fixing (first ray irradiating roller 17*a* for fixing apparatus 17B and second ray irradiating roller 17*b* for fixing apparatus 17C) is left as it is without being subjected to heating control during copying in single-sided image forming for the reverse side, or, temperature control is conducted for the upper rotary member for fixing so that it is maintained at fixing temperature set value T for non-image-forming.

It is preferable that the upper rotary member for fixing is heated to be kept at appropriate fixing temperature. set value T1 in the course of image forming during the copying in single-sided image forming for the reverse side, with ray irradiating member 171*g* therein being turned on in synchronization with the passage timing of recording sheet P, as shown with one-dot chain lines in FIGS. 23(*a*), 23(*b*) and 23(*c*), and when the upper rotary member for fixing is turned on for heating, a tip portion of nipping section T is heated, which prevents that toner images are disturbed when the leading edge of recording sheet P is caught in the nipping section, and toner images of a single-sided image for the reverse side only can be fixed satisfactorily.

Temperature control is conducted by fixing temperature set values T, T2 and (T1) stored in ROM in advance and by detection by temperature sensors TS1 and TS2, through a comparison circuit and a control section.

In FIGS. 23(*a*), 23(*b*) and 23(*c*), temperature control for the lower rotary member for fixing and the upper rotary member for fixing is conducted in an area where the leading edge and the trailing edge of recording sheet P are nipped, in synchronization with the passage timing of the recording sheet P, and it is necessary to set the temperature control timing to be earlier when the linear speed is high, and further to set regular fixing temperature set values T2 and (T1) for printing operations.

In FIGS. 21(*a*) through 23(*c*), fixing can be conducted satisfactorily without preparing the warm-up time, because fixing of toner images in the case of single-sided image forming for the face side, single-sided image forming for the reverse side and of two-sided image forming is conducted by upper and lower roll-shaped rotary members for fixing for instant heating which have small heat capacity and can start quickly. In particular, heat capacity of the lower rotary member for fixing which has smaller heat capacity compared with a conventional heat fixing roller is sufficient for fixing of toner images on the reverse side, and fixing of a reverse side image can be conducted by the lower rotary member for fixing, because two-sided image forming and single-sided image forming for the reverse side only are conducted on alternate sheets.

Incidentally, the image forming apparatus can be set so that temperature control may be conducted automatically toward the state of two-sided image forming when the power supply switch is turned on for initial operation or when the pause mode is changed to the print operation mode, or the image forming apparatus can be controlled so that heating control for the upper and lower rotary members for fixing may be released when non-operation time exceeds a certain period of time.

Owing to the structure stated above, there are provided a fixing apparatus and an image forming apparatus in both of which energy consumption for each of single-sided image forming for the face side only, that for the reverse side only and two-sided image forming is different from others, less energy is consumed appropriately for each of single-sided image forming and two-sided image forming compared with a conventional fixing apparatus employing heating bodies for upper and lower rollers, a width of a nipping section in a fixing area is broad and high fixing efficiency can be obtained compared with a conventional fixing apparatus employing heating bodies for the upper and lower rollers and with a film fixing apparatus employing a ceramic heater, and two-sided fixing with low heat capacity and zero warm-up time can be carried out.

As stated above, by using fixing apparatus 17B explained in FIG. 19 or fixing apparatus 17C explained in FIG. 20, there can be realized a fixing apparatus which is resistant to deformation at a fixing section (nipping section) and is for quick start fixing by instant heating, and further, fusion of color toner which is difficult to fix by rays because of different spectral characteristics can be carried out satisfactorily by pressurization at the fixing section (nipping section) caused by elasticity of a rotary member for fixing and by heating by a ray absorbing layer of the rotary member for fixing, thus, fixing of color toner by instant heating or quick start fixing with a short heating time is made possible. By using the image forming apparatus explained in FIG. 2, in particular, fixing of toner images under quick start and instant heating in the case of fixing control for each of two-sided image forming, image forming for the face side and that for the reverse side is made to be possible, and an effect of energy conservation can be obtained. Fixing by instant heating or quick start fixing with a short heating time for toner images on a transfer material in the case of fixing control for each of two-sided image forming and single-sided image forming for the face side and reverse side is made to be possible, and further, fusion of superposed color toner images having a thick toner layer on a transfer material which is difficult to fix by rays because of different spectral characteristics can be carried out satisfactorily through fixing by pressurization at the soft fixing section (nipping section) caused by elasticity of a rotary member for fixing and by heating by a ray absorbing layer of the rotary member for fixing, thus, fixing by instant heating or quick start fixing with a short heating time each for color toner images is made possible.

Each of FIGS. 24 and 25 shows a tapered portion on a joining section between a flange member and a ray-transmitting base member, and FIG. 24 is a diagram showing an occasion where the ray-transmitting base member is inserted in the flange member, while FIG. 25 is a diagram showing an occasion where the flange member is inserted in the ray-transmitting base member. As shown in FIG. 24, when ray-transmitting base member 171*a* is inserted in flange 900 or 200 representing the flange member as explained in FIG. 9 or FIG. 16, it is preferable that a tapered portion (inclination) where an inside diameter of joining section 901 or 921 of flange 900 or 920 is made greater gradually until the inside diameter of a threshold of the joining section 901 or 921 is increased by 0.1–1 mm for the joining length 10–50 mm ,is provided in the joining section 901 or 921, and joining elastic layer S11 or S21 is formed between the joining section 901 or 921 and the ray-transmitting base member 171*a* by the use of rubber type filling agents having elasticity or adhesives. As shown in FIG. 25, when flange 900 or 200 representing the flange member is inserted in ray-transmitting base member 171*a* as explained in FIG. 11 or FIG. 18, it is preferable that a tapered portion (inclination) where an outside diameter of joining section 911 or 931 of flange 910 or 930 is made smaller gradually until the outside diameter of a threshold of the joining section 911 or 931 is reduced by 0.1–1 mm for the joining length 10–50 mm , is provided in the joining section 911 or 931, and joining elastic layer S12 or S22 is formed between the joining section 911 or 931 and the ray-transmitting base member 171*a* by the use of rubber type filling agents having elasticity or adhesives. Due to this, it is easy to fit the ray-transmitting base member in the flange member or to fit the flange member in the ray-transmitting base member, and the filling agents or adhesives are forced out toward the tip of the tapered portion where the clearance is greater. Therefore, excessive filling agents or adhesives do not stick to the joining end and air does not enter the filling agents or adhesives so that a joining elastic layer can surely be formed. Further, even when the flange member is inserted in the ray-transmitting base member for fitting with the tip of the flange member being deformed (when centering is not carried out accurately), stress caused by the deformation is absorbed by the joining elastic layer which is thicker because the tip portion having the greater deformation has a thicker joining elastic layer due to the tapered portion, and is away from the circumferential surface of the flange member, thus, the ray-transmitting base member is hardly split or broken (damaged).

In the invention, pressure which is directly applied on the ray-transmitting base member of the rotary member for fixing is decreased by the joining elastic layer, thereby, damage of an end portion of the ray-transmitting base member is prevented and the ray-transmitting base member can be centered accurately.

An embodiment attaining the second object of the invention will be explained as follows. Though an image writing means is arranged inside an image carrier in the following explanation, the one wherein an image writing means is arranged outside an image carrier is also included in the invention.

Referring to FIGS. 26–31, there will be explained an image forming process and each mechanism in an embodiment of a color image forming apparatus employing a fixing apparatus related to the invention. FIG. 26 is a sectional structure diagram showing an embodiment of a color image forming apparatus employing a fixing apparatus related to the invention, FIG. 27 is a side sectional view of an image carrier shown in FIG. 26, FIG. 28 is a sectional structure diagram of a fixing apparatus employing a roll-shaped rotary member for fixing, FIG. 29 is a side sectional view of a roll-shaped rotary member for fixing showing how a ray-transmitting base member and a flange member are put together, each of FIGS. 30(*a*) and 30(*b*) is a diagram showing grooves provided on a flange member and FIG. 31 is a diagram showing slits provided on a flange member.

In FIG. 26 or FIG. 27, photoreceptor drum 10 representing an image carrier is one wherein photoconductor layers such as a light transmitting conductive layer and an organic photoconductive layer (OPC) are formed on the outer circumferential surface of a cylindrical base body formed by a light-transmitting member such as, for example, glass or light-transmitting acrylic resin. The photoreceptor drum 10 is rotated by power from an unillustrated driving source in the clockwise direction shown with an arrow mark in FIG. 1, with the light-sensitive conductive layer being grounded. The photoreceptor drum 10 is sandwiched between front flange 10*a* and rear flange 10*b*, and the photoreceptor drum 10 is supported with the front flange 10*a* being pivoted on guide pin 10P1 provided on cover 503 attached on front side plate 501 of the apparatus main body and with the rear flange 10*b* being engaged with plural guide rollers 10R attached on rear side plate 502 of the apparatus main body to cover them. Gear 10G provided on the outer circumferential surface of the rear flange 10*b* is engaged with gear G1 for driving use, and its power rotates the photoreceptor drum 10 in the clockwise direction shown with an arrow mark in FIG. 26 with a transparent conductive layer being grounded.

In the invention, a photoconductor layer of the photoreceptor drum representing an image forming point for an exposure beam for image exposure use is only required to have a quantity of light for exposure having a wavelength capable of giving appropriate contrast to light decay characteristics (light carrier generation) of a photoconductor layer. Therefore, transmission factor of a ray-transmitting base member of a photoreceptor drum in the present embodiment does not need to be 100%, and characteristics wherein a certain quantity of light is absorbed when an exposure beam is transmitted are also acceptable, and in short, what is required is just to give appropriate contrast. As materials of the ray-transmitting base member, acrylic resins, especially the ones which are polymerized by using a methacrylic acid methyl ester monomer are excellent in terms of light-transmitting property, strength, accuracy and surface characteristics, and are used preferably. In addition to the foregoing, various light-transmitting resins such as acryl resins, fluorine containing resins, polyester, polycarbonate and polyethylene terephthalate which are used for general optical members can also be used. Light-transmitting resins may also be colored provided that they are light-transmittable for exposure light. As a light-transmitting conductive layer, there are used light-transmitting metallic thin layers which are made of indium tin oxide (ITO), tin oxide, lead oxide, indium oxide, copper iodide, Au, Ag, Ni and Al, and as a layer making method, there are used a vacuum evaporation method, an active reaction evaporation method, various sputtering methods, various CVD methods, a dip-coating method and a spray-coating method. As a photoconductor layer, various organic photoconductive layers (OPC) are used.

An organic photoconductive layer representing a photoconductive photoconductor layer is made to be a two-layer type photoconductor layer which is separated in terms of function to a charge generating layer (CGL) with the main components of charge generating materials (CGM) and to a charge transport layer (CTL) with the main components of charge transport materials (CTM). The organic photoconductive layer of a two-layer structure has high durability as an organic photoconductive layer because of a thick CTL, and is suitable for the invention. Incidentally, the organic photoconductive layer can also be made to be of a single-layer structure wherein charge generating materials (CGM) and charge transport materials (CTM) are contained in one layer, and binder resins are usually contained in the photoconductor layer of the single-layer structure or the two-layer structure.

The scorotron charger 11 representing a charging means which will be explained below, the exposure optical system 12 representing an image writing means and the developing unit 13 representing a developing means are used for an image forming process for each color of yellow (Y), magenta (M), cyan (C) and black (K) respectively, and they are arranged in the order of Y, M, C and K in the direction of rotation of photoreceptor drum 10 shown with an arrow mark in FIG. 26.

Scorotron charging unit 11 serving as a charging means is mounted to face and to be closed to photoreceptor drum 10 in the direction perpendicular to the moving direction of the photoreceptor drum 10 representing an image carrier (direction perpendicular to the paper in FIG. 26), and conducts charging operations (negative charging in the present embodiment) through a control grid (having no symbol) which is held to a prescribed voltage to the organic photoconductor layer stated above and through corona discharge having the same polarity as in toner by using, for example, a serrated electrode as corona discharge electrode 11*a*, thus, it gives uniform voltage to the photoreceptor drum 10. As the corona discharge electrode 11*a*, a wire electrode and a needle electrode other than the foregoing may also be used.

Exposure optical system 12 for each color is structured as an exposure unit wherein a linear exposure element (not shown) in which plural LEDs (light emitting diode) representing a light emitting element for exposure light are arranged to be in parallel with an axis of the photoreceptor drum 10 and a SELFOC lens (not shown) representing a full size image forming element are mounted on a holder. Exposure optical system 12 for each color is mounted on cylindrical holding member 20 which is fixed with guide pin 10P2 provided on rear side plate 502 of the apparatus main body and with guide pin 10 P1 provided on cover 503 attached on front side plate 501 both serving as a guide, and the cylindrical holding member 20 is housed inside the base body of the photoreceptor drum 10. Exposure elements which can be used in addition to the foregoing include linear ones wherein plural light emitting elements such as FL (phosphor luminescence), EL (electro-luminescence) and PL (plasma discharge luminescence) are arranged in a form of an array.

Exposure optical system 12 representing an image writing means for each color is arranged inside the photoreceptor drum 10 in a way that the exposure position on the photoreceptor drum 10 is made to be between scorotron charging unit 11 and developing unit 13 and to be at the upstream side of the developing unit 13 in the direction of rotation of the photoreceptor drum 10.

The exposure optical system 12 conducts imagewise exposure on the photoreceptor drum 10 charged uniformly after the image processing based on image data for each color transmitted from a separate computer (not shown) and stored in a memory, and thereby forms a latent image on the photoreceptor drum 10. With regard to a wavelength of light emitted from the light emitting element used in the present embodiment, those in a range of 80–900 nm which usually are highly transmittable for toner of Y, M and C are preferable, but those which are shorter than the foregoing which are not transmittable sufficiently for color toner may also be used because imagewise exposure is conducted from the reverse side.

Developing unit 13 representing a developing means for each color contains therein two-component (single-component is also acceptable) developing agents for yellow (Y), magenta (M), cyan (C) or black (K), and is provided with developing sleeve 131 representing a developing agent carrier formed by a non-magnetic stainless steel or aluminum cylinder having a wall thickness of 0.5–1 mm and an outside diameter of 15–25 mm.

In the developing area, the developing sleeve 131 is kept by a stopper roll (not shown) to be away from the photoreceptor drum 10 by a clearance of a prescribed value, for example, of 100–1000 $\mu$m, on a non-contact basis, and is rotated in the forward direction for rotation of the photoreceptor drum 10. When the developing sleeve 131 is impressed with DC voltage having the same polarity as of toner (negative polarity in the present embodiment) or with voltage in which AC voltage is superposed on DC voltage, as developing bias voltage, reversal development on a non-contact basis is conducted on an exposure section on the photoreceptor drum 10. In this case, accuracy of about 20 $\mu$m or less for clearance for developing is necessary for preventing uneven developing.

As stated above, the developing unit 13 conducts, on a non-contact basis, reversal development for an electrostatic latent image on the photoreceptor drum 10 formed through charging by scorotron charging unit 11 and through imagewise exposure by exposure optical system 12, with toner having the same polarity as that for charging (the photoreceptor drum is negatively charged in the present embodiment, and toner has negative polarity accordingly).

When an unillustrated photoreceptor driving motor is started at the start of image forming, gear 10G provided on rear flange 10*b* of the photoreceptor drum 10 is rotated through gear G1 for driving, and thereby the photoreceptor drum 10 is rotated in the clockwise direction shown with an arrow mark in FIG. 1, and simultaneously with this, scorotron charging unit 11 for Y starts giving voltage to the photoreceptor drum 10 through charging operations. After the voltage is given to the photoreceptor drum 10, exposure by electric signals corresponding to signals of the first color, namely, to image data for Y is started in exposure optical system 12 for Y, and an electrostatic latent image corresponding to the image for yellow (Y) in images in an original is formed on the photosensitive layer on the surface of the drum through its rotation scanning. This latent image is subjected by developing unit 13 for Y to reversal development on a non-contact basis, thus, a toner image for yellow (Y) is formed on the photoreceptor drum 10.

After that, voltage is given to the photoreceptor drum 10 including the toner image for yellow (Y) by charging operations of scorotron charging unit 11 for M, then exposure by electric signals corresponding to signals of the second color, namely, to image data for magenta (M) is conducted by exposure optical system 12 for M, and a toner image for magenta (M) is formed to be superposed on the toner image for yellow (Y) through non-contact reversal development conducted by developing unit 13 for M.

In the same process, a toner image for cyan (C) corresponding to signals for the third color is formed to be superposed by scorotron charging unit 11 for C, exposure optical system 12 and developing unit 13, and further, a toner image for black (K) corresponding to signals for the fourth color is formed to be superposed by scorotron charging unit 11 for K, exposure optical system 12 and developing unit 13, thus, a color toner image is formed on the circumferential surface of the photoreceptor drum 10 within its one rotation.

As explained above, exposures on the organic photosensitive layer on the photoreceptor drum 10 conducted by exposure optical systems 12 for Y, M, C and K are performed from the inside portion of the photoreceptor drum 10 through a ray-transmitting base member in the present embodiment. Therefore, it is possible to form an electrostatic latent image with exposure for each of images corresponding to signals for the second, third and fourth colors which is not interrupted by the toner image formed in the preceding step, which is preferable. However, exposure may also be performed from the outside of the photoreceptor drum 10.

On the other hand, recording sheet P representing a transfer material is fed out of sheet-feeding cassette 15 representing a transfer material housing means by a feed-out roller (having no symbol), and is fed by a feeding roller (having no symbol) to be transported to timing roller 16.

The recording sheet P is synchronized by timing roller 16) with the color toner image which is carried on the photoreceptor drum 10 and is transported to the transfer area while being attracted to conveyance belt 14*a* by charging of sheet charging unit 150 representing a sheet charging means. With regard to the recording sheet P transported while being brought into close contact with the conveyance belt 14*a,* color toner images on the circumferential surface of the photoreceptor drum 10 are collectively transferred onto the recording sheet P, in the transfer area, by transfer unit 14*c* representing a transfer means on which voltage having polarity opposite to that of toner (positive polarity in the present embodiment) is impressed.

The recording sheet P on which color toner images have been transferred is neutralized by sheet separation AC neutralizing unit 14*h* representing a transfer material separating means, and is separated from the conveyance belt 14*a* to be conveyed to fixing unit 17.

The fixing unit 17 is composed of ray irradiating roller 17*a* representing an upper roll-shaped rotary member for fixing color toner images and of fixing roller 47*a* representing a lower roll-shaped rotary member for fixing, and there is provided inside the ray irradiating roller 17*a* halogen lamp 171*g* representing a ray irradiating device having therein ray filament F1 representing a ray source which mainly irradiates rays such as infrared radiation or far infrared radiation.

Recording sheet P is nipped at nipping section N formed between ray irradiating roller 17*a* and fixing roller 47*a,* and when heat and pressure are applied on the recording sheet P, color toner images thereon are fixed, and the recording sheet P is conveyed by sheet ejecting roller 18 to be ejected on a tray which is located on the upper part of the apparatus.

Toner remaining on the circumferential surface of the photoreceptor drum 10 after the transfer is removed by cleaning blade 19*a* which is provided on cleaning unit 19 representing an image carrier cleaning means. The photoreceptor drum 10 from which the remaining toner has been removed is charged uniformly by scorotron charging unit 11 to enter the following image forming cycle.

As shown in FIG. 28, fixing apparatus 17 is composed of ray irradiating roller 17*a* representing an upper and elastic roll-shaped rotary member for fixing toner images on the transfer material and of fixing roller 47*a* representing a lower roll-shaped rotary member for fixing. Recording sheet P is nipped at nipping section N having a width of about 2–10 mm which is formed between the elastic ray irradiating roller 17*a* and fixing roller 47*a,* and when heat and pressure are applied on the recording sheet P, toner images thereon are fixed. On the ray irradiating roller 17*a* representing a roll-shaped rotary member for fixing provided on the upper side, there are provided, in the direction of rotation of the ray irradiating roller 17*a* from the position of nipping section T, fixing separation claw TR6, fixing oil cleaning blade TR1, oil coating felt TR2 and oil quantity regulating blade TR3, and oil supplied to the oil coating felt TR2 from oil tank TR4 through capillary pipe TR5 is coated on the ray irradiating roller 17*a* by the oil coating felt TR2. Oil on the circumferential surface of the ray irradiating roller 17*a* is removed by the fixing oil cleaning blade TR1. Therefore, heat uniforming roller TR7 and temperature sensor TS1 which measures temperature of the ray irradiating roller 17*a* which will be described later are provided on the cleaned circumferential surface of the ray irradiating roller 17*a* that is located between fixing oil cleaning roller TR1 and oil coating felt TR2. The transfer material after the fixing is separated by fixing separation claw TR6. By providing heat uniforming roller TR7 using a metal roller member made of aluminum or stainless steel having high heat conductivity, distribution of temperature by generated heat on the circumferential surface of the ray irradiating roller 17*a* heated by ray absorbing layer 171*b* is uniformed. Therefore, the temperature sensor TR1 may be positioned at any place between fixing oil cleaning roller TR1 and oil coating felt TR2, but is preferable that the temperature sensor TS1 is arranged at the downstream side of the heat uniforming roller TR7, because it measures temperature on the surface of the ray irradiating roller 17*a* which is uniformed by heat uniforming roller TR7.

The ray irradiating roller 17*a* representing a rotary member for fixing which fixes toner images on the transfer material is structured as a soft roller which is composed of cylindrical ray-transmitting base member 171*a* and of elastic layer 171*d,* ray absorbing layer 171*b* and releasing layer 171*c* which are provided in this order outside (on the circumferential surface) the ray-transmitting base member 171*a.* Inside the ray-transmitting base member 171*a,* there is provided halogen lamp 171*g* representing a ray irradiating device having therein ray filament F1 representing a ray source which mainly emits rays such as infrared radiation or far infrared radiation. The ray irradiating roller 17*a* representing a rotary member for fixing is structured as a soft roller which is highly elastic due to elastic layer 171*d* (which will be described later) provided on the ray irradiating roller 17*a.* Rays emitted from the halogen lamp 171*g* are absorbed by ray absorbing layer 171*b,* thus, a roll-shaped rotary member for fixing which can heat instantly is formed.

The fixing roller 47*a* representing a lower roll-shaped rotary member for fixing is structured as a soft roller wherein cylindrical metal pipe 471*a* employing, for example, aluminum material, iron material or steel material (heat conductivity is $(0.15–0.76)\times10^{-3}$ J/cm·s·K, and coefficient of linear expansion is $(10–30)\times10^{-6}$/° C.) is formed, and rubber roller 471*b* composed of a thin rubber layer having a thickness of 1–3 mm employing silicone material is formed on the outer circumferential surface of the metal pipe 471*a.* Due to this, s role of heat uniforming roller TR7 can also be played. Halogen heater 471*c* having herein filament F2 representing a heat generating source may also be provided inside the metal pipe 471*a.*

Between the upper soft roller and the lower soft roller, there is formed flat nipping section N where toner images are fixed.

TS1 is a temperature sensor for controlling temperature provided on the upper ray irradiating roller 17*a,* while TS2 is a temperature sensor for controlling temperature provided on the lower fixing roller 47*a.* As temperature sensors TS1 and TS2, those of a contact type which touch the surface of the ray irradiating roller 17*a* or the fixing roller 47*a* or those of a non-contact type which are provided to be away slightly from the surface of the ray irradiating roller 17*a* or the fixing roller 47*a* are used.

Further, in FIGS. 13(*a*), 13(*b*) and 13(*c*), it is also possible to structure the upper rotary member for fixing representing a soft roller, by providing a heat-transmitting layer (not shown) on the upper side (on the face side) of ray absorbing layer 171*b* and on the lower side (on the reverse side) of releasing layer 171*c*. As a heat-transmitting layer, those having a layer thickness of 10–1000 μm, preferably of 50–500 μm and of a binder type wherein fine particles of highly heat-conductive metal such as titanium, alumina, zinc, magnesium, chromium, nickel, tantalum, and molybdenum are dispersed in resin binders, or those of a solid type and of a layer structure type wherein highly heat-conductive metal such as, for example, chromium, nickel, tantalum or molybdenum is plated, sputtered or evaporated to form a layer, and heat-conductivity is $50\times10_{-3}$ J/cm·s·K, preferably $100\times10^{-3}$ J/cm·s·K. When the thickness of the heat-conductive layer is less than 10 μm, the layer thickness is too thin, resulting in insufficient heat capacity, and heat from ray absorbing layer 171*b* can not be transmitted sufficiently in the lateral direction, and thereby heat in the lateral direction can not be made uniform. When the thickness exceeds 1000 μm to be too thick, heat capacity is too great, resulting in a longer warm-up time, and instant heating is difficult. By providing a heat-transmitting layer, heat is transmitted immediately from the heat absorbing layer to the heat-transmitting layer, and temperature distribution in the longitudinal direction ((lateral direction), direction which is in parallel with a central axis of a cylindrical ray-transmitting base member) of a ray absorbing layer can be made uniform by heat transmission in the lateral direction in the heat-transmitting layer.

In the foregoing, it is also possible to mix fine particles of highly heat-conductive metal such as titanium, alumina, zinc, magnesium, chromium, nickel, tantalum or molybdenum in the ray absorbing layer by dispersing them and thereby to form a ray absorbing layer wherein the heat-transmitting layer and the ray absorbing layer are solidly integrated, thus, heat transmission in the lateral direction in the ray absorbing layer is improved in the same way as in the aforesaid effect, and temperature distribution in the longitudinal direction ((lateral direction), direction which is in parallel with a central axis of a cylindrical ray-transmitting base member) of a ray absorbing layer can be made uniform.

As stated above, by using fixing apparatus 17 explained in FIG. 28, fusion of color toner which is difficult to fix with heat waves because of different spectral characteristic can be conducted satisfactorily by pressurization at the fixing section (nipping section) caused by elasticity of the rotary member for fixing and by heating caused by the ray absorbing layer of the rotary member for fixing, and thereby instant heating fixing for color toner having functions of a soft roller, or quick start fixing requiring shorter heating time can be made possible. By using in the image forming apparatus explained in FIG. 26, in particular, fusion of superposed color toner images with a thick toner layer on the transfer material which is difficult to fix with heat waves because of different spectral characteristic can be conducted satisfactorily by pressurization at the fixing section (nipping section) caused by elasticity of the rotary member for fixing and by heating caused by the ray absorbing layer of the rotary member for fixing, and thereby instant heating fixing for color toner images having functions of a soft roller, or quick start fixing requiring shorter heating time can be made possible.

In FIGS. 29–31, as the cylindrical ray-transmitting base member 171*a* of the ray irradiating roller 17*a* representing a rotary member for fixing which fixes toner images of a face side image as stated above, there are used ceramic materials with a wall thickness of about 2–10 mm (coefficient of linear expansion is $(0.4–8)\times10^{-6}$/° C., thermal conductivity is $(5.5–19.0)\times10_{-3}$ J/cm·s·k) transmitting rays such as infrared radiation or far infrared radiation irradiated from halogen lamp 171*g,* mainly of Pyrex glass, sapphire ($Al_2O_3$) and $CaF_2$ and under the state of being centered at the inner end portion of the cylindrical ray-transmitting base member 171*a* of the ray irradiating roller 17*a,* flange 910 representing a cylindrical flange member which is made of metal member (coefficient of linear expansion is $(10–30)\times10^{-6}$/° C. and thermal conductivity is $(0.15–0.76)\times10_{-3}$ J/cm·s·k, t) such as, mainly, aluminum or stainless steel and has a wall thickness of about 1–3 mm is fitted for a width of about 10–50 mm, then, joining elastic layer ST representing an elastic member employing, for example, filling agents or adhesives of a type of heat-resistant silicone or a type of elastic rubber of urethane type, is formed in the clearance of about 0.5–2.0 mm formed between the inside (inner circumferential surface) of the ray-transmitting base member 171*a* and the outside (outer circumferential surface) of fitting section 911 of the flange 910, and the flange 910 is joined to the inner end portion of the cylindrical ray-transmitting base member 171*a* through the joining elastic layer ST. With regard to hardness of the joining elastic layer ST, it is preferable that it is joined with flange 910 with appropriate hardness for the necessity to absorb stress of the ray-transmitting base member 171*a* and flange 910 and to minimize an amount of deformation, and hardness of 30–80 Hs (JIS A rubber hardness) is preferable.

On the outer side (outer circumferential surface) of the ray-transmitting base member 171*a* in which the flange 910 is fitted, there are formed elastic layer 171*d,* ray absorbing layer 171*b* and releasing layer 171*c* in this order in a way that they cover also an outer circumferential surface of fitting section 913 between the flange 910 and the ray-transmitting base member 171*a,* and thus, a rotary member for fixing is formed. Bearing portion 912 of flange 910 is fitted in metal bearing B1 representing a bearing member which is fitted in ray irradiating roller holder HL made of a metal member, and ray irradiating roller 17*a* is fixed on the ray irradiating roller holder HL. Halogen lamp 171*g* is inserted inside the ray irradiating roller 17*a* to be held at the center position of the ray irradiating roller 17*a* by terminals JT on both ends. A radiation area of heat wave filament F1 representing a ray source of halogen lamp 171*g* in the ray irradiating roller 17*a* is mostly the same as that of filament F2 representing a heat source of halogen heater 471*c* in the fixing roller 47*a* described in FIG. 28, and it is provided to be of a width outside a passing area for the transfer material size (maximum transfer material size) inside fitting section 911 of flange 910. Although temperature rise at flange 910 caused by heat conduction is reduced by making the radiation area of the heat wave filament F1 to be inside the fitting section 911 of flange 910 or by using the ray irradiating roller holder HL made of a metal member and bearing B1, the flange 910 is subjected to heat expansion by heating, and an end portion tends to be cracked.

Therefore, for releasing pressure applied on flange 910 which is fitted in ray-transmitting base member 171*a,* there are formed longitudinal grooves (in the direction parallel with a center axis of the cylinder), for example, V-grooves VM each having a width of 5–20 mm and a depth of 1–5 mm on the outer side (outer circumferential surface) of cylindrical fitting section 911 on the flange 910, as shown in FIG. 30(*a*). Or, there are formed lateral grooves (in the direction perpendicular to a center axis of the cylinder), for example, V-grooves VM each having a width of 5–20 mm and a depth of 1–5 mm on the outer side (outer circumferential surface) of cylindrical fitting section 911 on the flange 910, as shown in FIG. 30(*b*). The V-groove VM representing a groove is formed to cover up to the root of the fitting section 911. The fitting section 911 on which V-grooves VM are formed is joined with an end portion of the ray-transmitting base member 171*a* through the joining elastic layer ST representing an elastic member.

Owing to the structure stated above, heat expansion of a flange member is absorbed by an elastic member, a contact surface between the flange member and the ray-transmitting base member is made to be smaller by the flange member on which grooves are provided, and there is formed a space which allows deformation of the elastic member which is depressed by the flange member in the case of thermal expansion of the flange member. Thus, there is made possible a fixing apparatus for quick start fixing with capability of instant heating wherein breakage of the ray-transmitting base member from its end portion caused by thermal expansion of the flange member can be prevented. In particular, the grooves formed to cover up to the root of the fitting section of the flange member enhance the aforesaid effect and prevent further breakage of the ray-transmitting base member on its end portion.

Further, longitudinal (in the direction parallel with a center axis of the cylinder) slits SL are provided on the outer side (outer circumferential surface) of the cylindrical fitting section 911 of flange 910, as shown in FIG. 31. The slit SL is made to have a width of 5–20 mm and is provided to cover up to the root of the fitting section 911. The fitting section 911 on which slits SL are formed is joined with an end portion of the ray-transmitting base member 171*a* through joining elastic layer ST representing an elastic member.

It is also possible to obtain further effect by employing the structure wherein grooves in FIGS. 30(*a*) and 30(*b*) and slits in FIG. 31 are combined.

Owing to the structure stated above, heat expansion of a flange member is absorbed by an elastic member, a contact surface between the flange member and the ray-transmitting base member is made to be smaller by the flange member on which slits are provided, there is formed a space which allows deformation of the elastic member which is depressed by the flange member in the case of thermal expansion of the flange member, and the flange member is deformed toward the inside thereof by the slits provided on the fitting section and thereby the pressure is reduced. Thus, there is made possible a fixing apparatus for quick start fixing with capability of instant heating wherein breakage of the ray-transmitting base member from its end portion caused by thermal expansion of the flange member can be prevented. The slits formed to cover up to the root of the fitting section of the flange member enhance the aforesaid effect and prevent further breakage of the ray-transmitting base member on its end portion. Further, these grooves and slits in FIGS. 30(*a*) and 30(*b*) and FIG. 31 have an effect that they serve as a buffer space even when the flange member is joined through the elastic member.

Another example of joining the flange member with the ray-transmitting base member will be explained below, referring to FIGS. 32A and 32B. FIG. 32A is a diagram showing another example of joining a flange member with a ray-transmitting base member, FIG. 32B shows a partially enlarged view of FIG. 32A.

In FIGS. 29–31, as the cylindrical ray-transmitting base member 171*a* of the ray irradiating roller 17*a* representing a rotary member for fixing which fixes toner images of a face side image as stated above, there are used ceramic materials with a wall thickness of about 2–10 mm (coefficient of linear expansion is $(0.4–8)\times10^{-6}/°$ C., thermal conductivity is $(5.5–19.0)\times10^{-3}$ J/cm·s·k) transmitting rays such as infrared radiation or far infrared radiation emitted from halogen lamp 171*g,* mainly of Pyrex glass, sapphire ($Al_2O_3$) and $CaF_2$ and under the state of being centered at the inner end portion of the cylindrical ray-transmitting base member 171*a* of the ray irradiating roller 17*a,* flange 910 representing a cylindrical flange member which is made of metal member (coefficient of linear expansion is $(10–30)\times10^{-6}/°$ C.) such as, mainly, aluminum or stainless steel and has a wall thickness of about 1–3 mm is fitted for a width of about 10–50 mm, ring-shaped groove 911*a* having a depth of 0.5–2.0 mm which establishes a clearance from an inner wall surface of the ray-transmitting base member 171*a* to be wider is formed on the fitting end portion at the root of fitting section 911 between flange 910 and ray-transmitting base member 171*a,* then, joining elastic layer ST representing an elastic member employing, for example, filling agents or adhesives of a type of heat-resistant silicone or a type of elastic rubber of urethane type, is formed in the clearance of about 0.5–2.0 mm formed between the inside (inner circumferential surface) of the ray-transmitting base member 171*a* and the outside (outer circumferential surface) of fitting section 911 of the flange 910 and in the clearance from the ring-shaped groove 911*a* connected to the aforesaid clearance, and the flange 910 is joined to the inner end portion of the cylindrical ray-transmitting base member 171*a* through the joining elastic layer ST. With regard to hardness of the joining elastic layer ST, it is preferable that it is joined with flange 910 with appropriate hardness for the necessity to absorb stress of the ray-transmitting base member 171*a* and flange 910 and to minimize an amount of deformation, and hardness of 30–80 Hs (JIS A rubber hardness) is preferable.

On the outer side (outer circumferential surface) of the ray-transmitting base member 171*a* in which the flange 910 is fitted, there are formed elastic layer 171*d,* ray absorbing layer 171*b* and releasing layer 171*c* in this order in a way that they cover also an outer circumferential surface of fitting section 913 between the flange 910 and the ray-transmitting base member 171*a,* and thus, a rotary member for fixing is formed. Bearing portion 912 of flange 910 is fitted in metal bearing B1 representing a bearing member which is fitted in ray irradiating roller holder HL made of a metal member, and ray irradiating roller 17*a* is fixed on the ray irradiating roller holder HL. Halogen lamp 171*g* is inserted inside the ray irradiating roller 17*a* to be held at the center position of the ray irradiating roller 17*a* by terminals JT on both ends. A radiation area of heat wave filament F1 representing a heat wave source of halogen lamp 171*g* in the ray irradiating roller 17*a* is mostly the same as that of filament F2 representing a heat source of halogen heater 471*c* in the fixing roller 47*a* described in FIG. 28, and it is provided to be of a width outside a passing area for the transfer material size (maximum transfer material size) inside fitting section 911 of flange 910. Although temperature rise at flange 910 caused by heat conduction is reduced by making the radiation area of the heat wave filament F1 to be inside the fitting section 911 of flange 910 or by using the ray irradiating roller holder HL made of a metal member and bearing B1, the flange 910 is subjected to heat expansion by heating, and an end portion tends to be cracked. In particular, microscopic cracks which are caused in the course of cutting and easily cause breakage exist on the glass end portion of the ray-transmitting base member 171*a*. Therefore, the surface of the end portion is heated to be melted. However, breakage from the end portion still tends to be caused because cracks are not eliminated completely and an end portion is deformed to be swelled. Accordingly, when thermal expansion of flange 910 is caused by heating in fixing, breakage of ray-transmitting base member 171*a* from its end portion is caused by the thermal expansion of the flange 910.

Therefore, the ring-shaped groove 911*a* is provided at the end portion for fitting between flange 910 and ray-transmitting base member 171*a* at the root portion of fitting section 911 so that the ray-transmitting base member 171*a* may be held not on the end portion at the root of fitting section 911 with flange 910 but on the inside from the end portion, a clearance from the inner wall surface of the ray-transmitting base member 171*a* at the end portion for fitting is set to be wider, avoiding the end portion of the ray-transmitting base member 171*a* which is heated and swelled roundly, and fitting section 911 is joined with the end portion of the ray-transmitting base member 171*a* through joining elastic layer ST representing an elastic member.

Owing to the structure stated above, it is possible to realize a fixing apparatus for quick start fixing with capability of instant heating wherein heat expansion of a flange member is absorbed by an elastic member, a space which allows deformation of the elastic member which is depressed by the end of the ray-transmitting base member when the flange member expands thermally is formed on the end portion of fitting between the flange member and ray-transmitting base member, internal pressure in the flange member can be lowered, deformation of the end portion of the ray-transmitting base member which is heated and swelled roundly can be coped with and breakage of the ray-transmitting base member from its end portion caused by thermal expansion of the flange member can be prevented. It is naturally possible to obtain further effect by employing the structure wherein the aforesaid structure and grooves and slits in FIGS. 30(*a*) and 30(*b*) and FIG. 31 are combined.

Owing to the first structure, thermal expansion of a flange member is absorbed by an elastic member, a contact area between the flange member and a ray-transmitting base member is made smaller by the flange member on which grooves are provided, a space which allows deformation of the elastic member which is depressed by the flange member when the flange member expands thermally is formed, thus, there is realized a fixing apparatus for quick start fixing with capability of instant heating in which breakage of the ray-transmitting base member from its end portion caused by thermal expansion of the flange member can be prevented. Further, owing to a flange member on which slits are provided, a contact area between the flange member and a ray-transmitting base member is made smaller, a space which allows deformation of an elastic member that is depressed by the flange member in the course of thermal expansion of the flange member is formed, and the flange member deforms towards its inside to lower the pressure, thus, there is realized a fixing apparatus for quick start fixing with capability of instant heating in which breakage of the ray-transmitting base member from its end portion caused by thermal expansion of the flange member can be prevented.

Owing to the second structure, thermal expansion of a flange member is absorbed by an elastic member, a space which allows deformation of the elastic member which is depressed by an end portion of a ray-transmitting base member when the flange member expands thermally is formed at an end portion of fitting between the flange member and the ray-transmitting base member, internal pressure can be lowered and deformation of the end portion of the ray-transmitting base member which is swelled roundly by heating can be coped with, thus, there is realized a fixing apparatus for quick start fixing with capability of instant heating in which breakage of the ray-transmitting base member from its end portion caused by thermal expansion of the flange member can be prevented.

Embodiment 1

In the fixing apparatus stated above, a cylindrical glass member is mainly used as a material for the ray-transmitting base member of the rotary member for applying heat, as stated above. Therefore, breakage of the ray-transmitting base member caused by thermal expansion resulting from heating of the ray-transmitting base member, breakage of the ray-transmitting base member on its end portions, in particular, is caused, or, rotation of the rotary member for applying heat is made to be unsmooth by thermal expansion of the ray-transmitting base member, and breakage of the ray-transmitting base member caused by pressurized holding and rotation thereof under the pressure, especially breakage of the ray-transmitting base member on its end portions tends to be caused.

Prevention of breakage caused by thermal expansion of the ray-transmitting base member of the rotary member for applying heat, a method of smoothing a rotation and prevention of breakage of the ray-transmitting base member caused by rotation of the ray-transmitting base member under the pressure, all related to the invention for solving the problems stated above, will be explained as follows, referring to FIGS. 33–38. FIG. 33 is a diagram showing the first example for preventing breakage caused by thermal expansion of the ray-transmitting base member, FIG. 34 is a diagram showing a preferable example of a resin-made cap member in FIG. 33, FIG. 35 is a diagram showing the second example of prevention of breakage caused by thermal expansion of the ray-transmitting base member, FIG. 36 is an illustration for fitting between the resin-made cap member in FIG. 35 and the ray-transmitting base member, FIG. 37 is a diagram showing the third example of prevention of breakage caused by thermal expansion of the ray-transmitting base member, and FIG. 38 is a diagram showing another example of a method of providing a ray absorbing layer of the rotary member for applying heat which is common to each example of prevention of breakage caused by thermal expansion of the ray-transmitting base member.

In accordance with FIG. 33 or FIG. 34, ray irradiating roller 17*a* representing a rotary member for applying heat may be of the structure wherein ray-transmitting base member 171*a* is provided and ray absorbing layer 171*b* is provided on the outer circumferential surface of the ray-transmitting base member 171*a*, but it is preferable that ray-transmitting elastic layer 171*d* is provided between the ray-transmitting base member 171*a* employing mainly ceramic members (glass members) such as Pyrex glass, sapphire ($Al_2O_3$) and $CaF_2$ as stated above, and the ray absorbing layer 171*b*.

The ray-transmitting elastic layer 171*d* is made to be 0.5 mm or more in terms of layer thickness to protect the ray-transmitting base member 171*a* and thereby to prevent breakage of the ray-transmitting base member 171*a*, and it prevents breakage of the ray-transmitting base member 171*a* caused by pressurized holding and rotation of the ray-transmitting base member 171*a* under the pressure. Further, resin cap JC1 representing a ring-shaped, heat-resistant and resin-made cap member is fitted on each of outer circumferential surfaces of both end portions of the ray-transmitting base member 171*a* to be outside the elastic layer 171*d* in the direction that is in parallel with a center axis of the cylindrical ray-transmitting base member 171*a*, so that the ray-transmitting base member 171*a* is covered by the resin caps JC1. It is preferable that an end portion of each resin cap JCl facing the elastic layer 171*d* is positioned to be outside a ray emitting area of halogen lamp 171*g* or of a Xenon lamp (not shown) provided inside the ray-transmitting base member 171*a*. Further, B1 representing a bearing member mounted on bearing holder BH1 is fitted on the outer circumferential surface of ring-shaped resin cap JC1 so that ray irradiating roller 17*a* is supported to be rotatable. The resin cap JC1 may be provided to be movable against the ray-transmitting base member 171*a* so that it is possible to cope with a change of thermal expansion of the ray-transmitting base member 171*a*, but it is preferable, as shown in FIG. 34, that slot SL is provided on a ring portion of the resin cap JC1. Due to this, elasticity in the radial direction of the resin cap JC1 is generated.

As stated above, a movable resin-made cap member, especially, a resin-made cap member provided thereon with a slot absorbs thermal expansion on the part of the ray-transmitting base member, and breakage of the ray-transmitting base member employing mainly glass member on its end portion and breakage of the ray-transmitting base member on its end portions caused by pressurized holding and rotation of the ray-transmitting base member under pressure, are prevented. Further, owing to a movable resin-made cap member, especially, a resin-made cap member provided with a slot and to a bearing member, even when a ray-transmitting base member is subjected to thermal expansion by heating, the thermal expansion is absorbed by the movable resin-made cap member and a rotary member for applying heat is rotated smoothly.

In accordance with FIG. 35 or FIG. 36, ray irradiating roller 17*a* representing a rotary member for applying heat may be of the structure wherein ray-transmitting base member 171*a* is provided and ray absorbing layer 171*b* is provided on the outer circumferential surface of the ray-transmitting base member 171*a*, but it is preferable that ray-transmitting elastic layer 171*d* is provided between the ray-transmitting base member 171*a* employing mainly ceramic members (glass members) such as Pyrex glass, sapphire ($Al_2O_3$) and $CaF_2$ as stated above, and the ray absorbing layer 171*b*.

The ray-transmitting elastic layer 171*d* is made to be 0.5 mm or more in terms of layer thickness to protect the ray-transmitting base member 171*a* and thereby to prevent breakage of the ray-transmitting base member 171*a*, and it prevents breakage of the ray-transmitting base member 171*a* caused by pressurized holding and rotation of the ray-transmitting base member 171*a* under the pressure. Further, resin cap JC2 representing a ring-shaped, heat-resistant and resin-made cap member is fitted on each of outer circumferential surfaces of both end portions of the ray-transmitting base member 171*a* to be outside the elastic layer 171*d* in the direction that is in parallel with a center axis of the cylindrical ray-transmitting base member 171*a*, so that the ray-transmitting base member 171*a* is covered by the resin cap JC2. It is preferable that an end portion of each resin cap JC2 facing the elastic layer 171*d* is positioned to be outside a ray emitting area of halogen lamp 171*g* or of a Xenon lamp (not shown) provided inside the ray-transmitting base member 171*a*. Further, B1 representing a bearing member mounted on bearing holder BH1 is fitted on the outer circumferential surface of ring-shaped resin cap JC2 so that ray irradiating roller 17*a* is supported to be rotatable. With regard to the resin cap JC2, gear-shaped protrusion TS which can be deformed following thermal expansion is provided on the fitting portion between the resin cap JC2 and ray-transmitting base member 171*a* as shown in FIG. 36 so that it is possible to cope with a change in thermal expansion of the ray-transmitting base member 171*a*, and the gear-shaped protrusion TS is fitted in the ray-transmitting base member 171*a* to be fixed therein.

As stated above, deformation of the gear-shaped protrusion of the resin-made cap member absorbs thermal expansion on the part of the ray-transmitting base member, and breakage of the ray-transmitting base member employing mainly glass member on its end portion and breakage of the ray-transmitting base member on its end portion caused by pressurized holding and rotation of the ray-transmitting base member under pressure, are prevented. In addition, owing to the resin-made cap member having a gear-shaped protrusion and a bearing member, even when thermal expansion of the ray-transmitting base member is caused by heating, the thermal expansion is absorbed by deformation of the gear-shaped protrusion and thereby, a rotary member for applying heat rotates smoothly.

Incidentally, it is also possible to provide a slot (not shown) on the resin cap JC2 above and to make it to be movable relatively to the ray-transmitting base member 171*a*, and thereby to prevent thermal expansion of the ray-transmitting base member 171*a* and breakage of the ray-transmitting base member on its end portion caused by pressurized holding and rotation of the ray-transmitting base member under pressure.

In accordance with FIG. 37, ray irradiating roller 17*a* representing a rotary member for applying heat may be of the structure wherein ray-transmitting base member 171*a* is provided and ray absorbing layer 171*b* is provided on the outer circumferential surface of the ray-transmitting base member 171*a*, but it is preferable that ray-transmitting elastic layer 171*d* is provided between the ray-transmitting base member 171*a* employing mainly ceramic members (glass members) such as Pyrex glass, sapphire ($Al_2O_3$) and $CaF_2$ as stated above, and the ray absorbing layer 171*b*.

The ray-transmitting elastic layer 171*d* is made to be 0.5 mm or more in terms of layer thickness to protect the ray-transmitting base member 171*a* and thereby to prevent breakage of the ray-transmitting base member 171*a*, and it prevents breakage of the ray-transmitting base member 171*a* caused by pressurized holding and rotation of the ray-transmitting base member 171*a* under the pressure. Further, resin cap JC3 representing a ring-shaped, heat-resistant and resin-made cap member is fitted on each of outer circumferential surfaces of both end portions of the ray-transmitting base member 171*a* to be outside the elastic layer 171*d* in the direction that is in parallel with a center axis of the cylindrical ray-transmitting base member 171*a*, through elastic adhesion layer ST employing heat-resistant rubberlike (silicone rubber) adhesive agents, so that the ray-transmitting base member 171*a* is covered and fixed by the resin cap JC3. It is preferable that an end portion of each resin cap JC3 facing the elastic layer 171*d* is positioned to be outside a ray emitting area of halogen lamp 171*g* or of a Xenon lamp (not shown) provided inside the ray-transmitting base member 171*a*. Further, bearing BI representing a bearing member mounted on bearing holder BH1 is fitted on the outer circumferential surface of ring-shaped resin cap JC3 so that ray irradiating roller 17*a* is supported to be rotatable.

As stated above, elasticity of the adhesion layer on which a resin-made cap member is fitted absorbs thermal expansion on the part of the ray-transmitting base member, and breakage of the ray-transmitting base member employing mainly glass member on its end portion and breakage of the ray-transmitting base member on its end portion caused by pressurized holding and rotation of the ray-transmitting base member under pressure, are prevented. In addition, owing to the resin-made cap member fitted through the adhesion layer and a bearing member, even when thermal expansion of the ray-transmitting base member is caused by heating, the thermal expansion is absorbed by elasticity of the adhesion layer and thereby, a rotary member for applying heat rotates smoothly.

Incidentally, it is also possible to provide a slot (not shown) on the resin cap JC3 above and to make it to be movable relatively to the ray-transmitting base member 171*a*, and thereby to prevent thermal expansion of the ray-transmitting base member 171*a* and breakage of the ray-transmitting base member on its end portion caused by pressurized holding and rotation of the ray-transmitting base member under pressure.

Since a ray of halogen lamp 171*g* or of a Xenon lamp (not shown) includes also emission in the oblique direction, it is preferable that ray absorbing layer 171*b* is provided to be extended to the outside of a ray emitting area, and it is more preferable that the ray absorbing layer 171*b* is provided up to an end portion (an end portion of the ray-transmitting base member 171*a*) of each of resin-made cap members (resin caps JC1, JC2 and JC3) explained in each example in FIGS. 33–37. In this case, owing to the ray absorbing layer 171*b* provided up to an end portion (an end portion of the ray-transmitting base member 171*a*) of each of resin-made cap members (resin caps JC1, JC2 and JC3), even when heat is generated on the resin-made cap member portion, the heat is let off on the part of the ray-transmitting base member 171*a*.

Breakage of the ray-transmitting base member, especially breakage of the ray-transmitting base member on its end portion, caused by thermal expansion of the ray-transmitting base member, resulting from heating of the ray-transmitting base member, and breakage of the ray-transmitting base member, especially breakage of the ray-transmitting base member on its end portion, caused by pressurized holding and rotation of the ray-transmitting base member, are prevented in each of the examples stated above. In particular, breakage of the ray-transmitting base member, especially breakage of the ray-transmitting base member on its end portion, caused by thermal expansion of the ray-transmitting base member, resulting from heating of the ray-transmitting base member, and breakage of the ray-transmitting base member, especially breakage of the ray-transmitting base member on its end portion, caused by pressurized holding and rotation of the ray-transmitting base member, when a lass member is used as a ray-transmitting base member, are prevented. Further, even when thermal expansion is caused on the ray-transmitting base member by heating, a rotary member for applying heat rotates smoothly.

Embodiment 2

In the fixing apparatus stated above, a cylindrical glass member is mainly used as a material for the ray-transmitting base member of the rotary member for applying heat, as stated above. Therefore, there are caused problems that a ray-transmitting base member is damaged, especially an end portion is damaged, in the course of handling a rotary member for applying heat.

Prevention of breakage caused in the course of handling a rotary member for applying heat related to the invention to solve the foregoing will be explained as follows, referring to FIGS. 39–42. FIG. 39 is a diagram showing the first example for preventing breakage caused in the course of handling a ray-transmitting base member, FIG. 40 is a diagram showing the second example for preventing breakage caused in the course of handling a ray-transmitting base member, FIG. 40 is a diagram showing the third example for preventing breakage caused in the course of handling a ray-transmitting base member, and FIG. 42 is a diagram showing another example of a method of providing an elastic layer of a rotary member for applying heat which is common to each example of preventing breakage caused in handling a ray-transmitting base member.

In accordance with FIG. 39, ray irradiating roller 17*a* representing a rotary member for applying heat is structured by providing ray-transmitting base member 171*a* employing mainly ceramic members (glass members) such as Pyrex glass, sapphire ($Al_2O_3$) or $CaF_2$ as stated above, elastic layer 171*d* arranged on the outer side (outer circumferential surface) of the ray-transmitting base member 171*a* and ray absorbing layer 171*b* in this order, and the ray-transmitting elastic layer 171*d* is formed on an area (nipping area) of nipping portion N of the ray irradiating roller 17*a*.

The ray-transmitting elastic layer 171*d* is made to be 0.5 mm or more in terms of layer thickness to protect the ray-transmitting base member 171*a* so that the ray-transmitting base member 171*a* may withstand falling of ray irradiating roller 17*a* or shock thereof. However, both end portions of the ray-transmitting base member 171*a* are exposed and are feared to be damaged in the course of handling. For protecting the both end portions, therefore, elastic protection layer DS employing heat-resistant resin member such as, for example, fluorine-contained resin is formed on each of both end portions of outer circumferential surface of the ray-transmitting base member 171*a*, to be in parallel with a center axis of the cylindrical ray-transmitting base member 171*a* and to be on the outside of the elastic layer 171*d* in an area of nipping portion N in terms of the direction that is in parallel with the center axis of the cylindrical ray-transmitting base member 171*a*. It is effective for prevention of breakage that the elastic protection layer DS is provided up to the side of the end portion of the ray-transmitting base member 171*a*. In the course of molding of the elastic protection layer DS, bearing B2 representing a bearing member is provided solidly with the elastic protection layer DS to be concentric with the ray-transmitting base member 171*a*. Bearing holder BH2 is fitted on the outer circumferential surface of the bearing B2, and thereby, the ray irradiating roller 17*a* is supported to be rotatable. It is preferable that an outer side of the area of nipping portion N which is within the end portion of the elastic protection layer DS facing the elastic layer 171*d* is made to be a ray emitting area for halogen lamp 171*g* or for a Xenon lamp (not shown) provided inside the ray-transmitting base member 171*a*.

As stated above, breakage of a ray-transmitting base member caused by its falling or shock in the course of handling of the ray-transmitting base member employing mainly glass member in a rotary member for applying heat is prevented by the elastic layer forming a nipping portion, and breakage of an end portion caused in handling is prevented by an elastic protection layer provided on each of both end portions of the ray-transmitting base member.

In accordance with FIG. 40, ray irradiating roller 17*a* representing a rotary member for applying heat is structured by providing ray-transmitting base member 171*a* employing mainly ceramic members (glass members) such as Pyrex glass, sapphire ($Al_2O_3$) or $CaF_2$ as stated above, ray-transmitting elastic layer 171*d* and ray absorbing layer 171*b* both arranged on the outer side (outer circumferential surface) of the ray-transmitting base member 171*a*, in this order, and the ray-transmitting elastic layer 171*d* is formed on an area (nipping area) of nipping portion N of the ray irradiating roller 17*a*.

The ray-transmitting elastic layer 171*d* is made to be 0.5 mm or more in terms of layer thickness to protect the ray-transmitting base member 171*a* so that the ray-transmitting base member 171*a* may withstand falling of ray irradiating roller 17*a* or shock thereof. However, both end portions of the ray-transmitting base member 171*a* are exposed, and they are feared to be damaged in the course of handling. For protecting the both end portions, therefore, resin layer JS employing heat-resistant resin member such as, for example, fluorine-contained resin is formed on each of both end portions of outer circumferential surface of the ray-transmitting base member 171*a*, to be in parallel with a center axis of the cylindrical ray-transmitting base member 171*a* and to be on the outside of the elastic layer 171*d* in an area of nipping portion N in terms of the direction that is in parallel with the center axis of the cylindrical ray-transmitting base member 171*a*. It is effective for prevention of breakage that the elastic protection layer DS is provided up to the side of the end portion of the ray-transmitting base member 171*a*. In the course of molding of the resin layer JS, bearing B2 representing a bearing member is provided solidly with the resin layer JS to be concentric with the ray-transmitting base member 171*a*. Bearing holder BH2 is fitted on the outer circumferential surface of the bearing B2, and thereby, the ray irradiating roller 17*a* is supported to be rotatable. It is preferable that an outer side of the area of nipping portion N which is within the end portion of the resin layer JS facing the elastic layer 171*d* is made to be a ray emitting area for halogen lamp 171*g* or for a Xenon lamp (not shown) provided inside the ray-transmitting base member 171*a*. It is also possible to extend ray absorbing layer 171*b* covered by releasing layer 171*c* employing fluorine-contained resin, in place of the resin layer JS, or it is possible to cover with a heat-resistant tape employing fluorine-contained resin.

As stated above, breakage of a ray-transmitting base member caused by its falling or shock in the course of handling of the ray-transmitting base member employing mainly glass member in a rotary member for applying heat is prevented by the elastic layer forming a nipping portion, and breakage of an end portion caused in handling is prevented by a resin layer provided on each of both end portions of the ray-transmitting base member.

In accordance with FIG. 41, ray irradiating roller 17*a* representing a rotary member for applying heat is structured by providing ray-transmitting base member 171*a* employing mainly ceramic members (glass members) such as Pyrex glass, sapphire ($Al_2O_3$) or $CaF_2$ as stated above, ray-transmitting elastic layer 171*d* arranged on the outer side (outer circumferential surface) of the ray-transmitting base member 171*a* and ray absorbing layer 171*b* in this order, and the ray-transmitting elastic layer 171*d* is formed on an area (nipping area) of nipping portion N of the ray irradiating roller 17*a*.

The ray-transmitting elastic layer 171*d* is made to be 0.5 mm or more in terms of layer thickness to protect the ray-transmitting base member 171*a* so that the ray-transmitting base member 171*a* may withstand falling of ray irradiating roller 17*a* or shock thereof. However, both end portions of the ray-transmitting base member 171*a* are exposed, and they are feared to be damaged in the course of handling. For protecting the both end portions, therefore, resin flange JF representing a resin-made flange member employing a heat-resistant resin member such as, for example, fluorine-contained resin, on which bearing B2 representing a bearing member is provided solidly, is fitted on each of both end portions of outer circumferential surface of the ray-transmitting base member 171*a*, to be in parallel with a center axis of the cylindrical ray-transmitting base member 171*a* and to be on the outside of the elastic layer 171*d* in an area of nipping portion N in terms of the direction that is in parallel with the center axis of the cylindrical ray-transmitting base member 171*a*. It is effective for prevention of breakage that the resin flange JF is provided up to the side of the end portion of the ray-transmitting base member 171*a*. Bearing holder BH2 is fitted on the outer circumferential surface of the bearing B2, and thereby, the ray irradiating roller 17*a* is supported to be rotatable. It is preferable that an outer side of the area of nipping portion N which is within the end portion of the resin flange JF facing the elastic layer 171*d* is made to be a ray emitting area for halogen lamp 171*g* or for a Xenon lamp (not shown) provided inside the ray-transmitting base member 171*a*.

As stated above, breakage of a ray-transmitting base member caused by its falling or shock in the course of handling of the ray-transmitting base member employing mainly glass member in a rotary member for applying heat is prevented by the elastic layer forming a nipping portion, and breakage of an end portion caused in handling is prevented by a resin-made flange member provided on each of both end portions of the ray-transmitting base member.

As shown in FIG. 42, ray-transmitting elastic layer 171*d* in a nipping area in each example stated above is provided up to, or to exceed, an end portion of ray-transmitting base member 171*a*, so that breakage of both end portions of the ray-transmitting base member 171*a* may be prevented in the course of handling. On both end portions of the inside (inner circumferential surface) of the ray-transmitting base member 171*a*, there are provided elastic protection layer DS which is united solidly with bearing B3 representing the bearing member described in FIG. 39, resin layer JS which is united solidly with bearing B3 representing the bearing member described in FIG. 40 and resin flange JF which is united solidly with bearing B3 representing the bearing member described in FIG. 41, so that breakage of both end portions may further be prevented. On the outer circumferential surface of bearing B3, there is fitted bearing holder BH3 and thereby, ray irradiating roller 17*a* is supported to be rotatable. It is preferable that an area within both end portions of elastic layer 171*d* of elastic protection layer DS, resin layer JS or resin flange JF is made to be a ray emitting area of halogen lamp 171*g* or a Xenon lamp (not shown) provided inside the ray-transmitting base member 171*a*.

Each example stated above prevents breakage of a ray-transmitting base member in the course of handling with regard to a rotary member for applying heat, especially breakage on the end portion of the ray-transmitting base member, and in particular, breakage of a ray-transmitting base member in the course of handling, especially breakage on the end portion of the ray-transmitting base member, on the occasion wherein a glass member is used as a ray-transmitting base member.

Embodiment 3

In the fixing apparatus stated above, a cylindrical glass member is mainly used as a material for the ray-transmitting base member of the rotary member for applying heat, as stated above. Therefore, there is caused a problem, in particular, that an end portion of the ray-transmitting base member is damaged in the course of assembling the fixing apparatus.

Referring to FIGS. 43, 26 and 33, there will be explained prevention of breakage on the end portion of the ray-transmitting base member in the course of assembly of the fixing apparatus related to the invention for solving the problem stated above. FIG. 33 is a diagram showing a method of assembling a fixing apparatus wherein breakage on an end portion of a ray-transmitting base member is prevented.

In accordance with FIG. 43, fixing apparatus 17 is composed of ray irradiating roller 17*a* representing an upper roll-shaped rotary member for applying heat for fixing a toner image and fixing roller 47*a* representing a lower rollshaped rotary member for fixing. Inside the ray irradiating roller 17*a*, there is provided halogen lamp 171*g* or a Xenon lamp (not shown) which emits heat rays such as infrared radiation containing visible light depending on a light source or far infrared radiation, as a ray irradiating means. Most (at least an area forming a nipping portion) of the outer side (outer circumferential surface) of ray-transmitting base member 171*a* (not shown in FIG. 43) of the ray irradiating roller 17*a* is covered by ray-transmitting elastic layer 171*d* (not shown in FIG. 43) having a thickness of 0.5 mm or more, in the same way as in explanation in Embodiment 1 and Embodiment 2, so that breakage in the course of handling may be prevented. However, an end portion is easily damaged because it is exposed. In assembly of fixing apparatus 17, therefore, each of both ends of the ray irradiating roller 17*a* is first covered by cap CP representing a protection member made of, for example, rubber, paper or resin, then, the ray irradiating roller 17*a* whose end portion is covered by cap CP is inserted in fixing housing 17A in which fixing roller 47*a* is housed, and the ray irradiating roller 17*a* is mounted to face the fixing roller 47*a* (④). Then, the caps CP are removed from both end portions of the ray irradiating roller 17*a* (②), and resin cap JC1 representing the resin-made cap member explained in FIG. 33 in Embodiment 1, for example, is fitted on each of both end portions of the ray irradiating roller 17*a*, and after that, there are mounted, on the resin caps JC1, bearing holders BH1 in each of which bearing Bi representing a bearing member is fitted (③), and the bearing holder BH1 is fixed on the fixing housing 17A with unillustrated screws, thus, the ray irradiating roller 17*a* is supported rotatably by the bearing B1, and assembly of the fixing apparatus 17 is completed.

It is preferable that halogen lamp 171*g* or an unillustrated Xenon lamp shown with one-dot chain lines is made to be housed in ray irradiating roller 17*a* so that the halogen lamp 171*g* or the Xenon lamp (not shown) may be supported by round holes H1 of caps CP on both ends, and ray-transmitting base member 171*a* (not shown in FIG. 43) of the ray irradiating roller 17*a* which is easily damaged and halogen lamp 171*g* or the Xenon lamp (not shown) are handled solidly. It is more preferable that cap CP is provided with slot WA as shown with one-dot chain lines, and cap CP is widened along the slot WA to be removed after halogen lamp 171*g* or Xenon lamp (not shown) is fixed by mounting the ray irradiating roller 17*a*.

Owing to the foregoing, breakage on the end portion of a ray-transmitting base member of a rotary member for applying heat caused in the course of assembly of a fixing apparatus, in particular, breakage on the end portion of a ray-transmitting base member of a rotary member for applying heat on the occasion wherein a glass member is used as a ray-transmitting base member, is prevented.

As a side-sectional structural diagram of fixing apparatus 17 is shown in FIG. 44, ray irradiating roller 17*a* representing a rotary member for applying heat is composed of ray-transmitting base member 171*a*, ray-transmitting elastic layer 171*d* and ray absorbing layer 171*b* both provided on the outer side (outer circumferential surface) of the ray-transmitting base member 171*a*, in this order, and the ray absorbing layer 171*b* is provided up to the end portion of the ray-transmitting base member 171*a*. Further, flange FR1 representing a rotary shaft employing a metallic member made by stainless steel or heat-resistant polyimide resin, for example, is provided to be in parallel with a center axis of the ray-transmitting base member 171*a* on each of both end portions of an inner circumferential surface of the ray-transmitting base member 171*a*. The flange FR1 representing a rotary shaft is fitted in bearing B1 representing a bearing member which is force-fitted in bearing holder BH1, and thereby the ray irradiating roller 17*a* is held rotatably. It is preferable that a ray emitting area of halogen lamp 171*g* provided at the center inside the ray-transmitting base member 171*a* is positioned within both side end portions of flanges FR1.

Lower pressure roller 47*a* composed of core bar 471*a*, rubber roller layer 471*b* and tube 471*c* made of heat-resistant fluorine-contained resin is fitted, while it is pressed by upper ray irradiating roller 17*a*, in bearing B2 which is force-fitted in bearing holder BH1, so that the lower pressure roller 47*a* is held rotatably. The pressure roller 47*a* is driven to rotate through gear Ga provided at an end portion on one side of the core bar 471*a* of the pressure roller 47*a*, and the ray irradiating roller 17*a* is driven to rotate.

On ray irradiating roller 17*a*, ray absorbing layer 171*b* is provided to be broader than a ray emitting area so that heat rays may be absorbed sufficiently. Therefore, in the direction of an axis of the ray irradiating roller 17*a*, width H2 (ray absorbing layer width H2 mm) of the ray irradiating roller 17*a* is made to be broader than width H1 (ray emitting area width H1 mm) of an ray emitting area of halogen lamp 171*g* through which a transfer material having a width (297 mm) for longitudinal feeding of the maximum A-3 size is conveyed (H2 >H1). Width of actual ray absorbing layer HA (actual ray absorbing layer width A mm) which will be described later is naturally broader than ray emitting area width H1, and for example, it is made to be broader by 10–40 mm in terms of total length than ray emitting area width H1 through which a transfer material having a width (297 mm) for longitudinal feeding of the maximum A-3 size is conveyed, but it is narrower than ray absorbing layer H2.

On ray irradiating roller 17*a*, temperature rise of the ray absorbing layer 171*b* at the portion corresponding to the ray emitting area width Hi of halogen lamp 171*g* inside the ray irradiating roller 17*a* is rapid, and the ray absorbing layer 171*b* needs to be provided to be broader than ray emitting area width H1 so that heat rays may be absorbed sufficiently. Moreover, an inside of the ray absorbing layer 171*b* is ray-transmitting, and heat rays are leaked, and heat generation of the ray absorbing layer 171*b* at the portion (outside ray emitting area width H1) exceeding the ray emitting area width H1 is carried out, thus, heat is accumulated on the portion where no transfer material is conveyed, resulting in abnormal temperature rise. To prevent this, width H3 of a nipping portion (nipping portion width H3 mm) between pressure roller 47*a* forming a nipping portion and the ray irradiating roller 17*a* in the direction of an axis of the ray irradiating roller 17*a* is made to be broader in terms of total length than ray emitting area width Hi by 20–50 mm (H3>H1). Nipping portion width H3 may roughly be the same as ray absorbing layer width H2, but it is more preferable to make width H4 of a pressure roller (pressure roller width H4 mm) to be broader than width H3 of a nipping portion (or width H2 of a ray absorbing layer) (H4>H3, or H4>H2). Due to this, pressure roller 47*a* absorbs and thereby prevents temperature rise on the area of the ray absorbing layer 171*b* which is exceeding the ray emitting area width H1 (outside the ray emitting area width H1) and is not touched by an advancing transfer material.

In the foregoing structure, flange FR1 serving as a rotary shaft is provided inside the ray-transmitting base member 171*a* of the ray irradiating roller 17*a* and thereby the ray irradiating roller 17*a* is held by bearing B1 representing a bearing member, because it is difficult to hold the ray irradiating roller 17*a* due to nipping portion width H3 which is broader than ray absorbing layer width H2 (a width of pressure roller 47*a* is broader than nipping portion width H3). As stated above, it is preferable that an end portion of the flange FR1 representing the rotary shaft closer to a ray emitting area is placed to be away from the ray emitting area (to be outside the ray emitting area), so that the end portion may not be heated by halogen lamp 171*g*. When viewed from the halogen lamp 171*g*, an area regarded as ray absorbing layer 171*b* is made to be narrower by an amount equivalent to flange FR1 provided inside (on an inner circumferential surface of) the ray-transmitting base member 171*a* (width HA of actual ray absorbing layer).

Owing to the foregoing, abnormal heat generation on a ray absorbing layer outside the ray emitting area which is caused by a ray irradiating means in a rotary member for applying heat can be prevented.

As shown in FIG. 45, ray irradiating roller 17*a* representing a rotary member for applying heat of fixing apparatus 17 is composed of ray-transmitting base member 171*a*, ray-transmitting elastic layer 171*d* and ray absorbing layer 171*b* both provided on the outer side (outer circumferential surface) of the ray-transmitting base member 171*a*, in this order, and the ray absorbing layer 171*b* is provided up to the end portion of the ray-transmitting base member 171*a*. Further, there is provided resin flange JF1 representing a rotary shaft employing a resin member such as, for example, heat-resistant polyimide resin on each of both end portions of an outer circumferential surface of the ray-transmitting base member 171*a* to be in parallel with a center axis of the cylindrical ray-transmitting base member 171*a*. Resin flange JF1 which is provided on an end portion of the outside (outer circumferential surface) of the ray-transmitting base member 171*a* and has a great coefficient of thermal expansion prevents breakage of the ray-transmitting base member 171*a* employing mainly a glass member, the breakage being caused when the ray-transmitting base member 171*a* is heated and expands thermally. The resin flange JF1 representing a rotary shaft is force-fitted in bearing B1 representing a bearing member which is force-fitted in bearing holder BH1, thus, the ray irradiating roller 17*a* is supported rotatably.

Lower pressure roller 47*a* of fixing apparatus 17 formed by core bar 471*a*, rubber roller layer 471*b* and tube 471*c* made by heat-resistant fluorine-contained resin, is fitted in bearing B2 which is force-fitted in bearing holder BH1 under the state of pressure contact with the upper ray irradiating roller 17*a*, so that the lower pressure roller 47*a* is supported rotatably. The pressure roller 47*a* is driven to rotate by rotation of gear Ga provided on an end portion on one side of core bar 471*a* of the pressure roller 47*a*, and thereby the ray irradiating roller 17*a* is rotated.

On the ray irradiating roller 17*a*, ray absorbing layer 171*b* is provided to be broader than a ray emitting area so that rays may be absorbed sufficiently. For this reason, width H2*a* of a ray absorbing layer of ray irradiating roller 17*a* (ray absorbing layer width H2*a* mm) is made to be broader than width H1 a (ray emitting area width H1*a* mm) of a ray emitting area of halogen lamp 171*g* through which a transfer material having a width (297 mm) for longitudinal feeding of the maximum A-3 size is conveyed (H2*a*>H1*a*). Width HB of actual ray absorbing layer (actual ray absorbing layer width HB mm) in this case is naturally broader than ray emitting area width H1 a, but it is the same as ray absorbing layer width H2a.

On ray irradiating roller 17*a*, temperature rise of the ray absorbing layer 171*b* at the portion corresponding to the ray emitting area width H1 of halogen lamp 171*g* inside the ray irradiating roller 17*a* is rapid, and the ray absorbing layer 171*b* needs to be provided to be broader than ray emitting area width H1a so that heat rays may be absorbed sufficiently. Moreover, an inside of the ray absorbing layer 171*b* is ray-transmitting, and heat rays are leaked, and heat generation of the ray absorbing layer 171*b* at the portion (outside ray emitting area width H1*a*) exceeding the ray emitting area width H1 is carried out, thus, heat is accumulated on the portion where no transfer material is conveyed, resulting in abnormal temperature rise. To prevent this, width H3a of a nipping portion (nipping portion width H3a mm) between pressure roller 47*a* forming a nipping portion and the ray irradiating roller 17*a* in the direction of an axis of the ray irradiating roller 17*a* is made to be broader in terms of total length than ray emitting area width H1 a that is for conveying a transfer material having a width (297 mm) for longitudinal feeding of the maximum A-3 size, for example is conveyed, by 20–50 mm (H3*a*>H1*a*). Incidentally, when conveying a transfer material having a width (210 mm) for longitudinal feeding of the A-4 size, its outside generates heat abnormally. It is therefore preferable that two halogen lamps 171*g* each having a different irradiating width of rays are provided and they are used in accordance with a width of a transfer material. Due to this, pressure roller 47*a* absorbs and thereby prevents temperature rise on the area of the ray absorbing layer 171*b* which is exceeding the ray emitting area width H1 a (outside the ray emitting area width H1*a*) and is not touched by an advancing transfer material. Nipping portion width H3a is made to be slightly narrower than or the same in its maximum size as ray absorbing layer width H2*a*, because of providing resin flange JF1 outside the ray-transmitting base member 171*a*, but the nipping portion width H3a is regulated by pressure roller width H4*a* and is determined to be the same as width H4*a* of a pressure roller (pressure roller width H4*a* mm) (H4*a*=H3*a*, or H3*a*=H2*a*).

Owing to the foregoing, abnormal heat generation on a ray absorbing layer outside a ray emitting area caused by a ray irradiating means in a rotary member for applying heat can be prevented.

What is claimed is:

1. A fixing apparatus for fixing toner images on a transfer material upon which toner images have been placed by applying heat to the transfer material, the fixing apparatus comprising:

(a) a roll-shaped rotary member for applying heat to the transfer material upon which toner images have been placed, said roll-shaped rotary member including (1) a cylindrical ray-transmitting base member, (2) a ray absorbing layer for generating heat onto the transfer material upon which toner images have been placed so as to fix the toner on the transfer material, the ray absorbing layer, provided on an outer side of the ray-transmitting base member;

(b) a ray irradiating device for irradiating ray to said ray absorbing layer, the ray irradiating device provided inside the cylindrical ray-transmitting base member;

(c) bearing member for rotatably supporting the roll-shaped rotary member;

(d) flange members provided on both ends of the ray-transmitting base member;

(e) an elastic covering member provided between the flange member and the roll-shaped rotary member for joining each member;

(f) a pressure roller applying a pressure to the roll-shaped rotary member, a nip portion being formed between the pressure roller and the roll-shaped rotary member;

wherein, in the direction of an axis of the roll-shaped rotary member, a width of an area which the ray irradiating device irradiates light is narrower than a width of the nip portion and a width of the ray absorbing layer.

2. The fixing apparatus of claim 1, wherein the flange member is joined with an inner side of the ray-transmitting base member.

3. The fixing apparatus of claim 1, wherein the flange member is joined with an outer side of the ray-transmitting base member.

4. The fixing apparatus of claim 1, wherein the flange member is tapered at a joining portion with the ray-transmitting base member.

5. The fixing apparatus of claim 1, wherein the ray absorbing layer is provided on the ray-transmitting base member so that the outer side of the flange member over a joining portion of the flange member with the ray-transmitting base member is covered.

6. The fixing apparatus of claim 1, the roll-shaped rotary member further including, (3) a resilient layer provided on an outer side of the ray-transmitting base member, wherein the ray absorbing layer is provided on an outer side of the resilient layer.

7. The fixing apparatus of claim 1, a resilient layer is formed by a ray-transmitting rubber.

8. The fixing apparatus of claim 1, wherein the flange member comprises a groove or a slit on a joining portion with a ray-transmitting base member, and the flange member is joined with the outer side of the ray-transmitting base member through the joining elastic layer.

9. The fixing apparatus of claim 1, wherein the flange member is made of a electrically conductive member, and is joined with an inner side of the ray-transmitting base member through the joining elastic layer, and wherein the elastic covering member is provided in a clearance between a outer portion of the flange member and an inner wall surface of the ray-transmitting base member at an end portion of the joining with the ray-transmitting base member.

10. The fixing apparatus of claim 1, wherein both ends of a light source of the ray irradiating device are set inside to a position of each flange member in the longitudinal direction thereof.

11. The fixing apparatus of claim 1, the elastic covering member is a elastic rubber member.

12. The fixing apparatus of claim 11, wherein the elastic rubber member is formed by elastic rubber type filling agents or adhesives in a clearance between the roll-shaped rotary member and the flange member.

13. A fixing apparatus for fixing toner images on a transfer material upon which toner images have been placed by applying heat to the transfer material, the fixing apparatus comprising:

(a) a roll-shaped rotary member for applying heat to the transfer material upon which toner images have been placed, said roll-shaped rotary member including (1) a cylindrical ray-transmitting base member, (2) a ray absorbing layer for generating heat onto the transfer material upon which toner images have been placed so as to fix the toner on the transfer material, the ray absorbing layer, provided on an outer side of the ray-transmitting base member;

(b) a ray irradiating device for irradiating ray to said ray absorbing layer, the ray irradiating device provided inside the cylindrical ray-transmitting base member;

(c) bearing member for rotatably supporting the roll-shaped rotary member; and (d) an elastic covering member provided between the bearing member and the roll-shaped rotary member for joining each member;

wherein the elastic covering member is a resin cap member having a slit portion in a part of a ring of the resin cap member so as to provide the elasticity in the radial direction of the ray-transmitting base member and to follow an expansion of the ray-transmitting base member.

14. The fixing apparatus of claim 13, wherein the elastic covering member has a convex portion in a part of the ring of the resin cap member which provides the elasticity in the radial direction of the ray-transmitting base member and to follow an expansion of the ray-transmitting base member.

15. The fixing apparatus of claim 14, wherein the elastic covering member covers a surface of an end section of the ray-transmitting base member.

16. A fixing apparatus for fixing toner images on a transfer material upon which toner images have been placed by applying heat to the transfer material, the fixing apparatus comprising:

(a) a roll-shaped rotary member for applying heat to the transfer material upon which toner images have been placed, said roll-shaped rotary member including (1) a cylindrical ray-transmitting base member, (2) a ray absorbing layer for generating heat onto the transfer material upon which toner images have been placed so as to fix the toner on the transfer material, the ray absorbing layer, provided on an outer side of the ray-transmitting base member;

(b) a ray irradiating device for irradiating ray to said ray absorbing layer, the ray irradiating device provided inside the cylindrical ray-transmitting base member;

(c) bearing member for rotatably supporting the roll-shaped rotary member; and (d) an elastic covering member provided between the bearing member and the roll-shaped rotary member for joining each member;

the elastic covering member comprises an elastic rubber portion and a covering portion of resin, and the covering portion is a flange member provided between the elastic rubber portion and the bearing member.

17. A fixing apparatus for fixing toner images on a transfer material upon which toner images have been placed by applying heat to the transfer material, the fixing apparatus comprising:

(a) a roll-shaped rotary member for applying heat to the transfer material upon which toner images have been placed, said roll-shaped rotary member including
(1) a cylindrical ray-transmitting base member,
(2) a ray absorbing layer for generating heat onto the transfer material upon which toner images have been placed so as to fix the toner on the transfer material, the ray absorbing layer, provided on an outer side of the ray-transmitting base member;

(b) a ray irradiating device for irradiating ray to said ray absorbing layer, the ray irradiating device provided inside the cylindrical ray-transmitting base member;

(c) bearing member for rotatably supporting the roll-shaped rotary member; and (d) an elastic covering member provided between the bearing member and the roll-shaped rotary member for joining each member;

a pressure roller applying a pressure to the roll-shaped rotary member, a nip portion being formed between the pressure roller and the roll-shaped rotary member, wherein, in the direction of an axis of the roll-shaped rotary member, a width of an area which the ray irradiating device irradiates light is narrower than a width of the nip portion and a width of the ray absorbing layer.

18. The fixing apparatus of claim 17, wherein the elastic covering member has a elasticity in radial direction of the ray-transmitting base member.

19. The fixing apparatus of claim 17, wherein the elastic covering member is a elastic rubber member.

20. The fixing apparatus of claim 17, wherein the elastic covering member is formed by elastic rubber type filling agents or adhesives.

21. The fixing apparatus of claim 19, wherein the elastic covering member is formed by elastic rubber type filling agents or adhesives between the bearing member and the ray-transmitting base member.

22. The fixing apparatus of claim 19, wherein the elastic covering member covers a surface of an end section of the ray-transmitting base member.

23. The fixing apparatus of claim 17 wherein the elastic covering member covers a surface of an end section of the ray-transmitting base member in a clearance between the bearing member and the roll-shaped rotary member.

24. A fixing apparatus for fixing toner images on a transfer material upon which toner images have been placed by applying heat to the transfer material, the fixing apparatus comprising:

(a) a roll-shaped rotary member for applying heat to the transfer material upon which toner images have been placed, said roll-shaped rotary member including
(1) a cylindrical ray-transmitting base member,
(2) a ray absorbing layer for generating heat onto the transfer material upon which toner images have been placed so as to fix the toner on the transfer material, the ray absorbing layer, provided on an outer side of the ray-transmitting base member, and
(3) an elastic member provided on the outer side of the ray-transmitting base member;

(b) a ray irradiating device for irradiating ray to said ray absorbing layer, the ray irradiating device provided inside the cylindrical ray-transmitting base member;

(c) bearing member for rotatably supporting the roll-shaped rotary member; and (d) a pressure roller applying a pressure to the roll-shaped rotary member, a nip portion being formed between the pressure roller and the roll-shaped rotary member, wherein the elastic member is provided between the bearing member and the roll-shaped rotary member, and in the direction of an axis of the roll-shaped rotary member, a width of an area which the ray irradiating device irradiates light is narrower than a width of the nip portion and a width of the ray absorbing layer.

* * * * *